US012179312B2

(12) United States Patent
Moriura et al.

(10) Patent No.: US 12,179,312 B2
(45) Date of Patent: Dec. 31, 2024

(54) APPARATUS FOR POLISHING, PROCESSING SYSTEM, AND METHOD OF POLISHING

(71) Applicant: EBARA CORPORATION, Tokyo (JP)

(72) Inventors: Takuya Moriura, Tokyo (JP); Hiroshi Sotozaki, Tokyo (JP); Tadakazu Sone, Tokyo (JP); Masayoshi Ito, Tokyo (JP); Itsuki Kobata, Tokyo (JP); Hisanori Matsuo, Tokyo (JP); Tetsuya Terada, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 3 days.

(21) Appl. No.: 17/193,049

(22) Filed: Mar. 5, 2021

(65) Prior Publication Data

US 2021/0283746 A1 Sep. 16, 2021

(30) Foreign Application Priority Data

Mar. 6, 2020 (JP) ..... 2020-038725
Mar. 13, 2020 (JP) ..... 2020-044050
Jan. 12, 2021 (JP) ..... 2021-002919

(51) Int. Cl.
*B24B 57/02* (2006.01)
*B24B 37/04* (2012.01)

(52) U.S. Cl.
CPC ..... *B24B 57/02* (2013.01); *B24B 37/042* (2013.01)

(58) Field of Classification Search
CPC ..... B24B 7/228; B24B 37/005; B24B 37/04; B24B 37/044; B24B 37/10;
(Continued)

(56) References Cited

U.S. PATENT DOCUMENTS 4,451,507 A * 5/1984 Beltz ..... B01J 19/1887 118/321
5,679,063 A * 10/1997 Kimura ..... B24B 37/04 451/60
(Continued)

FOREIGN PATENT DOCUMENTS

CN 203418410 U * 2/2014
CN 105538128 A * 5/2016
(Continued)

OTHER PUBLICATIONS

Machine translation of CN-203418410-U (Year: 2014).*
(Continued)

*Primary Examiner* — Robert F Neibaur
(74) *Attorney, Agent, or Firm* — PEARNE & GORDON LLP

(57) ABSTRACT

There is provided an apparatus for polishing, comprising a table configured to support a polishing pad; a polishing head configured to hold a substrate; and a polishing solution supply device configured to supply a polishing solution between the polishing pad and the substrate. The polishing solution supply device comprises a plurality of polishing solution supply ports arrayed in a direction intersecting with a rotating direction of the polishing pad in a state that the polishing solution supply device is placed on an upstream side in rotation of the polishing pad relative to the substrate. The polishing solution supply device supplies the polishing solution, such that the polishing solution supplied from the plurality of polishing solution supply ports has a predetermined flow rate distribution.

19 Claims, 37 Drawing Sheets

(58) Field of Classification Search
CPC ..... B24B 37/102–107; B24B 37/30; B24B 37/345; B24B 49/08; B24B 49/16; B24B 53/017; B24B 57/02
USPC ..... 451/5, 41, 285–287, 444, 446, 449
See application file for complete search history.

(56) References Cited

U.S. PATENT DOCUMENTS

| | | | | |
|---|---|---|---|---|
| 5,997,392 | A * | 12/1999 | Chamberlin | B24B 57/02 451/446 |
| 6,139,406 | A * | 10/2000 | Kennedy | B24B 37/04 451/283 |
| 6,284,092 | B1 * | 9/2001 | Manfredi | B24B 57/02 451/446 |
| 6,336,850 | B1 | 1/2002 | Wada et al. | |
| 6,398,627 | B1 * | 6/2002 | Chiou | B24B 57/02 451/72 |
| 6,413,154 | B1 * | 7/2002 | Togawa | B24B 37/04 451/60 |
| 6,544,109 | B1 * | 4/2003 | Moore | B24B 37/04 451/60 |
| 6,699,529 | B2 | 3/2004 | Garner et al. | |
| 6,722,943 | B2 * | 4/2004 | Joslyn | B24B 37/04 451/60 |
| 6,887,132 | B2 * | 5/2005 | Kajiwara | B24B 37/04 451/60 |
| 6,926,584 | B2 * | 8/2005 | Chang | B24B 57/02 451/36 |
| 7,086,933 | B2 | 8/2006 | Vereen et al. | |
| 8,197,306 | B2 | 6/2012 | Borucki et al. | |
| 8,523,639 | B2 * | 9/2013 | Leighton | B24B 57/02 451/36 |
| 8,845,395 | B2 | 9/2014 | Borucki et al. | |
| 9,205,529 | B2 * | 12/2015 | Ham | B24B 57/02 |
| 9,296,088 | B2 | 3/2016 | Borucki et al. | |
| 2001/0034134 | A1 | 10/2001 | Lin et al. | |
| 2006/0105678 | A1 * | 5/2006 | Kohama | B24B 57/02 451/5 |
| 2017/0368663 | A1 | 12/2017 | Yang et al. | |
| 2020/0001427 | A1 * | 1/2020 | Soundararajan | B24B 37/015 |

FOREIGN PATENT DOCUMENTS

| | | | | |
|---|---|---|---|---|
| CN | 108177089 | A * | 6/2018 | B24B 57/02 |
| CN | 108326748 | A * | 7/2018 | B24B 57/02 |
| JP | H08-250457 | A | 9/1996 | |
| JP | H10-217114 | A | 8/1998 | |
| JP | H11-114811 | A | 4/1999 | |
| JP | 2903980 | B2 | 6/1999 | |
| JP | 2000-280166 | A | 10/2000 | |
| JP | 2001-088009 | A | 4/2001 | |
| JP | 2003-225862 | A | 8/2003 | |
| JP | 2003-324082 | A | 11/2003 | |
| JP | 2006-147773 | A | 6/2006 | |
| JP | 2011-530422 | A | 12/2011 | |
| JP | 2015-205355 | A | 11/2015 | |
| JP | 2019-520991 | A | 7/2019 | |
| KR | 10-2019-0005383 | A | 1/2019 | |
| KR | 10-2019-0058942 | A | 5/2019 | |
| WO | 2006/054732 | A2 | 5/2006 | |
| WO | 2010/019264 | A2 | 2/2010 | |

OTHER PUBLICATIONS

Machine translation of CN-105538128-A (Year: 2016).*
Machine translation of CN-108326748-A (Year: 2018).*
Machine translation of CN-108177089-A (Year: 2018).*

* cited by examiner

APPARATUS FOR POLISHING, PROCESSING SYSTEM, AND METHOD OF POLISHING

TECHNICAL FIELD

The present disclosure relates to an apparatus for polishing, a processing system, and a method of polishing.

BACKGROUND ART

In the manufacturing process of a semiconductor device, the planarization technology of the surface of the semiconductor device is of increasing significance. One known planarization technique is CMP (chemical mechanical polishing). This CMP uses a polishing apparatus to slide and polish a substrate such as a semiconductor wafer against a polishing pad with supplying a polishing solution (slurry) containing abrasive grains of, for example, silica ($SiO_2$) and/or ceria ($CeO_2$) to the polishing pad.

A polishing apparatus that performs a CMP process includes a polishing table configured to support a polishing pad, a polishing head configured to hold an object such as a substrate, and a polishing solution supply device configured to supply a polishing solution between the polishing pad and the substrate. This polishing apparatus causes the polishing solution to be supplied from the polishing solution supply device to the polishing pad, presses the substrate against the surface of the polishing pad (polishing surface) by a predetermined pressure, and rotates the polishing table and the polishing head to flatly polish the surface of the substrate.

U.S. Pat. No. 7,086,933 (Patent Document 1) discloses a polishing solution supply device including a first nozzle configured to supply a polishing solution to a center part of a polishing pad and a second nozzle configured to supply the polishing solution to a peripheral part of the polishing pad. This polishing solution supply device is configured to switch over between supply of the polishing solution from the first nozzle and supply of the polishing solution from the second nozzle according to the chemical properties of the polishing solution and the like.

A polishing apparatus that performs the CMP process includes a polishing table configured to support a polishing pad and a substrate holding mechanism called a top ring, a polishing head or the like to hold the substrate. This polishing apparatus causes a polishing solution to be supplied from a polishing solution supply nozzle to the polishing pad and presses the substrate against the surface of the polishing pad (polishing surface) by a predetermined pressure. The substrate is slid against the polishing surface by rotating the polishing table and the substrate holding mechanism, so that the surface of the substrate is polished to a flat, specular surface.

The polishing solution used for the CMP apparatus is expensive, and an additional cost is required to treat the used polishing solution. It is accordingly required to reduce the use amount of the polishing solution, with a view to reducing the operating cost of the CMP apparatus and the manufacturing cost of the semiconductor device. It is also required to suppress or prevent the influence of the used polishing solution and by-products on the quality and/or the polishing rate of the substrate.

One of the measures to solve such problems is to provide a polishing apparatus configured to supply a polishing solution onto a polishing pad via a polishing solution supply device or a regulation mechanism in a pad-like shape or in a box-like shape placed on the polishing pad (as described in, for example, Patent Documents 2 to 6 referred to below). Such a polishing solution supply device or regulation mechanism presses a wiper, a tank in a surrounding shape or an injector against the polishing pad to regulate the flow of the polishing solution. More specifically, Japanese Unexamined Patent Publication No. H10-217114 (Patent Document 2) describes a configuration that uses a regulation mechanism serving as a wiper to evenly spread over a polishing agent supplied from a polishing agent supply mechanism onto a polishing surface to supply the polishing agent to a substrate. Japanese Patent No. 2903980 (Patent Document 3) describes a configuration that causes a polishing solution spreading from the center of a polishing table outward of the polishing table by a centrifugal force to climb over one side wall of a rectangular parallelepiped container and flow into the rectangular parallelepiped container and to be supplied from a polishing surface center side in the other side wall to a substrate.

Japanese Unexamined Patent Publication No. H11-114811 (Patent Document 4) describes a configuration that places a bottomless tank in a surrounding shape on a polishing surface to supply a polishing solution from a location between a tank wall and the polishing surface and presses the tank against the polishing surface by a pressing shaft. Japanese Unexamined Patent Publication No. 2019-520991 (Patent Document 5) describes a configuration brings a wiper blade into contact with a polishing surface and supplies a polishing solution from a location between the wiper blade and the polishing surface to a substrate holding position. In this configuration, an actuator is operated to press the wiper blade and regulate the pressing force of the wiper blade against the polishing surface.

U.S. Pat. No. 8,845,395 (Patent Document 6) describes an apparatus that uses a pad-type injector (supply device) provided with weights placed inside thereof to supply a polishing solution onto a polishing surface. This pad-type supply device is supported on the polishing surface by a rod connected with a support structure outside of a polishing table and is pressed against the polishing surface by its own weight to supply the polishing solution from a clearance between a bottom face and the polishing surface to a substrate holding position.

RELATED ART DOCUMENT

Patent Document

Patent Document 1: U.S. Pat. No. 7,086,933

Patent Document 2: Japanese Unexamined Patent Publication No. H10-217114

Patent Document 3: Japanese Patent No. 2903980

Patent Document 4: Japanese Unexamined Patent Publication No. H11-114811

Patent Document 5: Japanese Unexamined Patent Publication No. 2019-520991

Patent Document 6: U.S. Pat. No. 8,845,395

SUMMARY OF INVENTION

Problem to be Solved

The polishing apparatus described in Patent Document 1 switches over the first nozzle and the second nozzle to change the supply location of the polishing solution. This apparatus, however, does not take into account maintaining the polishing rate of a substrate and reducing the use amount of a polishing solution.

More specifically, the polishing solution used for the polishing apparatus is expensive, and an additional cost is required to treat the used polishing solution. It is accordingly required to reduce the use amount of the polishing solution, with a view to reducing the operating cost of the polishing apparatus and the manufacturing cost of the semiconductor device. Simply reducing the supply amount of the polishing solution undesirably lowers the polishing rate of the substrate. In order to reduce the use amount of the polishing solution while keeping a predetermined polishing rate of the substrate, there is a requirement to supply the polishing solution such as to be spread over efficiently between the polishing pad and the substrate.

Accordingly, one object of the present disclosure is to maintain the polishing rate of a substrate and to reduce the use amount of a polishing solution.

The supply device or the regulation mechanism disclosed in the above patent documents is placed on the polishing surface during a polishing process, and the polishing solution and/or the polishing residue or the like is likely to be splashed and adhere to the surface and inside of the polishing solution supply device. The adhering polishing solution and/or polishing residue or the like is likely to be solidified on the surface or inside of the supply device and to fall off on the polishing surface. This may damage the surface of the substrate and may affect the polishing quality. The polishing apparatus is generally provided with a pad cleaning mechanism such as an atomizer or a high-pressure water rinsing device for the purpose of cleaning the surface of the polishing pad after the polishing process. Part of the polishing solution and/or the polishing residue or the like adhering to the supply device is removed in the process of cleaning the pad by this cleaning mechanism. This cleaning mechanism, however, performs cleaning on the polishing pad, so that the removed polishing solution and/or polishing residue or the like is likely to remain on the polishing pad. The remaining polishing solution and/or polishing residue or the like is likely to damage a next substrate that is a next object to be polished. There is accordingly a requirement to remove the polishing solution and/or the polishing residue or the like adhering to the supply device in a location outside of the polishing pad.

The supply device or the regulation mechanism disclosed in the above patent documents regulates the flow of the polishing solution by pressing the supply device against the polishing pad. A friction torque is generated between the polishing solution supply device and the polishing pad by rotation of the polishing table during a polishing process. This friction torque is likely to cause inclination or vibration of the supply device and thereby cause the non-uniform contact state of the supply device with the polishing pad. In this case, the non-uniform regulation of the flow of the polishing solution varies the polishing performance. In order to stabilize the polishing performance, there is also a requirement to suppress/prevent the non-uniform contact state of the supply device with the polishing pad caused by a friction torque in the polishing process.

An object of the present disclosure is to provide a polishing solution supply system that solves at least part of the problems described above.

Solution to Problem

According to one aspect of the present disclosure, there is provided an apparatus for polishing, comprising: a table configured to support a polishing pad; a polishing head configured to hold an object; and a polishing solution supply device configured to supply a polishing solution between the polishing pad and the object. The polishing apparatus causes the polishing pad and the object to be in contact with each other and to be rotated relative to each other in presence of the polishing solution and thereby polishes the object. The polishing solution supply device comprises a plurality of polishing solution supply ports arrayed in a direction intersecting with a rotating direction of the polishing pad in a state that the polishing solution supply device is placed on an upstream side in rotation of the polishing pad relative to the object. The polishing solution supply device supplies the polishing solution, such that the polishing solution supplied from the plurality of polishing solution supply ports has a predetermined flow rate distribution.

According to one aspect of the present disclosure, there is provided an apparatus for polishing configured to polish an object by using a polishing pad having a polishing surface. The apparatus for polishing comprises a polishing solution supply device; an arm configured to be horizontally movable relative to the polishing surface; a lifting mechanism configured to lift up and lower the arm; a following mechanism linked with the arm and with the polishing solution supply device and configured to cause the polishing solution supply device to follow the polishing surface of the polishing pad; and a suspending mechanism linked with the arm and with the polishing solution supply device and configured to suspend the polishing solution supply device while the arm is lifted up and lowered by the lifting mechanism. The following mechanism comprises two rods wherein each of the rods has a first end and a second end and the first end of each rod is mounted to the polishing solution supply device via a first spherical joint; and two second spherical joints fixed to the arm between the two rods and configured to slidably receive the second ends of the respective rods. The suspending mechanism comprises a first stopper fixed to the polishing solution supply device; and an engagement portion fixed to the arm and engaged with the first stopper when the arm is lifted up relative to the polishing solution supply device.

According to one aspect of the present disclosure, there is provided a method of polishing an object by using a polishing pad having a polishing surface. The method comprises lowering an arm connected with a polishing solution supply device to land the polishing solution supply device on the polishing surface, and subsequently further lowering the arm to release the polishing solution supply device from the arm; causing a polishing solution to be supplied from the polishing solution supply device onto the polishing surface, and pressing and polishing the object against the polishing surface with rotating the polishing pad and/or the object; and lifting up the arm after termination of polishing to cause the polishing solution supply device to be held by the arm, and lifting up the polishing solution supply device together with the arm.

DESCRIPTION OF EMBODIMENTS

The following describes embodiments of the present disclosure with reference to drawings. In the attached drawings, identical or similar components are expressed by identical or similar reference signs. In the explanation of the respective embodiments, overlapping description with regard to the identical or similar components may be omitted. Characteristics and features described in each of the embodiments are applicable to the other embodiments so far as they are not incompatible with each other.

In the description hereof, the term "substrate" includes not only semiconductor substrates, glass substrates, liquid crystal substrates and printed circuit boards but magnetic recording media, magnetic recording sensors, mirrors, optical elements, micromachine elements or partially manufactured integrated circuits, and any other objects to be processed. The substrate may be in any of various shapes including polygonal shapes and circular shapes. Although the expressions such as "front face", "back face", "front", "back", "upper (on, above)", "lower (below)", "left", "right", "vertical" and "horizontal" are used in the description hereof, these expressions only indicate the positions and the directions on the sheet surfaces of the illustrative drawings for the purpose of explanation and may be different from the positions and the directions in the actual layout, for example, during use of the apparatus.

(General Configuration of Polishing Apparatus)

Figure 1:
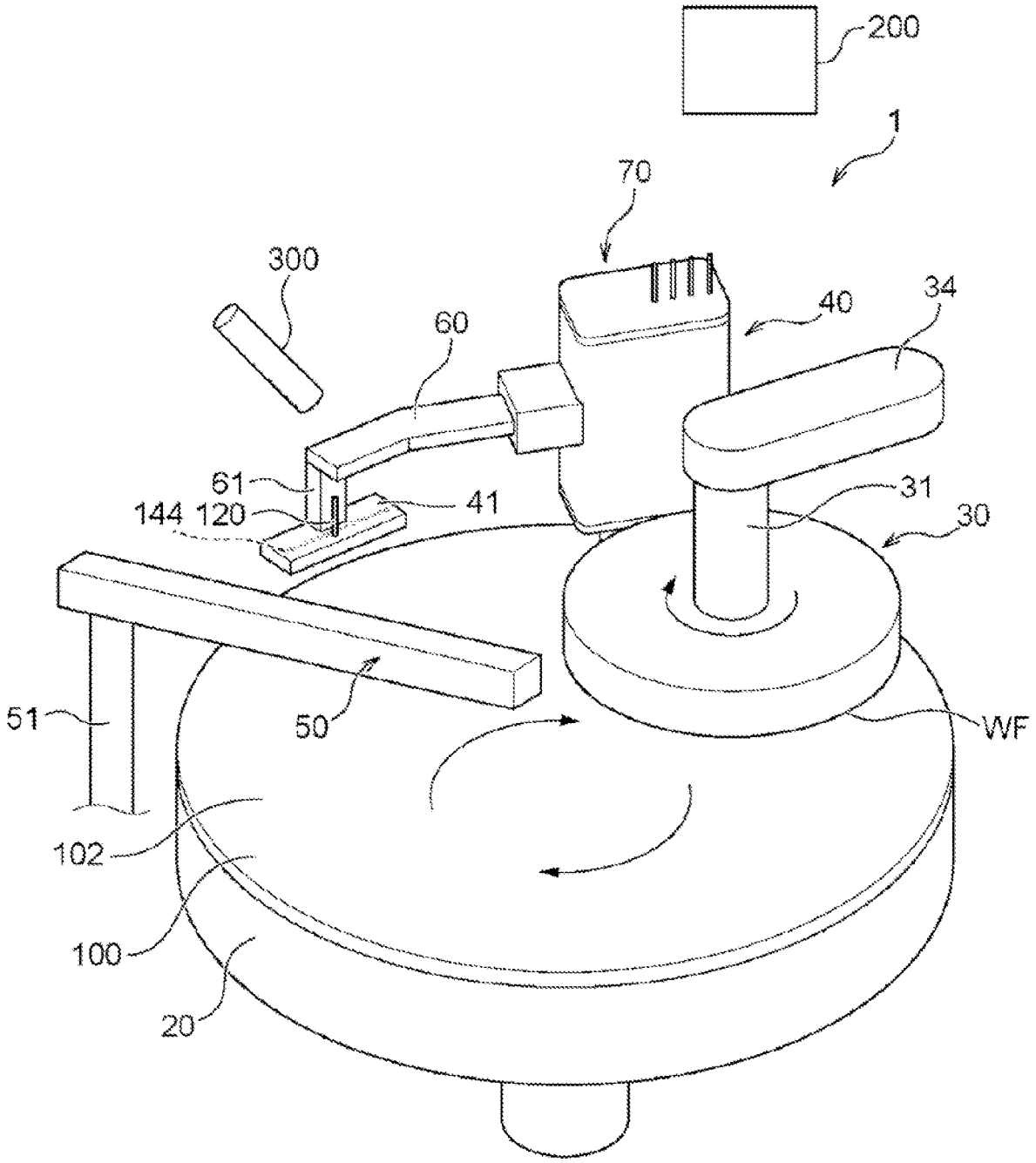
FIG. 1 is a diagram illustrating the schematic configuration of a polishing apparatus according to one embodiment of the present disclosure.

FIG. 1 is a diagram illustrating the schematic configuration of a polishing apparatus according to one embodiment of the present disclosure. A polishing apparatus 1 of the embodiment is configured to polish a substrate WF such as a semiconductor wafer as an object to be polished by using a polishing pad 100 having a polishing surface 102. As illustrated, the polishing apparatus 1 includes a polishing table 20 configured to support the polishing pad 100 and a polishing head (substrate holder) 30 configured to hold the substrate WF and press the substrate WF against the polishing surface 102 of the polishing pad 100. The polishing apparatus 1 further includes a polishing solution supply device 40 configured to supply a polishing solution (slurry) between the polishing pad 100 and the substrate WF, a cleaning mechanism 300 configured to supply a cleaning solution to the polishing solution supply device 40 turned to outside of the polishing pad 100, and an atomizer 50 configured to spray a liquid such as pure water and/or a gas such as nitrogen onto the polishing surface 102 so as to wash away the used polishing solution, the polishing residue and the like. The polishing solution supply device 40 is placed on an upstream side in rotation of the polishing pad 100 relative to the substrate WF. In the embodiment of FIG. 1, the cleaning mechanism 300 is placed above the polishing solution supply device 40. This configuration is, however, not essential. According to a modified configuration, for example, the cleaning mechanisms 300 may be placed above and below the polishing solution supply device 40 to clean the polishing solution supply device 40 in both upward and downward directions.

The polishing table 20 is formed in a disk-like shape and is configured to be rotatable about a center axis of the disk-like shape as an axis of rotation. The polishing pad 100 is mounted to the polishing table 20 by pasting or the like. A surface of the polishing pad 100 forms the polishing surface 102. As the polishing table 20 is rotated by a non-illustrated motor, the polishing pad 100 is rotated integrally with the polishing table 20.

The polishing head 30 has a lower face configured to hold the substrate WF by vacuum suction or the like. The polishing head 30 is configured to be rotatable along with the substrate by the power from a non-illustrated motor. The polishing head 30 has an upper portion connected with a support arm 34 via a shaft 31. The polishing head 30 is also configured to be movable in a vertical direction by motor driving via a non-illustrated air cylinder or ball bearing, so as to adjust the distance from the polishing table 20. This configuration enables the polishing head 30 to press the substrate WF held thereby against the polishing surface 102. Furthermore, the polishing head 30 has a non-illustrated airbag that is placed inside thereof and that is divided into a plurality of areas. A pressure is applied to the substrate WF from its back face by supplying a pressure of any fluid such as the air to the respective airbag areas. Moreover, the support arm 34 is configured to be turnable by a non-illustrated motor, so as to move the polishing head 30 in a direction parallel to the polishing surface 102. According to the embodiment, the polishing head 30 is configured to be movable between a non-illustrated substrate receiving position and an upper position above the polishing pad 100 and is also configured to change a pressing position where the substrate WF is pressed against the polishing pad 100.

The polishing solution supply device 40 includes a polishing solution supply member 41 configured to supply the polishing solution to the polishing pad 100. The polishing liquid supply member 41 is configured to be movable between a supply position on the polishing surface 102 and a retreat position on outside of the polishing table 20. The details of the polishing solution supply device 40 will be described later.

The atomizer 50 is connected with a pivot 51. The atomizer 50 is configured to be rotatable about the pivot 51 by a non-illustrated driving mechanism such as a motor and to be movable between an operating position on the polishing surface 102 and a retreat position on outside of the polishing table 20. The atomizer 50 is also configured to change the operating position and height on the polishing surface 102 by the non-illustrated driving mechanism such as the motor.

The polishing apparatus 1 further includes a controller 200 configured to control the general operations of the polishing apparatus 1. The controller 200 may be configured by a microcomputer that includes a CPU, memories and the like and that uses software such as a polishing recipe and/or information of machine parameters of relevant equipment input in advance to achieve desired functions, may be configured by a hardware circuit that performs exclusive arithmetic processing, or may be configured by a combination of the microcomputer and the hardware circuit that performs exclusive arithmetic processing.

The polishing apparatus 1 polishes the substrate WF by a procedure described below. The procedure first rotates the polishing pad 100, while rotating the polishing head 30 that holds the substrate WF. The procedure uses the polishing solution supply device 40 in this state to supply the polishing solution. More specifically, the polishing solution supply member 41 is moved to a predetermined position on the polishing surface 102 by a turning operation of an arm 60 by means of a turning mechanism 90 of a lifting turning mechanism 70 described later, is further lowered to a predetermined height by a lifting mechanism 80, and then starts supplying the polishing solution. This removes pure water or a chemical solution that is used for the purpose of conditioning or the like and that remains on the polishing pad 100, and causes the polishing solution to be spread over the polishing surface 102 and to replace the pure water or the chemical solution. The time period from a start of supply of the polishing solution to pressing of the substrate WF and the rotation speed of the polishing pad 100 are adjusted according to the shape of grooves provided in the polishing surface 102 and the surface conditions of the pad. For example, when the grooves are concentric grooves, it takes time to make replacement with the polishing solution. It is accordingly desirable to rotate the polishing pad 100 at a high speed. The high-speed rotation, however, also increases the effect of removing the polishing solution. The desirable rotation speed is thus 60 to 120 rpm and is preferably 80 to 100 rpm. The supply time is preferably about 5 to 15 sec. The procedure subsequently presses the substrate WF held by the polishing head 30 against the polishing surface 102 and causes the substrate WF and the polishing pad 100 to be moved, for example, rotated, relative to each other in the state that a surface to be polished or a polishing surface of the substrate WF is in contact with the polishing pad 100 in the presence of the polishing solution. This polishes the substrate. After conclusion of polishing, the polishing solution supply member 41 is lifted up by the lifting mechanism 80 of the lifting turning mechanism 70, is further moved to the retreat position on outside of the polishing pad 100 by the turning operation of the arm 60 by means of the turning mechanism 90, and is then cleaned by using a cleaning mechanism 300. This sequence of operations may be set in advance by the polishing recipe and/or the preset machine parameters provided in the controller 200.

The configuration of the polishing apparatus 1 described above is merely one example, and another configuration may be employed. For example, the polishing apparatus 1 may further include a dresser and/or a temperature regulation device or mechanism and may exclude the atomizer. The dresser serves to perform surface conditioning of the polishing surface 102 during an interval between polishing operations of the substrates WF or in the course of polishing of the substrate WF. The dresser presses a disk that has a smaller diameter than the diameter of the polishing pad 100 and that has diamond abrasive grains placed thereon, against the polishing surface 102 of the polishing pad 100 and moves the disk relative to the polishing pad 100, so as to condition the entire polishing surface 102 of the polishing pad 100. The polishing solution is supplied during conditioning or during polishing, whereas the pure water or the chemical solution is supplied during an interval between polishing operations. For example, the temperature regulation mechanism may be connected with the polishing solution supply device to heat up or cool down the polishing solution itself. In another example, the temperature regulation mechanism may be provided with a heat exchanger placed near to the polishing surface 102 and may be configured to heat up or cool down the heat exchanger by using a heater placed inside of the heat exchanger or by supplying either of hot water or cold water or a mixture of hot water and cold water at a predetermined mixing ratio to the heat exchanger, and to transmit the temperature of the heated or cooled heat exchanger to the polishing surface 102 and thereby regulate the temperature of the polishing surface 102. In another example, the temperature regulation mechanism may be configured to inject and supply a gas (for example, the air, $N_2$ or the like) to the polishing surface 102 of the polishing pad 100 to cool down the polishing surface 102. The gas to be injected and supplied may be cooled down in advance.

(Polishing Solution Supply Device)

Figure 2:
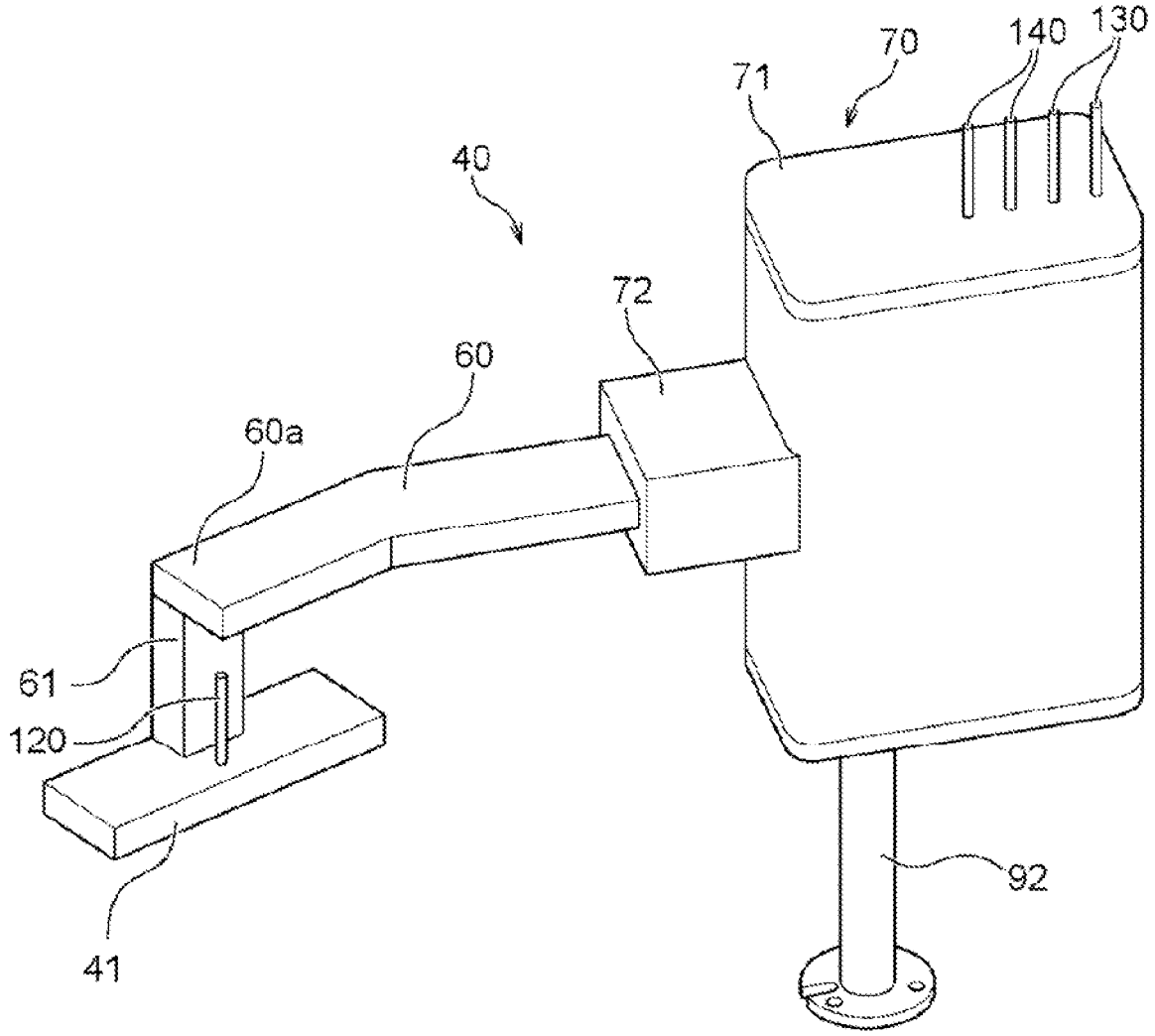
FIG. 2 is a perspective view illustrating a polishing solution supply device.
Figure 3:
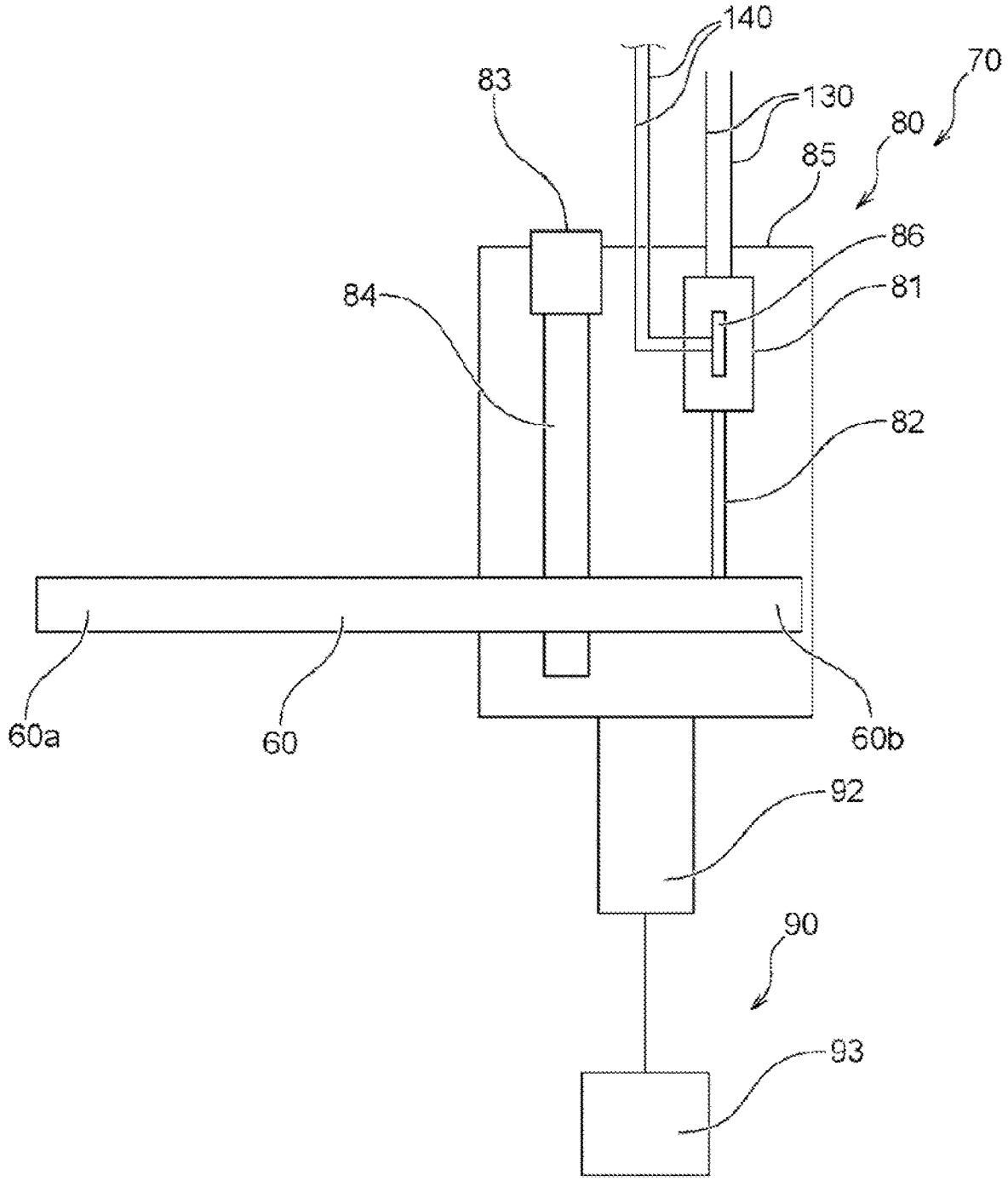
FIG. 3 is a diagram illustrating the configuration of a lifting turning mechanism.

FIG. 2 is a perspective view illustrating the polishing solution supply device. FIG. 3 is a diagram illustrating the configuration of the lifting turning mechanism. In the description hereof, the upstream side and the downstream side denote an upstream side and a downstream side in the case where the polishing table 20 (the polishing pad 100) is rotated clockwise in FIG. 1.

As illustrated, the polishing solution supply device 40 includes the polishing solution supply member 41, the arm 60, and a link member 61 configured to link the polishing solution supply member 41 with the arm 60. The polishing solution supply member 41 is connected with a polishing solution supply line 120. The polishing solution supply member 41 serves to eject the polishing solution that is supplied through the polishing solution supply line 120, onto the polishing surface 102. The polishing solution supply member 41 is mounted to a leading end portion 60*a* of the arm 60 via the link member 61. The polishing solution supply member 41 is configured to be mountable to and demountable from the link member 61, and the link member 61 is configured to be mountable to and demountable from the arm 60. This configuration allows for replacement of the polishing solution supply member 41 and also allows for collective replacement of the polishing solution supply member 41 and the link member 61, according to the polishing specification and the properties of the substrate WF.

(Lifting Turning Mechanism)

A base end portion 60*b* of the arm 60 is connected with the lifting turning mechanism 70 configured to lift up, lower, and turn the arm 60 as shown in FIG. 3. The lifting turning mechanism 70 includes the lifting mechanism 80 configured to lift up and lower the arm 60, and the turning mechanism 90 configured to turn the arm 60. The lifting mechanism 80 and the turning mechanism 90 are controlled by the controller 200.

In this illustrated example, the lifting mechanism 80 includes a lift cylinder 81 fixed to a frame 85, and the base end portion 60*b* of the arm 60 is fixed to an axis 82 of the lift cylinder 81. The lift cylinder 81 is configured to receive a supply of a fluid (a gas such as the air or a liquid such as hydraulic oil) through fluid lines 130 to advance or retreat the axis 82. The lift cylinder 81 has two chambers parted by, for example, a piston and arranged such that one of the fluid lines 130 is connected with one chamber and the other of the fluid lines 130 is connected with the other chamber. The lift cylinder 81 advances and retreats the axis 82 by introducing the fluid into one chamber and discharging the fluid from the other chamber and by introducing the fluid into the other chamber and discharging the fluid from one chamber. The arm 60 is configured to be moved in a vertical direction by advance and retreat of the axis 82 of the lift cylinder 81. The lifting mechanism 80 further includes a ball spline 83 configured to guide the vertical motions of the arm 60. The ball spline 83 is fixed to the frame 85. The base end portion 60*b* of the arm 60 is fit in an axis 84 of the ball spline 83, and the vertical motions of the arm 60 by the lift cylinder 81 are guided along the axis 84. The configuration of guiding the vertical motions of the anm 60 is not limited to the ball spline, but may be any other guide mechanism or may be omitted. A sensor 86 (for example, a magnetic sensor) is provided to detect a move of the axis 82 of the lift cylinder 81 and thereby detect the height of the arm 60. Electric cables 140 denote cables connected with the sensor. The sensor may, however, be omitted. The lifting mechanism 80 is not limited to the above configuration but may be any other configuration to lift up and lower the arm 60. Furthermore, the lifting mechanism 80 employs the lift cylinder 81-based driving system in this illustrated example but may employ a motor driving system via a ball screw or a belt mechanism. This lifting mechanism 80 enables the polishing solution supply member 41 to be moved from the polishing surface 102 to a predetermined height. With regard to the height of the polishing solution supply member 41 from the polishing surface 102, the closer distance from the polishing surface 102 causes the polishing solution supplied from the polishing solution supply member 41 to have a distribution more conforming to the hole shape and the arrangement of polishing solution supply ports 414, while increasing the degree of pollution of the polishing solution supply member 41 caused by splash of the polishing solution from the polishing surface 102. A supply surface 410*a* of the polishing solution supply member 41 is accordingly set to, for example, a height of 5 mm to 30 mm or preferably to a height of 5 mm to 15 mm from the polishing surface 102 by the lifting mechanism 80. The polishing solution supply member 41 is moved to be parallel to the polishing surface 102.

The base end portion 60*b* of the arm 60 is also connected with the turning mechanism 90 configured to turn the arm 60 via the frame 85. In this illustrated example, the turning mechanism 90 has a motor 93 that is connected with, for example, a lower end of a shaft 92 fixed to a lower portion of the frame 85 as shown in FIG. 3. The motor 93 is connected with the shaft 92 via, for example, a reduction mechanism or the like. An axis of the motor 93 may be directly connected with the shaft 92. The arm 60 is configured to be turnable in a plane parallel to the polishing surface 102 via the shaft 92 that is rotated by rotation of the motor 93. Accordingly, the arm 60 is configured to be turnable about a turning axis placed outside of the polishing pad 100. The turning mechanism 90 is not limited to the configuration described above but may employ any other configuration that enables the arm 60 to be turned. For example, a pulse motor may be used for the motor 93 of the turning mechanism 90, and the arm 60 may be turned to any angle by regulating the input pulse of the pulse motor. This turning mechanism 90 enables the polishing solution supply member 41 to be moved to a predetermined position on the polishing surface 102.

In this illustrated example, as shown in FIG. 2, the base end portion 60*b* of the arm 60 and the lifting mechanism 80 are placed in a waterproof box 71 provided to protect these components from splashes of the polishing solution, water, polishing residue and the like. As shown in FIG. 2, the base end side of the arm 60 is covered with a waterproof box 72. The arm 60 may be made of a metal or may be configured by applying a resin to a metal. The arm 60 is, however, not limited to these configurations but may be configured by using any of various composite materials, may be made of only a resin, or may be configured by coating a metal with a resin.

(Polishing Solution Supply Member)

Figure 4:
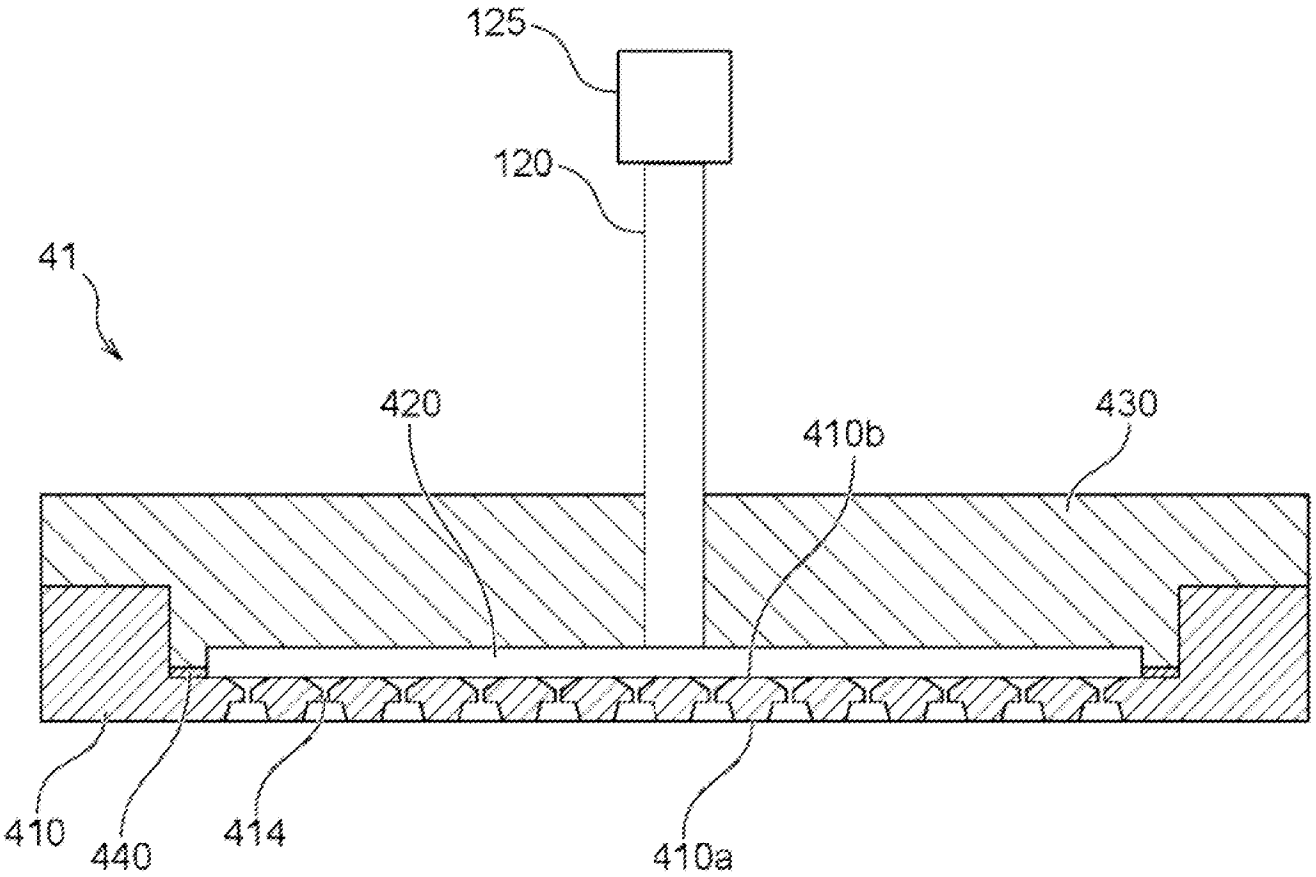
FIG. 4 is a sectional diagram schematically illustrating the configuration of a polishing solution supply member.

The following describes the details of the polishing solution supply member 41. FIG. 4 is a sectional diagram schematically illustrating the configuration of the polishing solution supply member. As shown in FIG. 4, the polishing solution supply member 41 includes a supply member body 410 and a cover member 430 that is linked with the supply member body 410 via a packing 440. The supply member body 410 is formed in a rectangular plate-like shape and has a recess in a center thereof. A plurality of polishing solution supply ports 414 are formed in the recess of the supply member body 410 to be arrayed along a predetermined direction. The plurality of polishing solution supply ports 414 are arranged in a direction intersecting with a rotating direction of the polishing pad 100 in such a state that the polishing solution supply member 41 is placed on the upstream side in rotation of the polishing pad 100 relative to the substrate WF. The plurality of polishing solution supply ports 414 are formed to have opening diameters of, for example, 0.3 to 2 mm but may have any other opening diameters.

Figure 5:
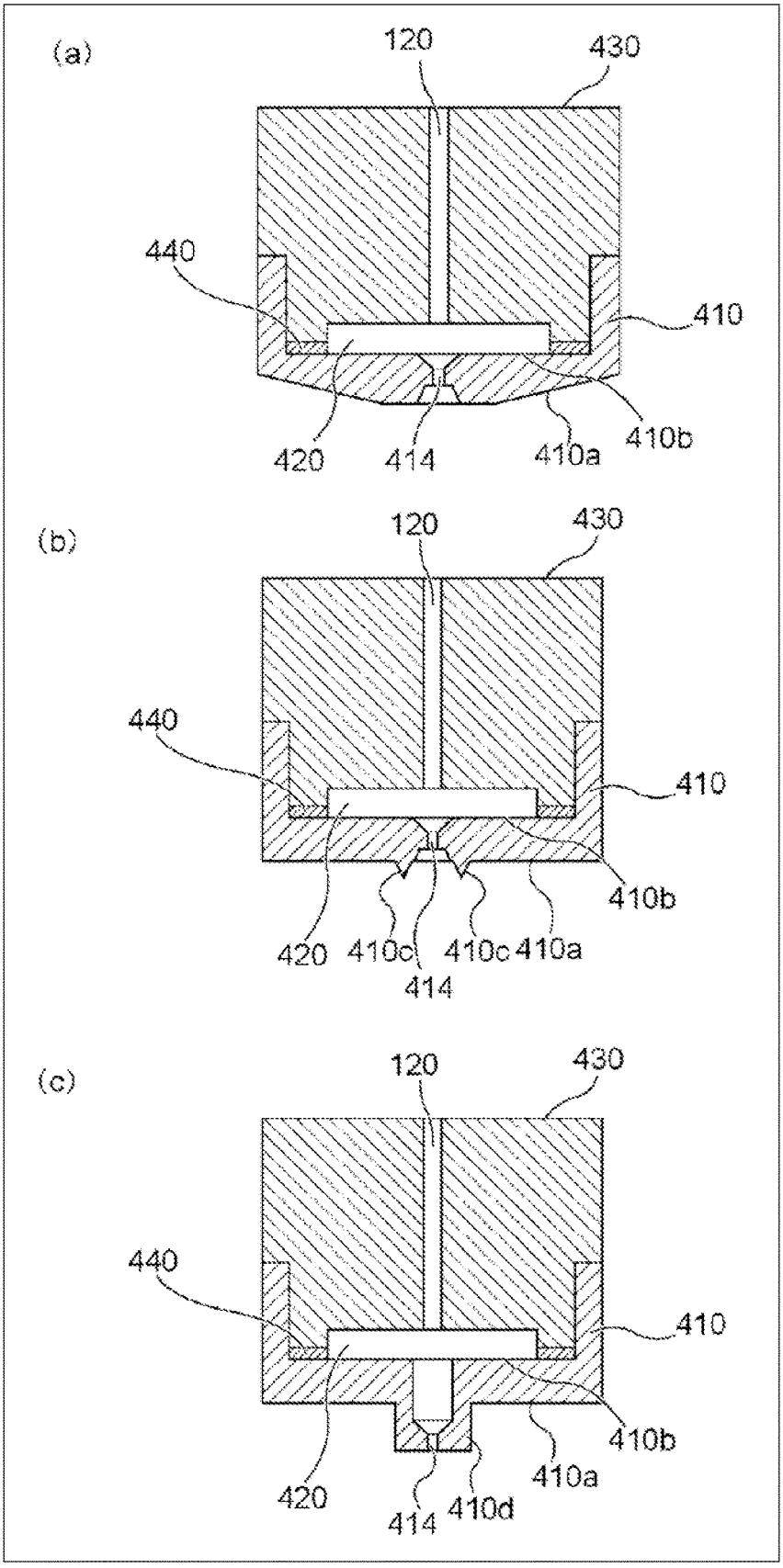
FIG. 5 is diagrams illustrating examples of side face cross section of the polishing solution supply member.

The polishing solution supply line 120 is connected with the cover member 430. A buffer portion (buffer space) 420 is formed between the cover member 430 and the supply member body 410. The supply member body 410 has the plurality of polishing solution supply ports 414 formed therein and is configured to be mountable to and demountable from the cover member 430 by a clamping member such as a screw. This configuration enables a desired flow pattern of the polishing solution to be formed by replacement of the supply member body 410. The cover member 430 is also configured to be mountable to and demountable from the arm 60 by a clamping member such as a screw. The cover member 430 having a different buffer portion 420 may be selected according to the arrangement of the polishing solution supply ports 414 of the supply member body 410. The polishing solution supply line 120 has a base end portion connected with a flow rate regulating mechanism 125 configured to regulate the flow rate of the polishing solution supplied from the polishing solution supply device 40. The polishing solution supply line 120 also has a leading end portion that is open to the buffer portion 420. The buffer portion 420 serves to temporarily store the polishing solution supplied through the polishing solution supply line 120 and equalize the back pressure of the polishing solution that is supplied to the plurality of polishing solution supply ports 414. This configuration enables the polishing solution supplied through the polishing solution supply line 120 to be stored in the buffer portion 420 and to be subsequently supplied from the plurality of polishing solution supply ports 414 onto the polishing pad 100. In the example of FIG. 4, the volume of the buffer portion 420 is made smaller than the supply quantity of the polishing solution from the polishing solution supply line 120. This maintains the back pressure of the polishing solution supplied to the plurality of polishing solution supply ports 414 and shortens the filling time of the polishing solution into the buffer portion 420. This, on the other hand, increases a pressure loss caused by friction against the flow path wall surface. In the case where there is a large effect of the pressure loss, the flow path shape of the buffer portion 420 may be changed to a shape having a smaller pressure loss. For example, the upper face of the buffer portion 420 provided in the cover member 430 has a linear sectional shape in the example of FIG. 4 but may have a fan-like shape about a pivot that is a connecting portion with the polishing solution supply line 120. The opening shape of the plurality of polishing solution supply ports 414 is, for example, a circular hole and may be formed linearly from a back face 410*b* of the supply member body 410 to the supply surface 410*a*. The small supply port diameter, however, increases the pressure loss. Accordingly, as shown in FIG. 4, tapered holes or spot facing holes may be provided in at least one of the supply surface 410*a* and the back face 410*b*. This configuration reduces the pressure loss of the flow path in the plurality of polishing solution supply ports 414. The supply member body 410 has the planar supply surface 410*a* in the example of FIG. 4. In the case of a small flow rate of the polishing solution, however, the polishing solution supplied from the plurality of polishing solution supply ports 414 is likely to run along the supply surface 410*a* and not to have a predetermined supply flow rate distribution, due to the wettability and the surface roughness of the supply surface 410*a* of the supply member body 410. The supply member body 410 may be made of a resin material such as PEEK. PVC or PP. When the effect of the wettability described above is not negligible, however, the supply member body 410 may be made of a fluororesin material such as PTFE, PCTFE or PFA. FIG. 5 is diagrams illustrating examples of the side face cross section of the polishing solution supply member 41. As shown in FIG. 5(*a*), the supply surface 410*a* of the supply member body 410 may have a slope, such as a tapered shape, on a short side direction side. As shown in FIG. 5(*b*), the supply surface 410*a* may be provided with a convex 410*c* in an outer circumferential part of the plurality of polishing solution supply ports 414. As shown in FIG. 5(*c*), the supply surface 410*a* of the supply member body 410 may be provided with a protrusion 410*d* where the polishing solution supply port 414 is formed. A plurality of the projections 410*d* may be provided along a longitudinal direction of the supply surface 410*a* of the supply member body 410. The projection 410*d* may be formed in any shape, such as a cylindrical shape, a quadrangular prism shape, a cone shape or a quadrangular pyramid shape.

(Cleaning Mechanism)

Figure 6:
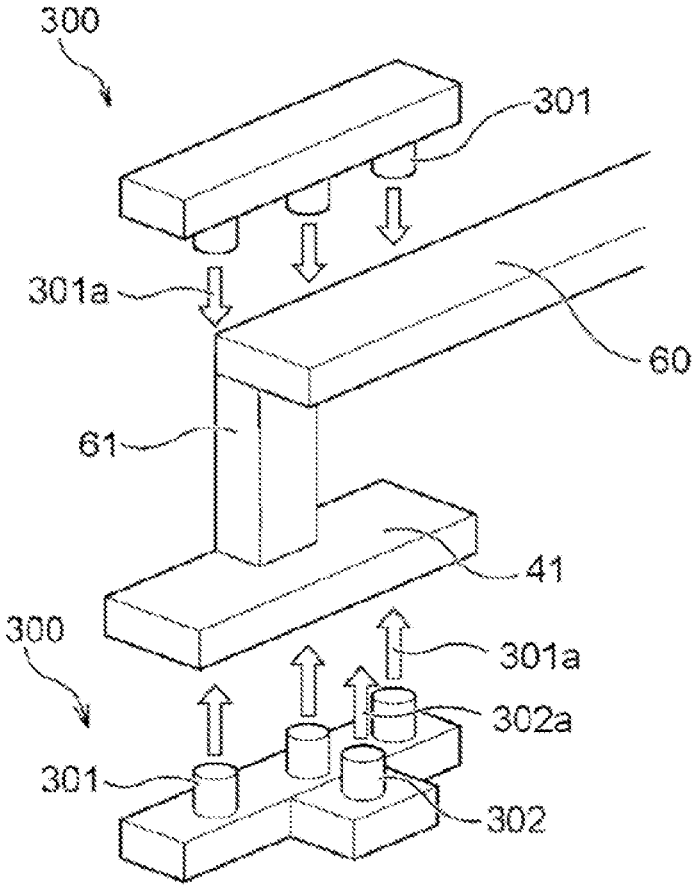
FIG. 6 is a diagram illustrating a cleaning mechanism for the polishing solution supply member, a link member, and an arm.

The following describes the details of the cleaning mechanism 300. FIG. 6 is a diagram illustrating the cleaning mechanism 300 for the polishing solution supply member 41, the link member 61, and the arm 60. As shown in FIG. 6, the cleaning mechanism 300 includes a plurality of cleaning nozzles 301 placed above and below the polishing solution supply member 41, the link member 61 and the arm 60 and is placed outside of the polishing table 20. The cleaning mechanism 300 is configured to clean the polishing solution supply member 41, the link member 61 and the arm 60 when the polishing solution supply member 41 is retreated to outside of the polishing table 20 by the turning mechanism 90 during an interval between polishing operations of the substrates WF. The cleaning nozzles 301 are formed in at least one of a cone shape and a fan shape or in a combination thereof and are configured to supply pure water 301*a*. The cleaning mechanism 300 may further include a drying nozzle 302 provided to dry the polishing solution supply member 41, the link member 61 and the arm 60 after being cleaned by the cleaning nozzles 301. The drying nozzle 302 is formed in at least one of a cone shape and a fan shape or in a combination thereof and is configured to supply $N_2$ or the compressed air 302*a*. When the polishing solution supply member 41 is moved back onto the polishing table 20 for a next polishing operation, the remaining pure water is likely to drop down onto the polishing surface 102 of the polishing pad 100 and affect the polishing performance. The remaining pure water on the supply surface 401*a* is likely to disturb the flow of the polishing solution from the polishing solution supply ports 414. Providing the drying nozzle 302 to dry the supply member body 410 and the cover member 430 of the polishing solution supply member 41 and the arm 60 after cleaning with the cleaning nozzles 301 suppresses the pure water from remaining.

The polishing solution supply device 40 according to the embodiment is configured to supply the polishing solution, such that the polishing solution supplied from the plurality of polishing solution supply ports 414 has a predetermined flow rate distribution, while the polishing pad 100 and the substrate WF are moved relative to each other. In other words, the polishing solution supply device 40 supplies the polishing solution such as to have a predetermined supply flow rate distribution within a range of trajectory of the substrate WF sliding on the polishing pad 100.

Figure 7:
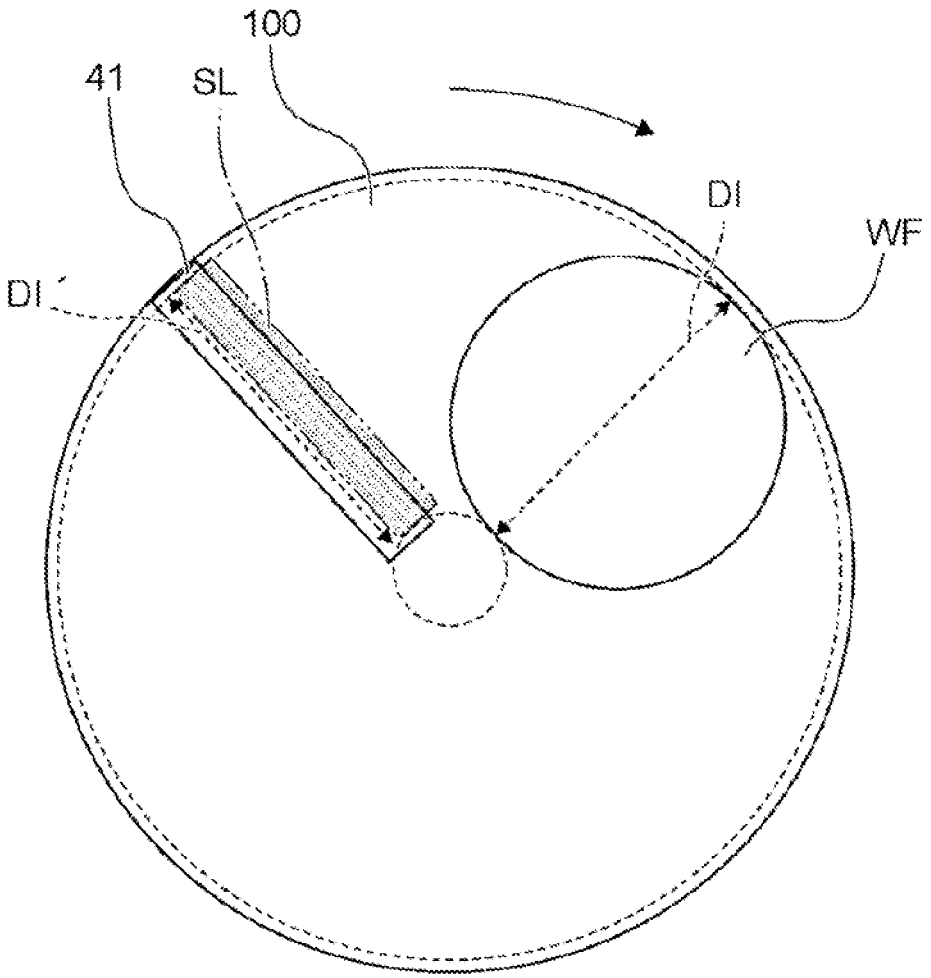
FIG. 7 is a diagram schematically illustrating one example of a flow rate distribution of polishing solution.
Figure 8:
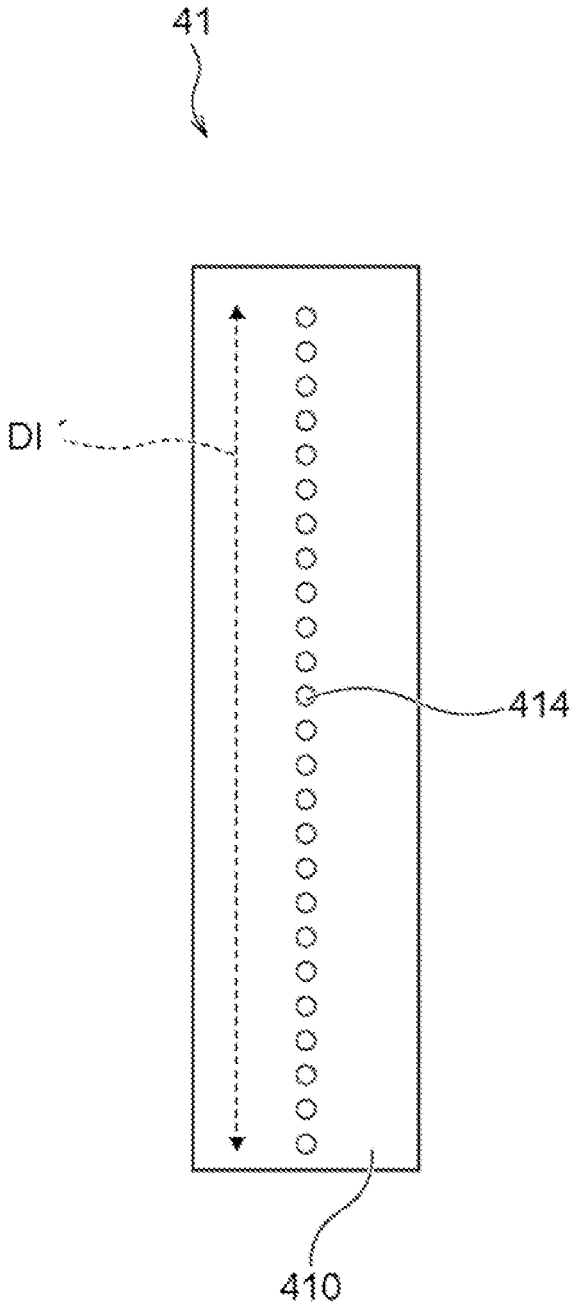
FIG. 8 is a diagram illustrating one example of formation of a plurality of polishing solution supply ports in order to achieve the flow rate distribution of the polishing solution shown in FIG. 7.

FIG. 7 is a diagram schematically illustrating one example of a flow rate distribution of the polishing solution. FIG. 8 is a diagram illustrating one example of formation of the plurality of polishing solution supply ports in order to achieve the flow rate distribution of the polishing solution shown in FIG. 7. As shown in FIG. 7, the polishing solution supply member 41 is placed on an upstream side in rotation of the polishing pad 100 relative to the substrate WF such that the plurality of polishing solution supply ports 414 are arranged to intersect with the rotating direction of the polishing pad 100. As shown in FIGS. 7 and 8, the polishing solution supply member 41 has the plurality of polishing solution supply ports 414 formed in a corresponding range DI' on a trajectory of rotation of the polishing pad 100 corresponding to a diameter DI of the substrate WF along a radial direction of the polishing pad 100. This configuration enables the polishing solution to be supplied such as to equalize the flow rate distribution of polishing solution SL in the range DI'. In order to achieve this flow rate distribution, the supply member body 410 of the polishing solution supply member 41 has a length equivalent to the radius of the polishing pad 100, and the plurality of polishing solution supply ports 414 have an identical opening diameter and have their opening centers arranged at equal intervals in the range DI' as shown in FIG. 8. The plurality of polishing solution supply ports 414 are arranged linearly in one line in a longitudinal direction of the supply member body 410 and are connected with the buffer portion 420 in the example of FIG. 8, but may be arranged in multiple lines. The arrangement may be a lattice arrangement or a zigzag arrangement. The arrangement of the plurality of polishing solution supply ports 414 in multiple lines increases the coverage ratio of the supplied polishing solution on the polishing pad 102 and accordingly achieves the more uniform distribution of the supplied amount of the polishing solution.

The configuration of this example enables the polishing solution SL to be supplied in a uniform flow rate distribution in the direction of the diameter DI of the substrate WF. When the polishing solution itself has a high chemical content, the supply in the uniform flow rate distribution reduces a change in polishing rate profile caused by the distribution of the supplied amount of the polishing solution. In the case where the polishing pad 100 has grooves formed in a concentrical arrangement, there may be a difficulty in spreading the polishing solution outward in the radial direction of the polishing pad 100 by the centrifugal force even by taking into account the rotation of the substrate WF. In such a case, the configuration of supplying the polishing solution to cover the diameter range of the substrate WF enables the polishing solution to be uniformly supplied over the entire surface of the substrate WF. Furthermore, the arrangement of the plurality of polishing solution supply ports 414 within the range of trajectory of the substrate WF on the polishing pad 100 suppresses the polishing solution from being excessively supplied and results in reducing the use amount of the polishing solution.

Figure 9:
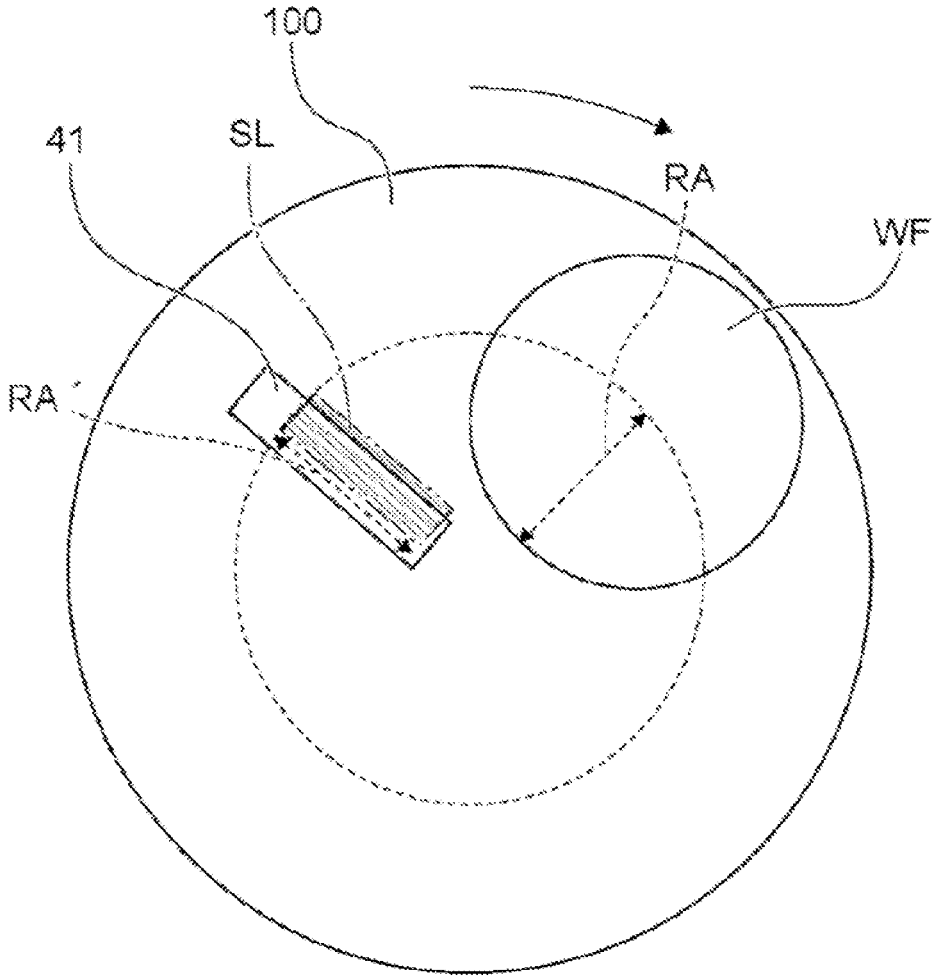
FIG. 9 is a diagram schematically illustrating another example of the flow rate distribution of the polishing solution.
Figure 10:
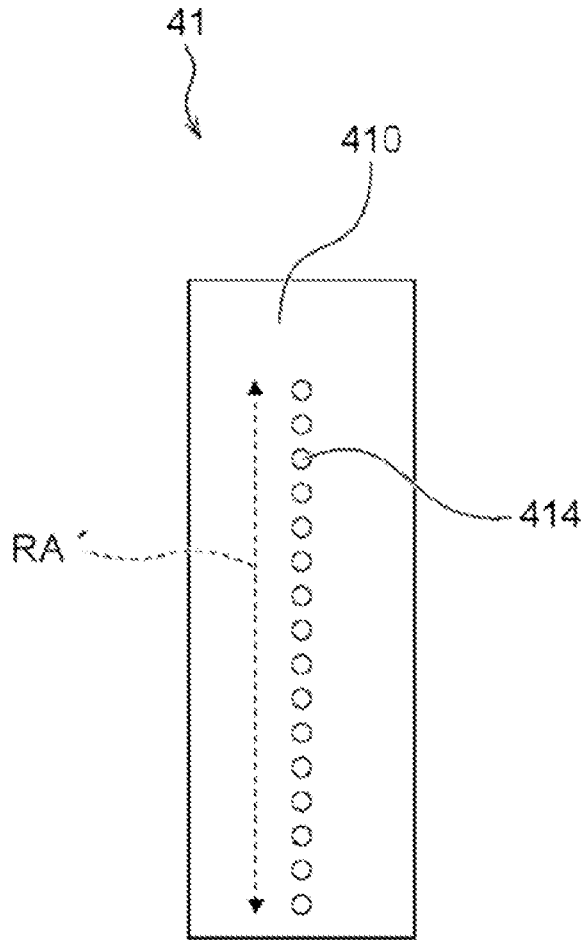
FIG. 10 is a diagram illustrating one example of formation of the plurality of polishing solution supply ports in order to achieve the flow rate distribution of the polishing solution shown in FIG. 9.

FIG. 9 is a diagram schematically illustrating another example of the flow rate distribution of the polishing solution. FIG. 10 is a diagram illustrating one example of formation of the plurality of polishing solution supply ports in order to achieve the flow rate distribution of the polishing solution shown in FIG. 9. As shown in FIGS. 9 and 10, the polishing solution supply device 40 has the plurality of polishing solution supply ports 414 formed in a corresponding range RA' on the trajectory of rotation of the polishing pad 100 corresponding to a radius RA of the substrate WF on a side nearer to the center of rotation of the polishing pad 100 along the radial direction of the polishing pad 100. This configuration enables the polishing solution to be supplied such as to equalize the flow rate distribution of polishing solution SL in the range RA'. One end of the range RA' is located at one end of the trajectory (broken line) of the center of rotation of the substrate WF on the polishing pad 100. In order to achieve this flow rate distribution, the supply member body 410 of the polishing solution supply member 41 has a length slightly longer than half the radius of the polishing pad 100, and the plurality of polishing solution supply ports 414 have an identical opening diameter and have their opening centers arranged at equal intervals in the range RA' as shown in FIG. 10.

The configuration of this example enables the polishing solution SL to be supplied in a uniform flow rate distribution in a range corresponding to only the radius of the substrate WF. When the polishing solution itself has a high chemical content, the supply in the uniform flow rate distribution reduces a change in polishing rate profile caused by the distribution of the suppled amount of the polishing solution. This configuration causes the polishing solution to go around in the polishing head 30 due to the rotation of the substrate WF and thereby enables the polishing solution to be uniformly supplied over the entire surface of the substrate WF, depending on polishing conditions (for example, the shape of grooves formed in the polishing pad 100, the rotation speeds of the substrate WF and the polishing table 20, and the shape of a groove in a retainer ring of the polishing head 30). Moreover, the configuration of this example suppresses the polishing solution from being excessively supplied and results in reducing the use amount of the polishing solution.

Figure 11:
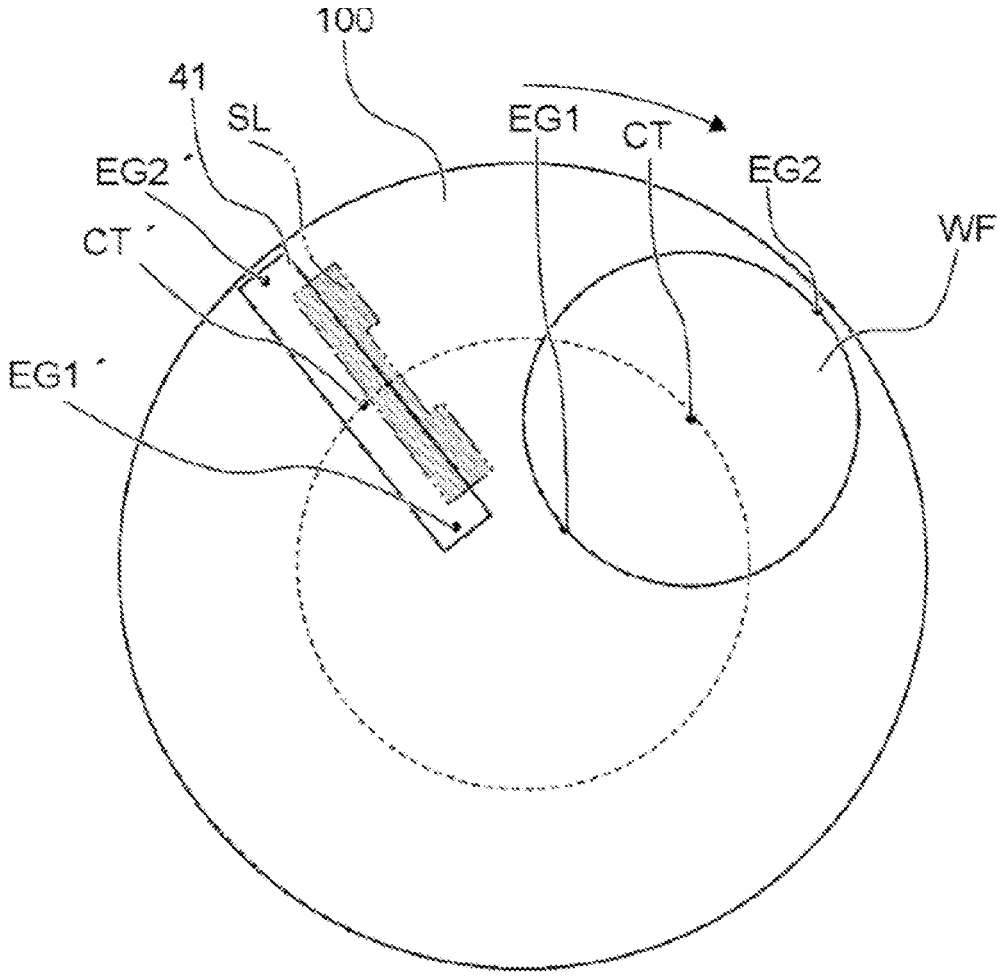
FIG. 11 is a diagram schematically illustrating another example of the flow rate distribution of the polishing solution.
Figure 12:
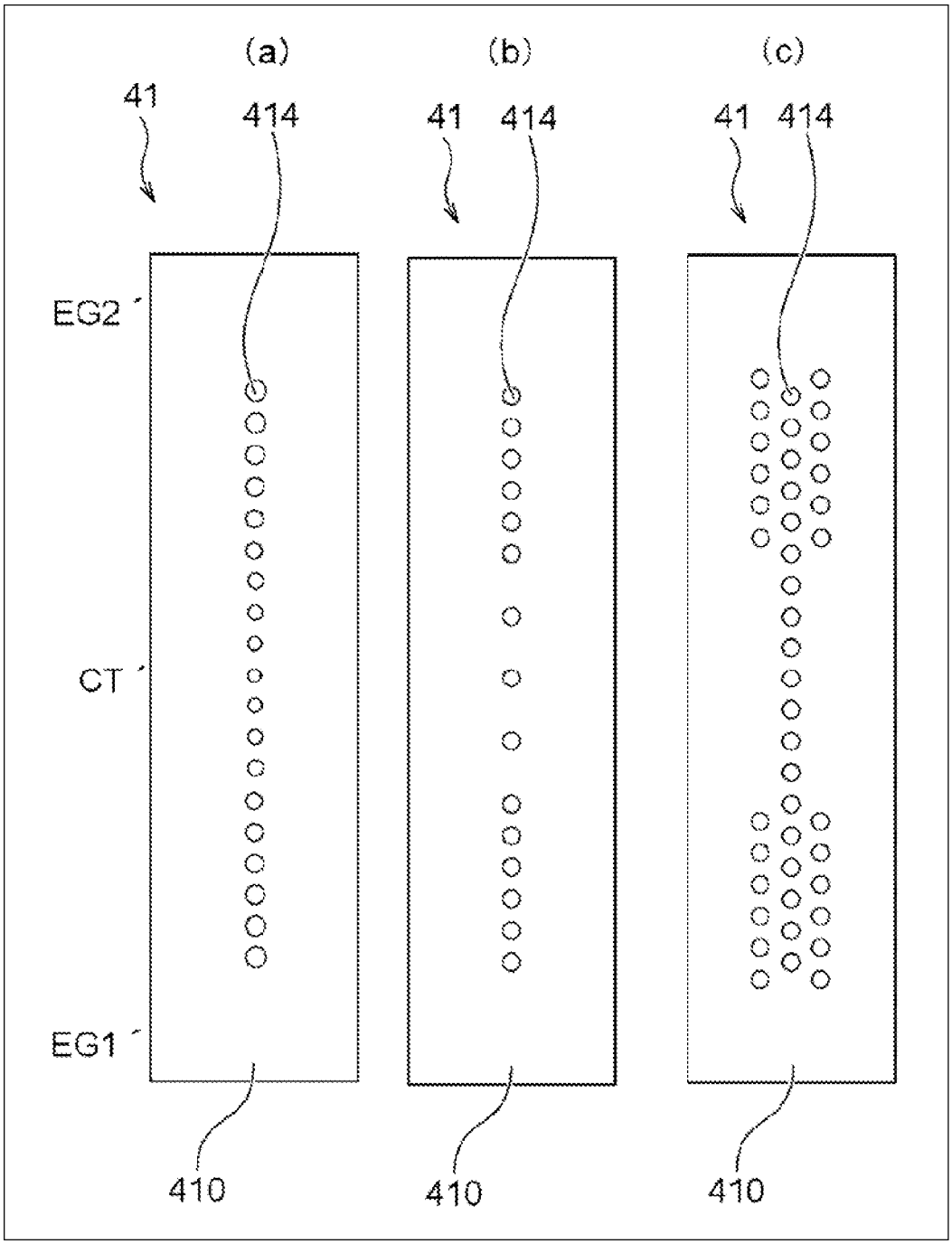
FIG. 12 is diagrams illustrating examples of formation of the plurality of polishing solution supply ports in order to achieve the flow rate distribution of the polishing solution shown in FIG. 11.

FIG. 11 is a diagram schematically illustrating another example of the flow rate distribution of the polishing solution. FIG. 12 is diagrams illustrating examples of formation of the plurality of polishing solution supply ports in order to achieve the flow rate distribution of the polishing solution shown in FIG. 11. As shown in FIGS. 11 and 12, the polishing solution supply device 40 has the plurality of polishing solution supply ports 414 formed in an equal distance range (bilaterally symmetrically) from a corresponding position CT on the trajectory of rotation (broken line) of the polishing pad 100 corresponding to a center of rotation CT of the substrate WF toward positions EG1' and EG2' corresponding to respective outer circumferences EG1 and EG2 of the substrate WF along the radial direction of the polishing pad 100. This configuration enables the polishing solution to be supplied such as to increase the flow rate of the polishing solution SL from the position CT toward the positions EG1' and EG2' in this range. In order to achieve this flow rate distribution, the supply member body 410 of the polishing solution supply member 41 has a length equivalent to the radius of the polishing pad 100. The plurality of polishing solution supply ports 414 have opening centers arranged at equal intervals and have opening diameters continuously increasing from the position CT toward the positions EG1' and EG2' as shown in FIG. 12(*a*). The illustrated example of FIG. 12(*a*) is, however, not essential, but the opening diameters may increase by every fixed number (non-continuously) from the position CT toward the positions EG1' and EG2'. In another example, the plurality of polishing solution supply ports 414 may have an identical opening diameter and may be arranged to decrease intervals between the opening centers of the respective polishing solution supply ports 414 (i.e., pitches of the plurality of polishing solution supply ports 414) from the position CT toward the positions EG1' and EG2' as shown in FIG. 12(*b*). In yet another example, the plurality of polishing solution supply ports 414 may have an identical opening diameter and may be arranged to increase the number of the polishing solution supply ports 414 per unit area, for example, by arrangement in multiple lines, continuously or by every fixed number from the position CT toward the positions EG1' and EG2' as shown in FIG. 12(*c*).

The configuration of this example enables the polishing solution to be supplied such as to increase the supplied amount in the radial direction of the substrate WF in the range of an identical radius (<radius of the substrate WF) relative to the center of rotation of the substrate WF. This configuration causes the polishing solution to go around in the polishing head 30 due to the rotation of the substrate WF and thereby enables the polishing solution to be uniformly supplied over the entire surface of the substrate WF, depending on polishing conditions (for example, the shape of grooves formed in the polishing pad 100, the rotation speeds of the substrate WF and the polishing table 20, and the shape of a groove in a retainer ring of the polishing head 30). An excessive amount of the polishing solution is, however, likely to be supplied to a center part of rotation of the substrate WF when the centrifugal force caused by rotation of the polishing pad 100 is taken into account. In such a case, this configuration enables the amount of the polishing solution to have a uniform distribution in the substrate WF. In the case where the polishing pad 100 has grooves formed in a concentrical arrangement, there may be a difficulty in spreading the polishing solution in the radial direction of the polishing pad 100 by the centrifugal force even by taking into account the rotation of the substrate WF. In such a case, the configuration of supplying the polishing solution to cover the diameter range of the substrate WF enables the polishing solution to have a distribution over the entire surface of the substrate WF. Moreover, the configuration of this example suppresses the polishing solution from being excessively supplied and results in reducing the use amount of the polishing solution.

Figure 13:
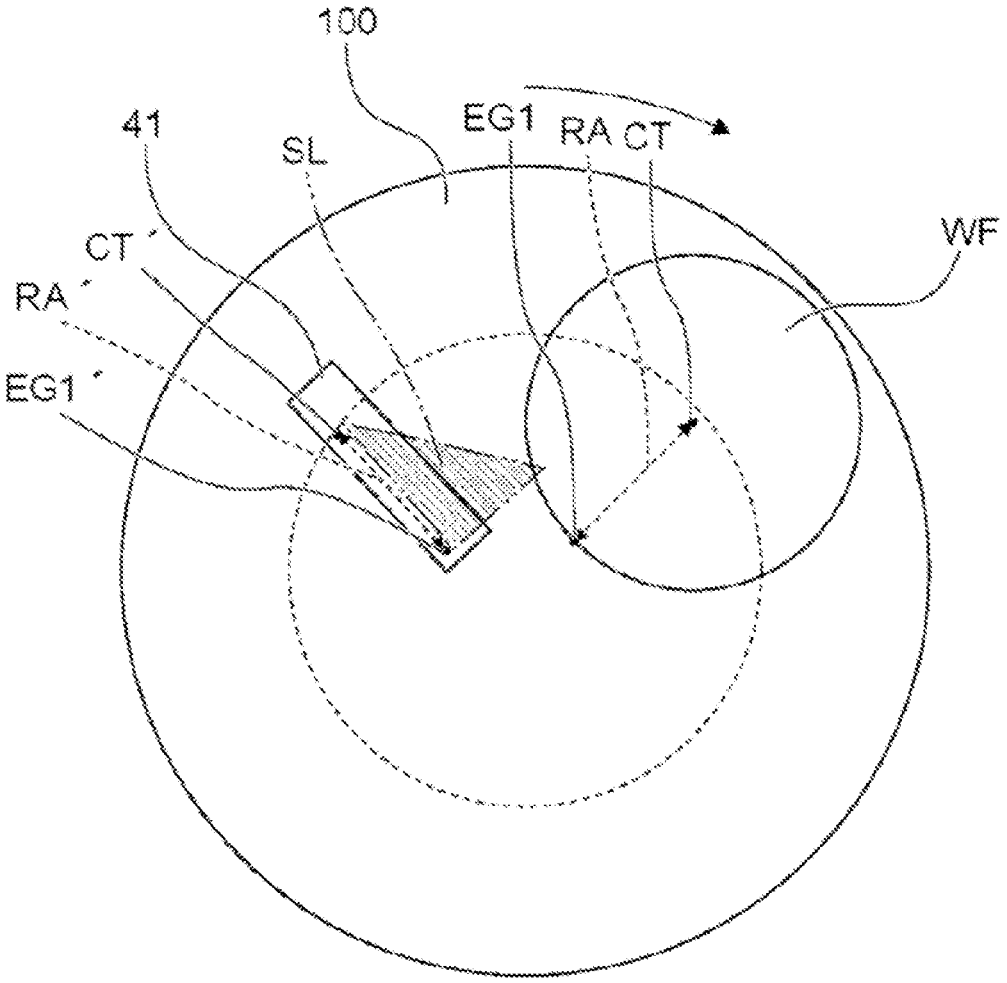
FIG. 13 is a diagram schematically illustrating another example of the flow rate distribution of the polishing solution.
Figure 14:
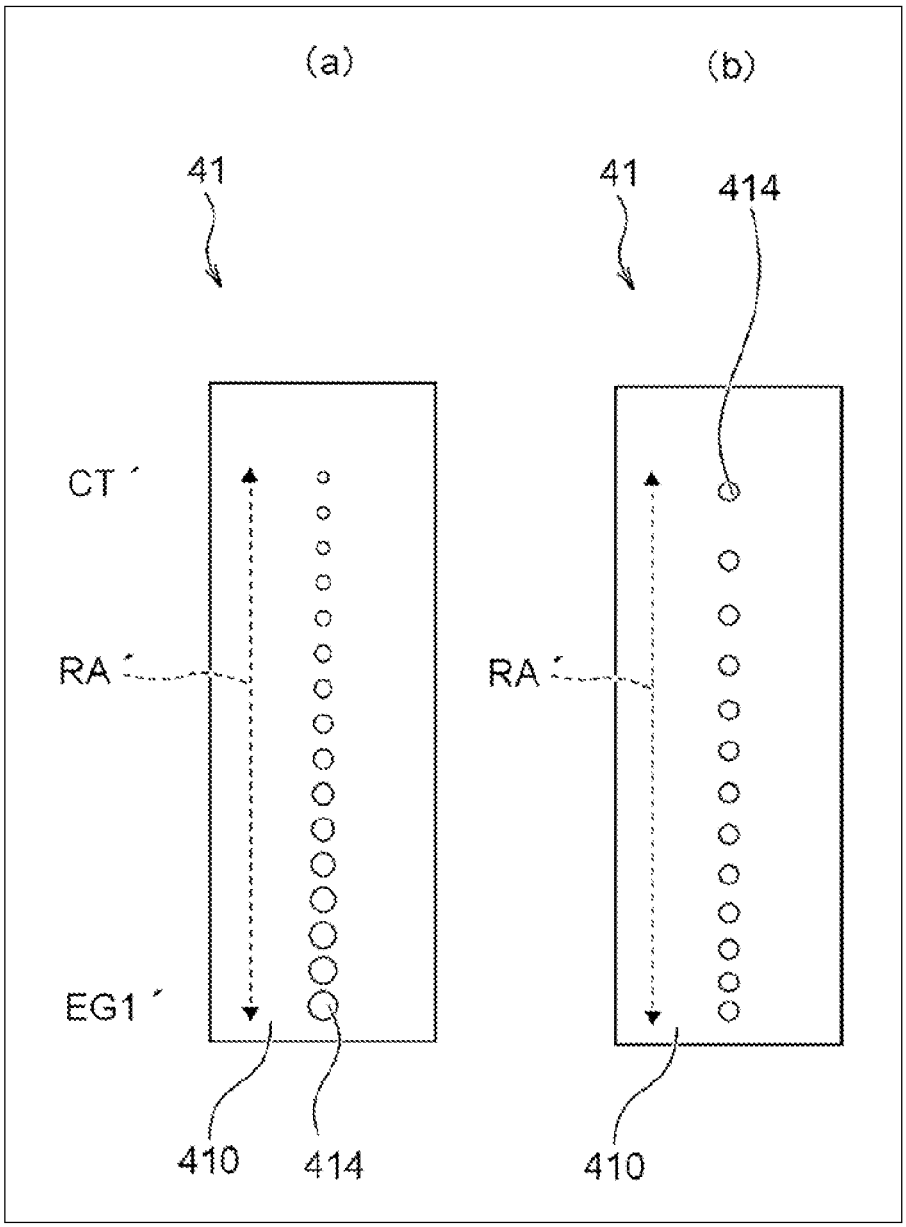
FIG. 14 is diagrams illustrating examples of formation of the plurality of polishing solution supply ports in order to achieve the flow rate distribution of the polishing solution shown in FIG. 13.

FIG. 13 is a diagram schematically illustrating another example of the flow rate distribution of the polishing solution. FIG. 14 is diagrams illustrating examples of formation of the plurality of polishing solution supply ports in order to achieve the flow rate distribution of the polishing solution shown in FIG. 13. As shown in FIGS. 13 and 14, the polishing solution supply device 40 has the plurality of polishing solution supply ports 414 formed in a corresponding range RA' on the trajectory of rotation of the polishing pad 100 corresponding to a radius RA of the substrate WF on a side nearer to the center of rotation of the polishing pad 100 along the radial direction of the polishing pad 100. This configuration enables the polishing solution to be supplied such as to increase the flow rate of the polishing solution SL from a corresponding position CT on the trajectory of rotation (broken line) of the polishing pad 100 corresponding to a center of rotation CT of the substrate WF toward a position EG1' corresponding to an outer circumference EG1 of the substrate WF on the side nearer to the center of rotation of the polishing pad 100 along the radial direction of the polishing pad 100 in the range RA'. In order to achieve this flow rate distribution, the supply member body 410 of the polishing solution supply member 41 has a length slightly longer than half the radius of the polishing pad 100. The plurality of polishing solution supply ports 414 have opening centers arranged at equal intervals and have opening diameters continuously increasing from the position CT toward the position EG1' as shown in FIG. 14(*a*). In another example, the plurality of polishing solution supply ports 414 may have an identical opening diameter and may be arranged to continuously decrease intervals between the opening centers of the respective polishing solution supply ports 414 from the position CT toward the position EG1' as shown in FIG. 14(*b*). In yet another example, the plurality of polishing solution supply ports 414 may have an identical opening diameter and may be arranged to increase the number of the polishing solution supply ports 414 per unit area, for example, by arrangement in multiple lines, continuously or by every fixed number from the position CT toward the position EG1', although not being specifically illustrated.

The configuration of this example enables the polishing solution to be supplied in a range corresponding to only the radius of the substrate WF such as to increase the supply in the radial direction of the substrate WF. This configuration causes the polishing solution to go around in the polishing head 30 due to the rotation of the substrate WF and thereby enables the polishing solution to be uniformly supplied over the entire surface of the substrate WF, depending on polishing conditions (for example, the shape of grooves formed in the polishing pad 100, the rotation speeds of the substrate WF and the polishing table 20, and the shape of a groove in a retainer ring of the polishing head 30). An excessive amount of the polishing solution is, however, likely to be supplied to a center part of rotation of the substrate WF when the centrifugal force caused by rotation of the polishing pad 100 is taken into account. In such a case, this configuration enables the amount of the polishing solution to have a uniform distribution in the substrate WF. Moreover, the configuration of this example suppresses the polishing solution from being excessively supplied and results in reducing the use amount of the polishing solution.

Figure 15:
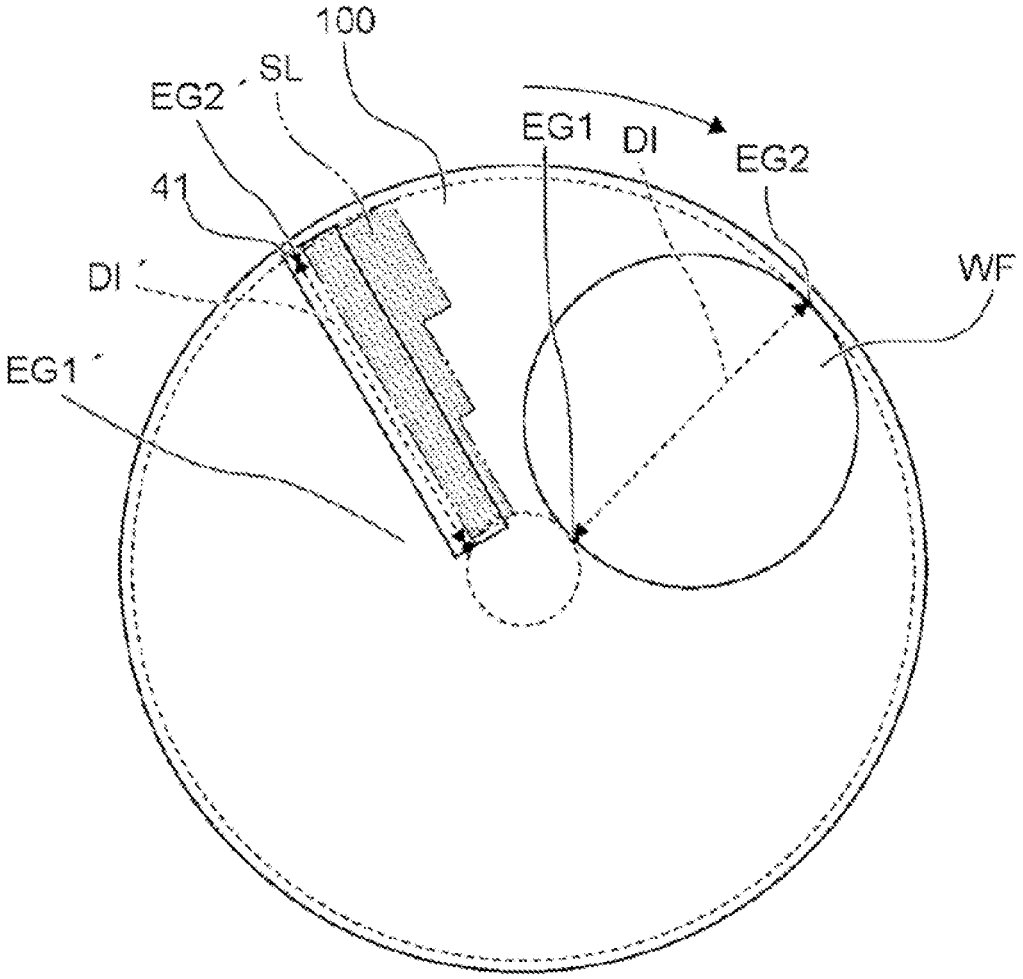
FIG. 15 is a diagram schematically illustrating one example of a flow rate distribution of the polishing solution.
Figure 16:
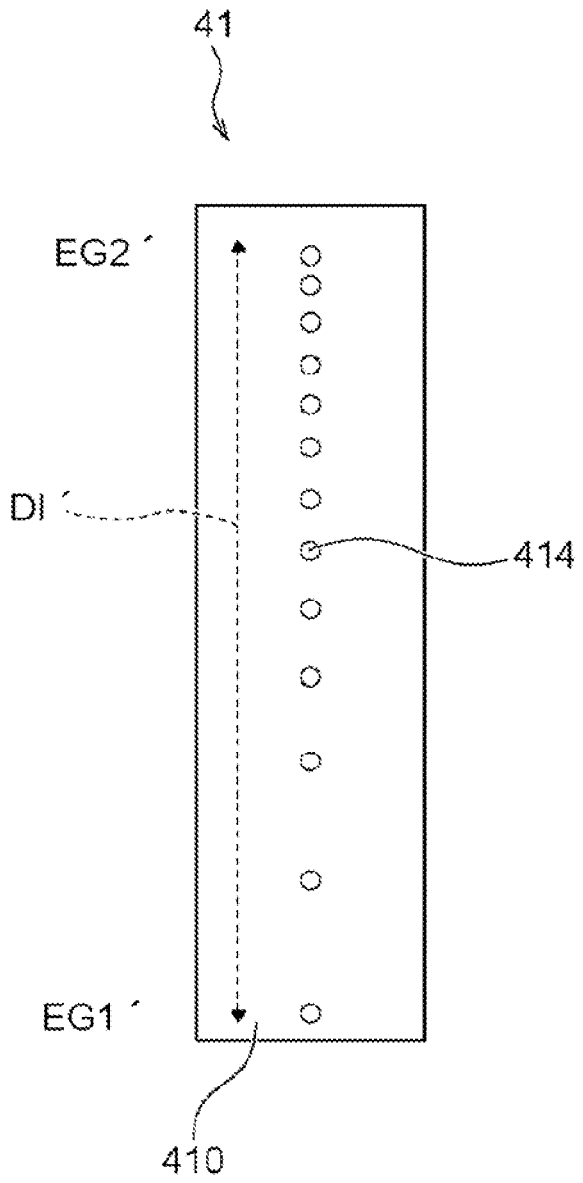
FIG. 16 is a diagram illustrating one example of formation of the plurality of polishing solution supply ports in order to achieve the flow rate distribution of the polishing solution shown in FIG. 15.

FIG. 15 is a diagram schematically illustrating one example of a flow rate distribution of the polishing solution. FIG. 16 is a diagram illustrating one example of formation of the plurality of polishing solution supply ports in order to achieve the flow rate distribution of the polishing solution shown in FIG. 15. As shown in FIGS. 15 and 16, the polishing solution supply device 40 has the plurality of polishing solution supply ports 414 formed in a corresponding range DI' on the trajectory of rotation of the polishing pad 100 corresponding to a diameter DI of the substrate WF along the radial direction of the polishing pad 100. This configuration enables the polishing solution to be supplied such as to increase the flow rate of the polishing solution SL from a position EG1' corresponding to an outer circumference EG1 of the substrate WF on a side nearer to the center of rotation of the polishing pad 100 toward a position EG2' corresponding to an outer circumference EG2 of the substrate WF on a side farther from the center of rotation of the polishing pad 100 in the range DI'. In order to achieve this flow rate distribution, the supply member body 410 of the polishing solution supply member 41 has a length equivalent to the radius of the polishing pad 100, and the plurality of polishing solution supply ports 414 have an identical opening diameter and are arranged to continuously decrease intervals between the opening centers of the respective polishing solution supply ports 414 from the position EG1' toward the position EG2' as shown in FIG. 16. This configuration is, however, not essential. The plurality of polishing solution supply ports 414 may have the opening centers arranged at equal intervals and may increase the opening diameters continuously or by every fixed number from the position EG1' toward the position EG2'.

The configuration of this example enables the polishing solution to be supplied in a flow rate distribution that increases the supply flow rate of the polishing solution toward the outer circumference of the polishing pad 100. In the case where the perimeter of the polishing pad 100 is to be taken into account, an outer circumferential part of the polishing pad 100 having a large perimeter requires a larger amount of the polishing solution, compared with an inner circumferential part thereof. This configuration provides a uniform distribution of the amount of the polishing solution with respect to each perimeter of the polishing pad 100. Moreover, the configuration of this example suppresses the polishing solution from being excessively supplied and results in reducing the use amount of the polishing solution.

Figure 17:
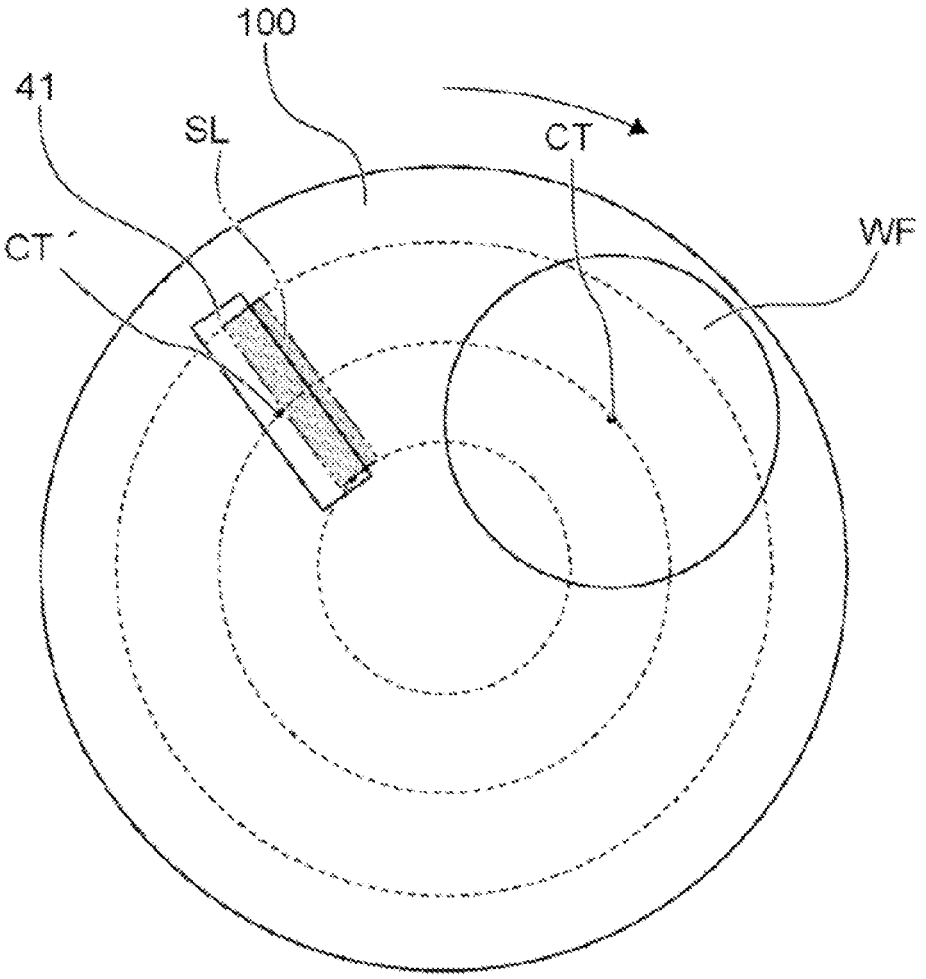
FIG. 17 is a diagram schematically illustrating one example of a flow rate distribution of the polishing solution.
Figure 18:
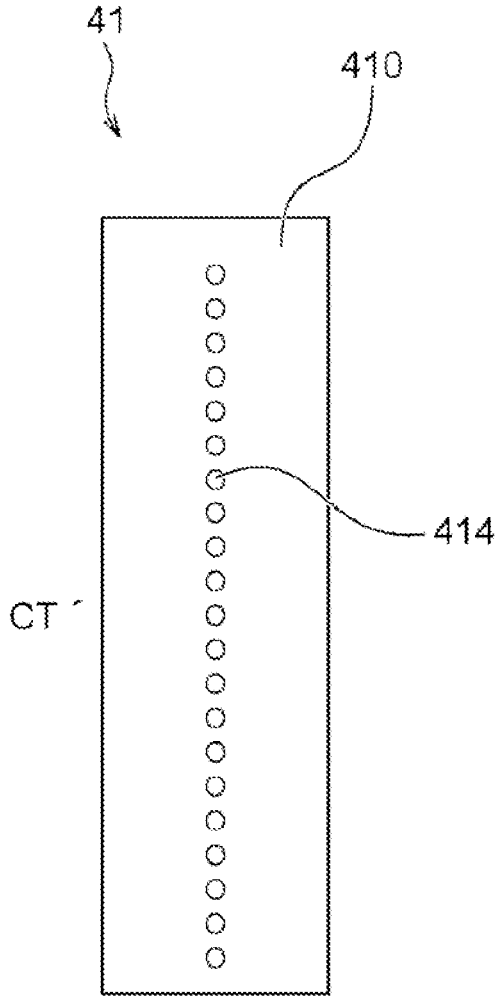
FIG. 18 is a diagram illustrating one example of formation of the plurality of polishing solution supply ports in order to achieve the flow rate distribution of the polishing solution shown in FIG. 17.

FIG. 17 is a diagram schematically illustrating one example of a flow rate distribution of the polishing solution. FIG. 18 is a diagram illustrating one example of formation of the plurality of polishing solution supply ports in order to achieve the flow rate distribution of the polishing solution shown in FIG. 17. As shown in FIGS. 17 and 18, the polishing solution supply device 40 has the plurality of polishing solution supply ports 414 formed in a range symmetric with respect to a corresponding position CT on the trajectory of rotation (broken line) of the polishing pad 100 corresponding to a center of rotation CT of the substrate WF. This configuration enables the polishing solution to be supplied such as to equalize the flow rate distribution of polishing solution SL in this range. In order to achieve this flow rate distribution, the supply member body 410 of the polishing solution supply member 41 has a length shorter than the length shown in FIGS. 7 and 8 but longer than the length shown in FIGS. 9 and 10. The plurality of polishing solution supply ports 414 have an identical opening diameter and have their opening centers arranged at equal intervals in the range symmetric with respect to the position CT as shown in FIG. 18.

The configuration of this example enables the polishing solution to be supplied in a uniform flow rate distribution in the range of an identical radius (<radius of the substrate WF) relative to the center of rotation of the substrate WF. When the polishing solution itself has a high chemical content, the supply in the uniform flow rate distribution reduces a change in polishing rate profile caused by the distribution of the supplied amount of the polishing solution. In the case where the polishing pad 100 has grooves formed in a concentrical arrangement, there may be a difficulty in spreading the polishing solution outward in the radial direction of the polishing pad 100 by the centrifugal force even by taking into account the rotation of the substrate WF. In such a case, the configuration of supplying the polishing solution to cover the diameter range of the substrate WF enables the polishing solution to be uniformly supplied over the entire surface of the substrate WF. When the arc length of the substrate WF where the polishing solution goes through on the polishing pad 100, however, an excess amount of the polishing solution is likely to be supplied at ends of the substrate WF having the short arc length. In such a case, the configuration of supplying the polishing solution in a supply range smaller than the radius of the substrate WF suppresses the polishing solution from being excessively supplied to the ends of the substrate WF and results in reducing the use amount of the polishing solution. As described above with reference to FIG. 7 to FIG. 18, the configuration of the embodiment achieves a desired flow rate distribution of the polishing solution by fixing/changing the opening diameter of the plurality of polishing solution supply ports 414, by fixing/changing the pitch of the plurality of polishing solution supply ports 414, or by arranging the plurality of polishing solution supply ports 414 in a single line/in multiple lines. The arrangement of the plurality of polishing solution supply ports 414 is not limited to the arrangements described in the examples of FIG. 7 to FIG. 18 but may be a combined arrangement of fixing/changing the opening diameter, fixing/changing the pitch, and arranging in a single line/in multiple lines to achieve a desired flow rate distribution of the polishing solution. The pad projection shape of the supply member body 410 and the cover member 430 is a rectangular shape extended linearly in a longitudinal direction in the examples of FIG. 7 to FIG. 18. The pad projection shape is, however, not limited to the rectangular shape according to the specification but may be, for example, a curved shape.

Figure 19:
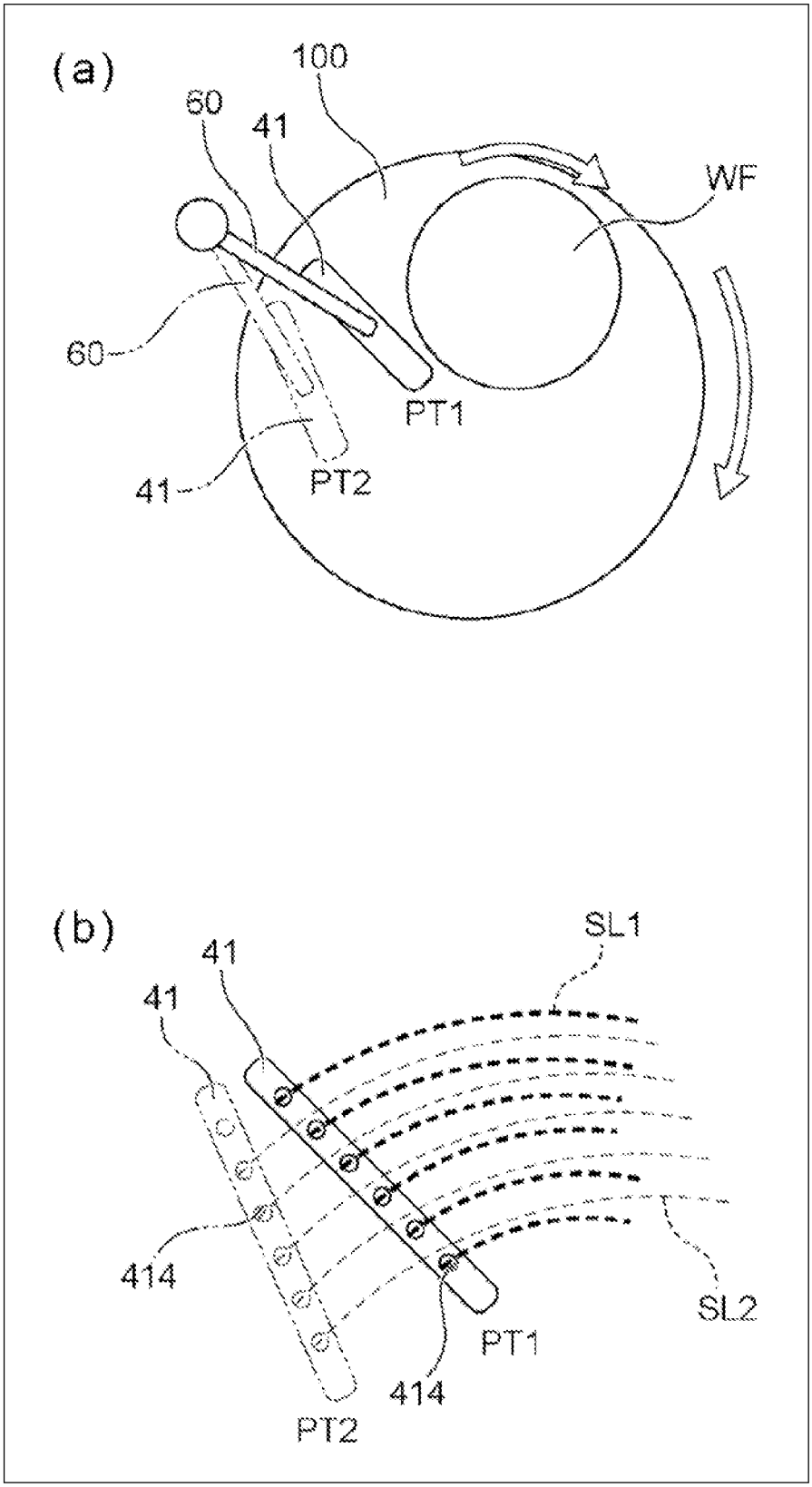
FIG. 19 is diagrams schematically illustrating the flow of the polishing solution by a swinging motion of the polishing solution supply member.

FIG. 19 is diagrams schematically illustrating the flow of the polishing solution by a swinging motion of the polishing solution supply member 41. As shown in FIG. 19(*a*), the polishing solution supply member 41 is configured to be swingable between a first position PT1 and a second position PT2 on the polishing pad 100 by a turning motion of the arm 60. As shown in FIG. 19(*b*), in the state that the polishing solution supply member 41 is placed at the first position PT1 or at the second position PT2, there is an interval between a flow of polishing solution SL1 and a flow of polishing solution SL2 supplied from the plurality of polishing solution supply ports 414. This is likely to make a discontinuous flow of the polishing solution. In the state that the polishing solution supply member 41 is swung between the first position PT1 and the second position PT2, on the other hand, the flow of the polishing solution supplied from the plurality of polishing solution supply ports 414 is changed between the flow SL1 and the flow SL2 alternately and continuously. This makes a continuous flow of the polishing solution.

As described above, according to the embodiment, the polishing solution is supplied from the plurality of polishing solution supply ports 414. The supplied amount of the polishing solution may be made discontinuous among the polishing solution supply ports 414, depending on the polishing conditions (for example, grooves formed in the polishing pad 100 and the rotation speeds of the substrate WF and the polishing table 20). The embodiment is, however, configured to swing the arm 60 connected with the polishing solution supply member 41. This configuration enables the track of the polishing solution supplied from the respective polishing solution supply ports 414 to be varied continuously and thereby eliminates the discontinuous supplied amount of the polishing solution. The swinging motions of the arm 60 are controlled, based on a polishing recipe and machine parameters set in the controller 200. In this case, the parameters include a swinging distance or a swinging range and a swinging speed. It is basically desirable that the swinging distance is an integral multiple of the pitch of the polishing solution supply ports 414 in the radial direction of the polishing pad 100. In the course of polishing, along with swinging motion of the polishing solution supply member 41, the polishing head 30 may be swung simultaneously by swinging the support arm 34.

Figure 20:
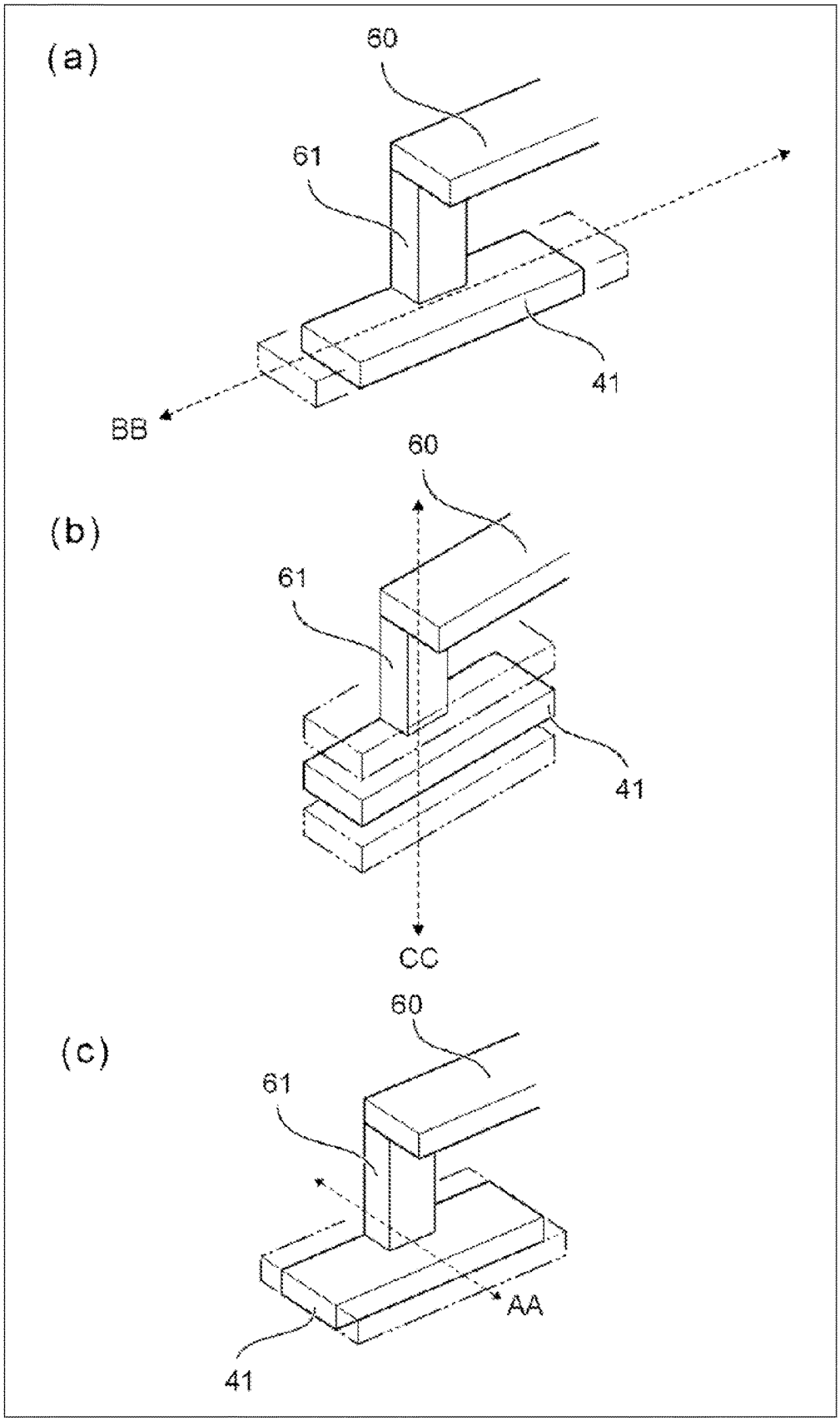
FIG. 20 is diagrams schematically illustrating sliding motions of the polishing solution supply member.

FIG. 20 is diagrams schematically illustrating sliding motions of the polishing solution supply member 41. As shown in FIGS. 20(*a*) to 20(*c*), the polishing solution supply member 41 is configured to be slidingly movable in a first direction where the plurality of polishing solution supply ports 414 are arrayed (in a direction of a virtual axis BB), in a second direction perpendicular to the polishing surface of the polishing pad 100 (in a direction of a virtual axis CC), and in a third direction orthogonal to both the first direction and the second direction (in a direction of a virtual axis AA) in the state that the polishing solution supply member 41 is placed to be opposed to the polishing pad 100.

For example, in a configuration of fastening the polishing solution supply member 41 and the link member 61 to each other or fastening the link member 61 and the arm 60 to each other by means of a screw or the like, the sliding motions of the polishing solution supply member 41 may be achieved by using a long hole formed in a member to be fastened. More specifically, the sliding motions of the polishing solution supply member 41 may be made by forming a long hole extended in the directions of the virtual axes AA, BB, and CC in at least one of the respective members to be fastened and adjusting the position of the polishing solution supply member 41 by the lengths of the long hole, prior to fastening. In a configuration of fastening the polishing solution supply member 41 and the link member 61 to each other or fastening the link member 61 and the arm 60 to each other by means of a friction-based clamp or the like, the sliding motions of the polishing solution supply member 41 may be made by adjusting the clamping position of the polishing solution supply member 41 to the link member 61 or the clamping position of the link member 61 to the arm 60 along the virtual axes AA, BB and CC. The sliding motions of the polishing solution supply member 41 are, however, not limited to these configurations but may be made by means of any driving mechanism such as an actuator or by means of any position adjustment mechanism such as a linear guide, a link mechanism, a spline, a ball screw, a screw and a spring, or a cam.

Figure 21:
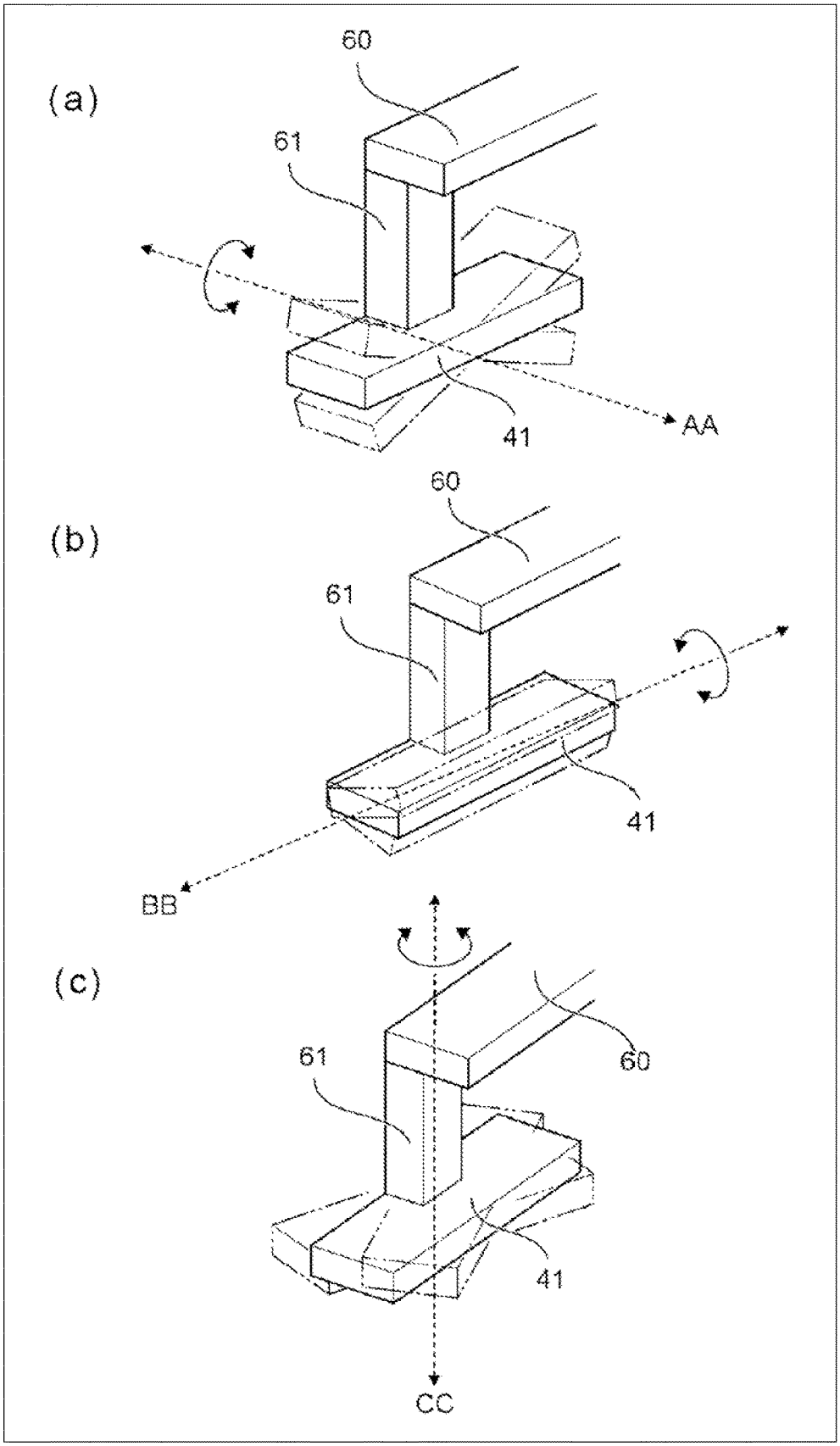
FIG. 21 is diagrams schematically illustrating angular adjustment of the polishing solution supply member.

FIG. 21 is diagrams schematically illustrating angular adjustment of the polishing solution supply member 41. As shown in FIGS. 21(*a*) to 21(*c*), the polishing solution supply member 41 is configured to be rotatable about the respective virtual axes BB, CC and AA in the first direction where the plurality of polishing solution supply ports 414 are arrayed, in the second direction perpendicular to the polishing surface of the polishing pad 100, and in the third direction orthogonal to both the first direction and the second direction, in the state that the polishing solution supply member 41 is placed to be opposed to the polishing pad 100.

The angular adjustment of the polishing solution supply member 41 may be achieved by, for example, a configuration that the polishing solution supply member 41 is supported by axes extended along the virtual axes AA, BB and CC to be rotatable about these axes and to be fixable at a desired angle. The polishing solution supply member 41 may be made rotatable about the virtual axes AA, BB and CC by linking the polishing solution supply member 41 with the link member 61 or by linking the link member 61 with the arm 60 by means of a ball joint or the like. The angular adjustment of the polishing solution supply member 41 is, however, not limited to these configurations but may be achieved by any driving mechanism such as an actuator.

Figure 23:
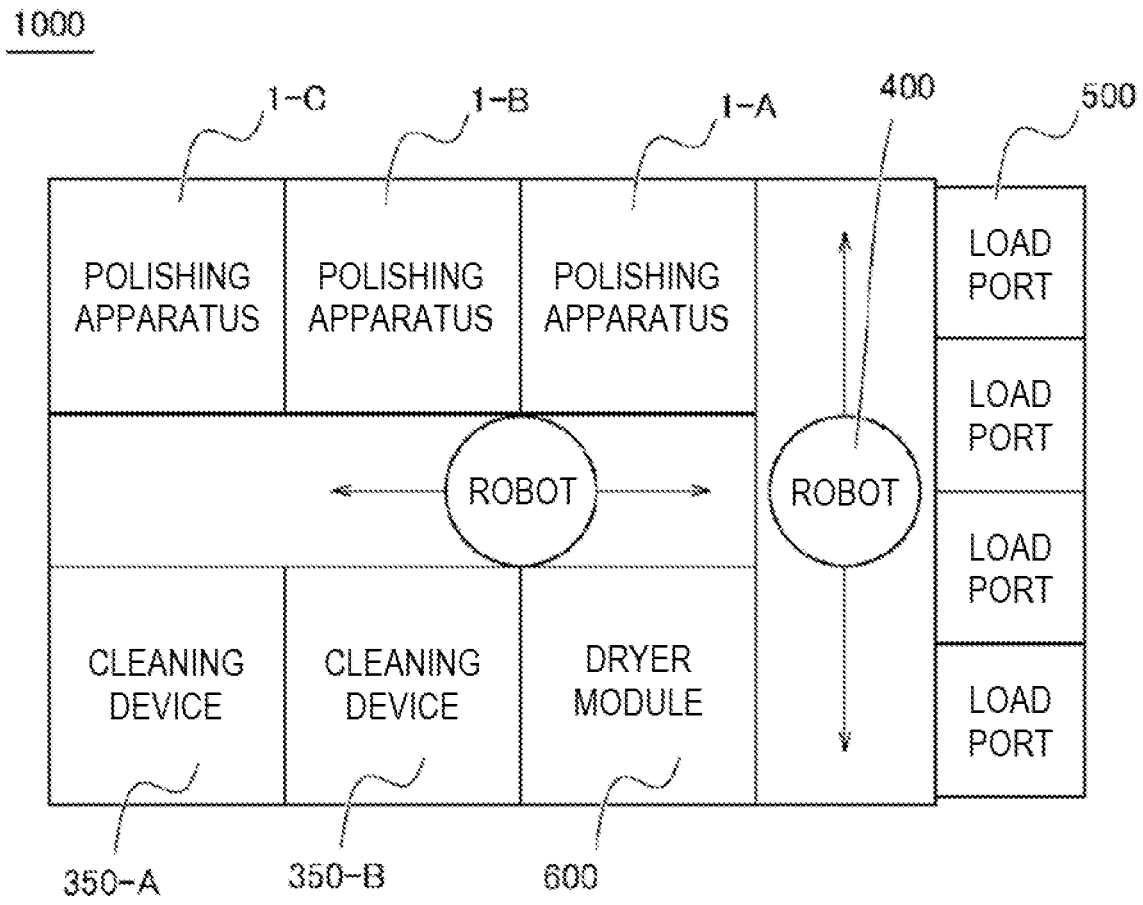
FIG. 23 is a plan view illustrating the schematic configuration of a processing system according to one embodiment.

Even in the case where the polishing solution supply devices 40 are mounted on a plurality of polishing apparatuses 1-A to 1-C as shown in FIG. 23 described later, the configuration of allowing for such sliding motions and angular adjustment enables the flow of the polishing solution to be adjusted to a predetermined flow and reduces the difference in polishing performance between the polishing apparatuses.

Figure 22:
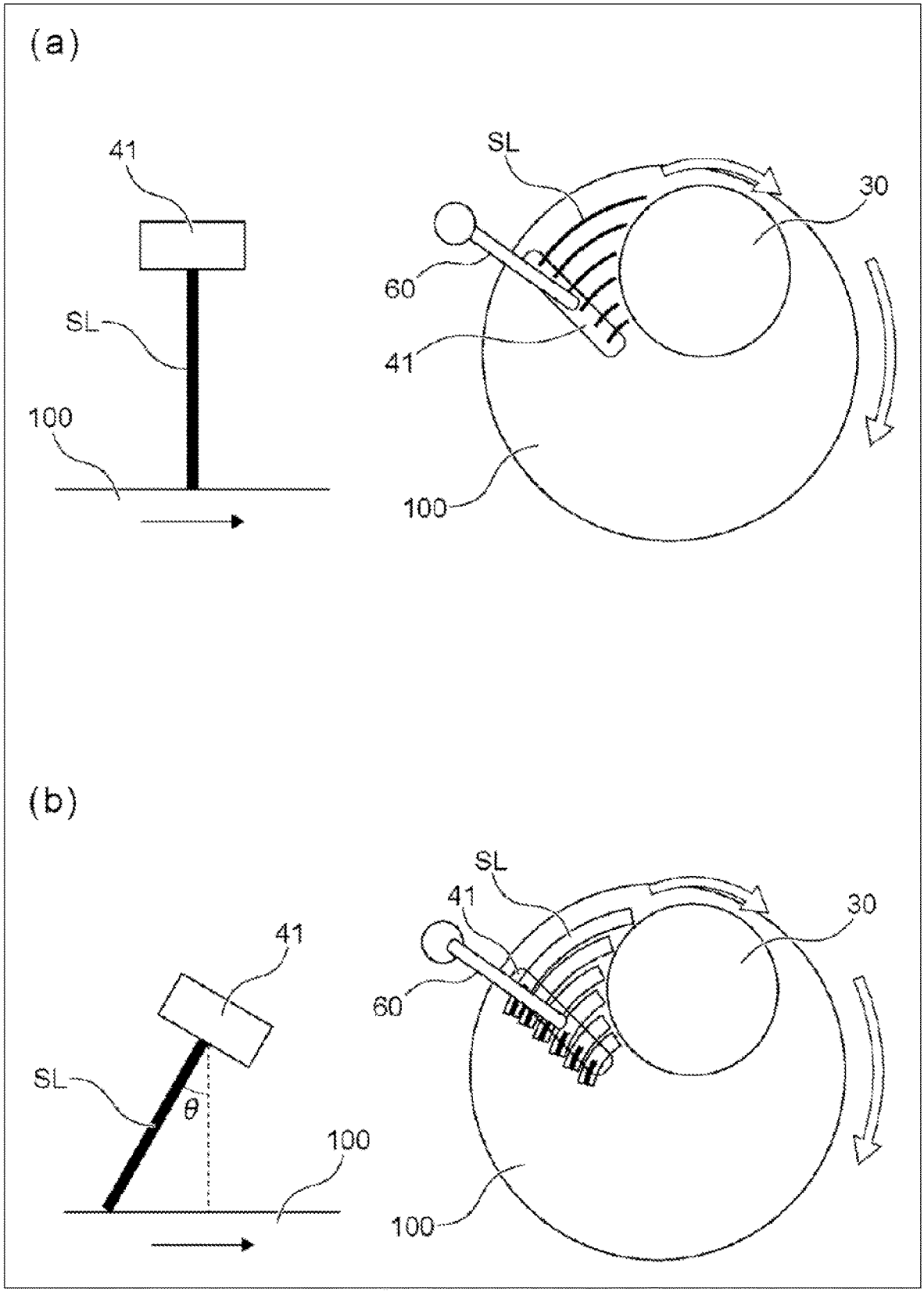
FIG. 22 is diagrams schematically illustrating a difference in distribution of the polishing solution by the angular adjustment of the polishing solution supply member.

The distribution of the polishing solution on the polishing surface 102 may be changed by changing the angle of the polishing solution supply member 41 to the rotating direction of the polishing pad 100. FIG. 22 is diagrams schematically illustrating a difference in distribution of the polishing solution by the angular adjustment of the polishing solution supply member 41. FIG. 22(*a*) illustrates the state that polishing solution SL is supplied perpendicularly to the polishing pad 100 with no angular adjustment of the polishing solution supply member 41. FIG. 22(*b*) illustrates the state that the polishing solution SL is supplied to an upstream side in rotation of the polishing pad 100 with angular adjustment of the polishing solution supply member 41 relative to the virtual axis BB such that the plurality of polishing solution supply ports 414 face to the upstream side in rotation of the polishing pad 100.

The configuration of the embodiment enables the distribution of the supplied polishing solution in the radial direction of the polishing pad 100 to be changed by changing the angle of the polishing solution supply member 41 to the polishing pad 100. More specifically, as shown in FIG. 22(*b*), in the case where the polishing solution is supplied with adjusting the angle of the polishing solution supply ports 414 to face to the upstream side in rotation of the polishing pad 100, the supplied polishing solution is spread outward such as to avoid the flow of the supplied polishing solution and is moved to a downstream side in rotation of the polishing pad 100. This configuration causes the polishing solution to be supplied to the substrate WF with being more effectively spread in the radial direction of the polishing pad 100, compared with the configuration of supplying the polishing solution perpendicularly to the polishing surface of the polishing pad 100. This further equalizes the distribution of the supplied amount of the polishing solution in the radial direction of the polishing pad 100. The rotation angle θ of the polishing solution supply member 41 is approximately 30 degrees according to the embodiment. The rotation angle θ may, however, be set arbitrarily.

FIG. 23 is a plan view illustrating the schematic configuration of a processing system according to one embodiment. The illustrated processing system 1000 includes polishing apparatuses 1-A to 1-C configured to polish and process the substrate WF as explained in the description hereof, cleaning devices 350-A and 350-B configured to clean the substrate WF, a robot 400 configured as a transport device of the substrate WF, loading ports 500 configured to load the substrate WF, and a dryer device or module 600. In this system configuration, the substrate WF to be processed enters one of the load ports 500. The substrate WF loaded by the load port 500 is transported or conveyed by the robot 400 to one of the polishing apparatuses 1-A to 1-C to be subjected to the polishing process. The substrate WF may be sequentially subjected to the polishing processes by a plurality of polishing apparatuses. The substrate WF after the polishing process is transported or conveyed by the robot 400 to either of the cleaning devices 350-A and 350-B to be cleaned. The substrate WF may be sequentially cleaned by the cleaning devices 350-A and 350-B. The cleaned substrate WF is transported or conveyed to the dryer device 600 to be dried. The dried substrate WF is returned to one of the load ports 500.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit respective constituent elements described in the claims and the specification in a range where at least a part of the above-mentioned problem can be solved or a range where at least a part of the effect is exhibited.

According to one aspect of the present disclosure, there is provided a polishing apparatus comprising a table configured to support a polishing pad: a polishing head configured to hold an object; and a polishing solution supply device configured to supply a polishing solution between the polishing pad and the object. The polishing apparatus causes the polishing pad and the object to be in contact with each other and to be rotated relative to each other in presence of the polishing solution and thereby polishes the object. The polishing solution supply device comprises a plurality of polishing solution supply ports arrayed in a direction intersecting with a rotating direction of the polishing pad in a state that the polishing solution supply device is placed on an upstream side in rotation of the polishing pad relative to the object. The polishing solution supply device supplies the polishing solution, such that the polishing solution supplied from the plurality of polishing solution supply ports has a predetermined flow rate distribution.

According to one aspect of the present disclosure, there is provided the polishing apparatus, wherein the polishing solution supply device may further comprise a polishing solution supply member configured to supply the polishing solution; an arm configured to hold the polishing solution supply member; and a flow rate regulating mechanism configured to regulate a flow rate of the polishing solution supplied from the polishing solution supply member. The arm may be configured to be turnable about a pivot placed outside of the polishing pad. The polishing solution supply member may comprise the plurality of polishing solution supply ports; and a buffer portion that is connected with the flow rate regulating mechanism and with the plurality of polishing solution supply ports.

According to one aspect of the present disclosure, there is provided the polishing apparatus, wherein the plurality of polishing solution supply ports may have opening diameters of 0.3 to 2 mm.

According to one aspect of the present disclosure, there is provided the polishing apparatus, wherein the polishing solution supply device may have the plurality of polishing solution supply ports formed in a range corresponding to a diameter of the object and configured to supply the polishing solution such as to have a uniform flow rate distribution of the polishing solution in the range.

According to one aspect of the present disclosure, there is provided the polishing apparatus, wherein the polishing solution supply device may have the plurality of polishing solution supply ports formed in a range corresponding to a radius of the object on a side nearer to a center of rotation of the polishing pad and configured to supply the polishing solution such as to have a uniform flow rate distribution of the polishing solution in the range.

According to one aspect of the present disclosure, there is provided the polishing apparatus, wherein the plurality of polishing solution supply ports may have an identical opening diameter and may be arranged at equal intervals in the range corresponding to the diameter of the object, or in the range corresponding to the radius of the object on the side nearer to the center of rotation of the polishing pad.

According to one aspect of the present disclosure, there is provided the polishing apparatus, wherein the polishing solution supply device may have the plurality of polishing solution supply ports formed in an equal distance range from a corresponding position on a trajectory of rotation of the polishing pad corresponding to a center of rotation of the object toward positions corresponding to respective outer circumferences of the object and configured to supply the polishing solution such as to increase a flow rate of the polishing solution in the range from the corresponding position on the trajectory of rotation of the polishing pad corresponding to the center of rotation of the object toward the positions corresponding to the respective outer circumferences of the object.

According to one aspect of the present disclosure, there is provided the polishing apparatus, wherein the polishing solution supply device may have the plurality of polishing solution supply ports formed in a range corresponding to a radius of the object on a side nearer to a center of rotation of the polishing pad and configured to supply the polishing solution such as to increase a flow rate of the polishing solution in the range from a corresponding position on a trajectory of rotation of the polishing pad corresponding to a center of rotation of the object toward a position corresponding to an outer circumference of the object on the side nearer to the center of rotation of the polishing pad.

According to one aspect of the present disclosure, there is provided the polishing apparatus, wherein the plurality of polishing solution supply ports may have opening centers thereof arranged at equal intervals and may have opening diameters increasing continuously or by every fixed number, from the corresponding position on the trajectory of rotation of the polishing pad corresponding to the center of rotation of the object toward the positions corresponding to the respective outer circumferences of the object or from the corresponding position on the trajectory of rotation of the polishing pad corresponding to the center of rotation of the object toward the position corresponding to the outer circumference of the object on the side nearer to the center of rotation of the polishing pad.

According to one aspect of the present disclosure, there is provided the polishing apparatus, wherein the plurality of polishing solution supply ports may have an identical opening diameter and may have intervals of the respective polishing solution supply ports decreasing continuously or by every fixed number, from the corresponding position on the trajectory of rotation of the polishing pad corresponding to the center of rotation of the object toward the positions corresponding to the respective outer circumferences of the object or from the corresponding position on the trajectory of rotation of the polishing pad corresponding to the center of rotation of the object toward the position corresponding to the outer circumference of the object on the side nearer to the center of rotation of the polishing pad.

According to one aspect of the present disclosure, there is provided the polishing apparatus, wherein the polishing solution supply device may have the plurality of polishing solution supply ports formed in a range corresponding to a diameter of the object and configured to supply the polishing solution such as to increase a flow rate of the polishing solution in the range from a position corresponding to an outer circumference of the object on a side nearer to a center of rotation of the polishing pad toward a position corresponding to an outer circumference of the object on a side farther from the center of rotation of the polishing pad.

According to one aspect of the present disclosure, there is provided the polishing apparatus, wherein the plurality of polishing solution supply ports may have opening centers thereof arranged at equal intervals and may have opening diameters increasing continuously or by every fixed number, from the position corresponding to the outer circumference of the object on the side nearer to the center of rotation of the polishing pad toward the position corresponding to the outer circumference of the object on the side farther from the center of rotation of the polishing pad.

According to one aspect of the present disclosure, there is provided the polishing apparatus, wherein the plurality of polishing solution supply ports may have an identical opening diameter and may have intervals of the respective polishing solution supply ports decreasing continuously or by every fixed number, from the position corresponding to the outer circumference of the object on the side nearer to the center of rotation of the polishing pad toward the position corresponding to the outer circumference of the object on the side farther from the center of rotation of the polishing pad.

According to one aspect of the present disclosure, there is provided the polishing apparatus, wherein the polishing solution supply member may be configured to be swingable on the polishing pad by a turning motion of the arm.

According to one aspect of the present disclosure, there is provided the polishing apparatus, wherein the polishing solution supply member may be configured to be slidable in a first direction where the plurality of polishing solution supply ports are arrayed, in a second direction perpendicular to a polishing surface of the polishing pad, and in a third direction orthogonal to both the first direction and the second direction.

According to one aspect of the present disclosure, there is provided the polishing apparatus, wherein the polishing solution supply member may be configured to be rotatable about respective virtual axes in a first direction where the plurality of polishing solution supply ports are arrayed, in a second direction perpendicular to a polishing surface of the polishing pad, and in a third direction orthogonal to both the first direction and the second direction.

According to one aspect of the present disclosure, there is provided the polishing apparatus that may further comprise a cleaning mechanism configured to supply a cleaning solution to the polishing solution supply device tuned to outside of the polishing pad by a turning motion of the arm.

According to one aspect of the present disclosure, there is provided a processing system configured to process an object. The processing system comprises the polishing apparatus of any one of the aspects described above; a cleaning device configured to clean the object polished by the polishing apparatus: a dryer device configured to dry the object cleaned by the cleaning device; and a transport device configured to transport or convey the object between the polishing apparatus, the cleaning device and the dryer device.

First Embodiment (General Configuration of Polishing Apparatus)

Figure 24:
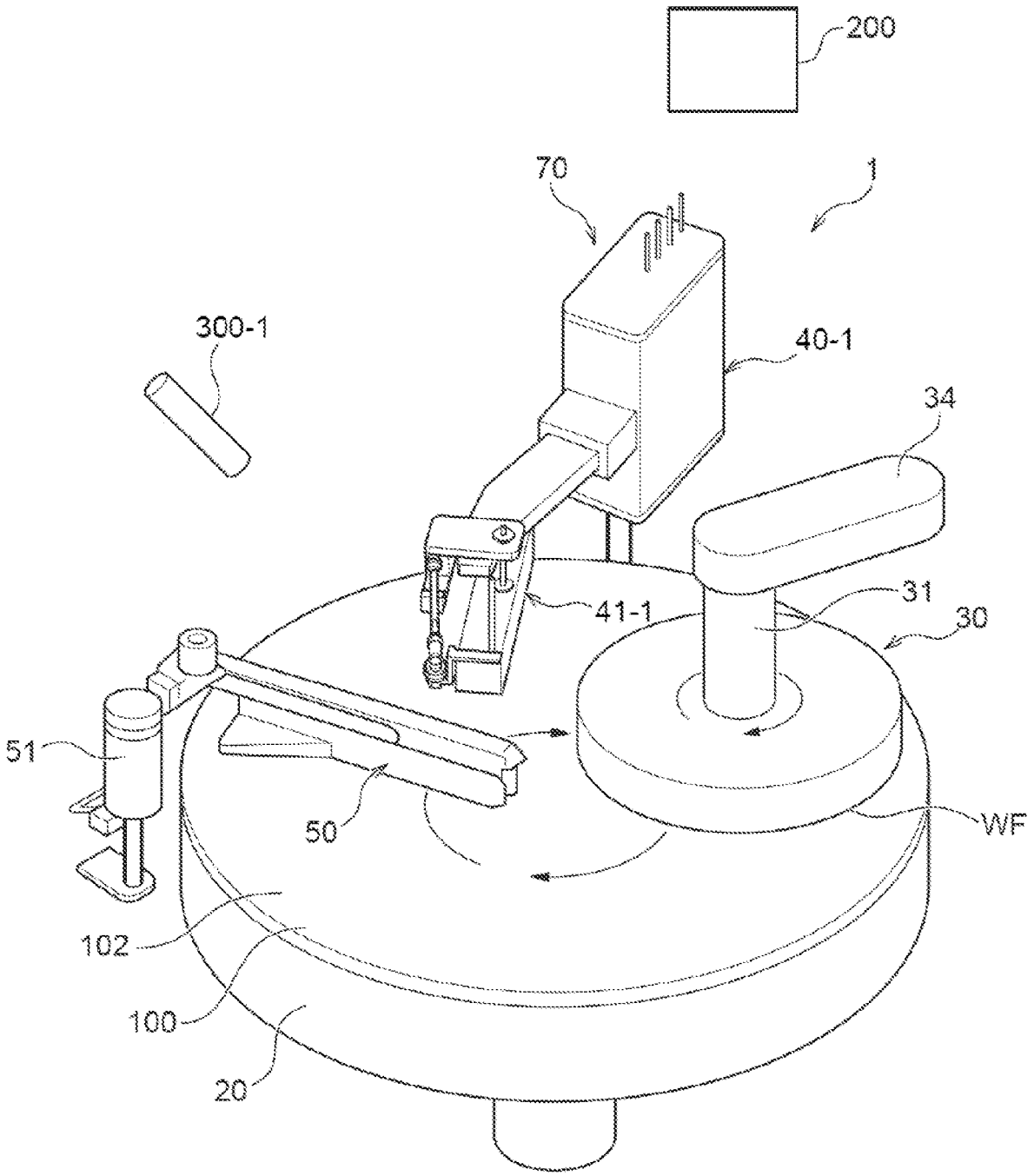
FIG. 24 is a diagram illustrating the schematic configuration of a polishing apparatus according to one embodiment of the present disclosure.

FIG. 24 is a diagram illustrating the schematic configuration of a polishing apparatus according to one embodiment of the present disclosure. A polishing apparatus 1 of the embodiment is configured to polish a substrate WF such as a semiconductor wafer as an object to be polished by using a polishing pad 100 having a polishing surface 102. As illustrated, the polishing apparatus 1 includes a polishing table 20 configured to support the polishing pad 100 and a top ring (substrate holder) 30 configured to hold the substrate and press the substrate against the polishing surface 102 of the polishing pad 100. The polishing apparatus 1 additionally includes a polishing solution supply system 40-1 configured to supply a polishing solution (slurry) to the polishing pad 100 and an atomizer 50 configured to spray a liquid such as pure water and/or a gas such as nitrogen onto the polishing surface 102 so as to wash away the used slurry, the polishing residue and the like.

The polishing table 20 is formed in a disk-like shape and is configured to be rotatable about a center axis of the disk-like shape as an axis of rotation. The polishing pad 100 is mounted to the polishing table 20 by pasting or the like. A surface of the polishing pad 100 forms the polishing surface 102. As the polishing table 20 is rotated by a non-illustrated motor, the polishing pad 100 is rotated integrally with the polishing table 20.

The top ring 30 has a lower face configured to hold the substrate WF as the object to be polished by vacuum suction or the like. The top ring 30 is configured to be rotatable along with the substrate by the power from a non-illustrated motor. The top ring 30 has an upper portion connected with a support arm 34 via a shaft 31. The top ring 30 is also configured to be movable in a vertical direction by motor driving via a non-illustrated air cylinder or ball bearing, so as to adjust the distance from the polishing table 20. This configuration enables the top ring 30 to press the substrate WF held thereby against the surface of the polishing pad 100 (the polishing surface 102). Furthermore, the top ring 30 has a non-illustrated airbag that is placed inside thereof and that is divided into a plurality of areas. A pressure is applied to the substrate WF from its back face by supplying a pressure of any fluid such as the air to the respective airbag areas. Moreover, the support arm 34 is configured to be tunable by a non-illustrated motor, so as to move the top ring 30 in a direction parallel to the polishing surface 102. According to the embodiment, the top ring 30 is configured to be movable between a non-illustrated substrate receiving position and an upper position above the polishing pad 100 and is also configured to change a pressing position where the substrate WF is pressed against the polishing pad 100. In the description below, the pressing position (holding position) where the substrate WF is pressed by the top ring 30 is also referred to as "polishing area".

The polishing solution supply system 40-1 includes a polishing solution supply device 41-1 serving to supply the polishing solution (slurry) to the polishing pad 100 and is configured to make the polishing solution supply device 41-1 movable between a supply position on the polishing surface 102 and a retreat position on outside of the polishing table 20. The polishing solution supply system 40-1 is also configured to change the supply position of the polishing solution supply device 41-1 on the polishing surface 102. The details of the polishing solution supply system 40-1 will be described later.

The atomizer 50 is a device configured to spray a liquid and/or a gas (for example, pure water and/or nitrogen) to the polishing surface 102 from one or a plurality of nozzles and wash away the used slurry, polishing residue and the like. The atomizer 50 is connected with a lifting and/or turning mechanism 51. The atomizer 50 is configured to be movable between an operating position on the polishing surface 102 and a retreat position on outside of the polishing table 20 by the lifting and/or turning mechanism 51. The atomizer 50 is also configured to change the operating position and height on the polishing surface 102 by the lifting and/or turning mechanism 51.

The polishing apparatus 1 further includes a controller 200 configured to control the general operations of the polishing apparatus 1. The controller 200 may be configured by a microcomputer that includes a CPU, memories and the like and that uses software such as a polishing recipe and/or information of machine parameters of relevant equipment input in advance to achieve desired functions, may be configured by a hardware circuit that performs exclusive arithmetic processing, or may be configured by a combination of the microcomputer and the hardware circuit that performs exclusive arithmetic processing.

The polishing apparatus 1 polishes the substrate WF by a procedure described below. The procedure first rotates the polishing pad 100, while rotating the top ring 30 with the substrate WF held by the lower surface thereof. The procedure uses the polishing solution supply system 40-1 described later in this state to supply the slurry. More specifically, prior to supply of the slurry, the polishing solution supply device 41-1 is moved to a predetermined position on the polishing surface 102 of the polishing pad 100 by a turning operation of an arm 60 that is engaged with the polishing solution supply device 41-1, by means of a lifting turning mechanism 70 (described later). Simultaneously with a start of supply of the slurry, the polishing solution supply device 41-1 is subsequently lowered to the polishing surface 102 of the polishing pad 100 by an up/down operation of the lifting turning mechanism 70, so as to come into contact with the polishing surface 102. The relationship between the turning stop and lowering operations and the supply start operation of the polishing solution supply device 41-1 is not limited to the above description but may be set appropriately according to the specifications of the device. The substrate WF held by the top ring 30 is then pressed against the polishing surface 102. This causes the substrate WF and the polishing pad 100 to be moved relative to each other in the state that the surface of the substrate WF is in contact with the polishing pad 100 in the presence of the slurry and thereby polishes the substrate. After conclusion of polishing, the polishing solution supply device 41-1 is lifted up by the lifting turning mechanism 70, is subsequently moved to the retreat position on outside of the polishing pad 100 by the turning operation of the arm 60 by means of the lifting turning mechanism 70, and is then cleaned by using a cleaning nozzle 300-1. This sequence of operations may be set in advance by the polishing recipe and/or the preset machine parameters provided in the controller 200.

The configuration of the polishing apparatus 1 described above is merely one example, and another configuration may be employed. For example, the polishing apparatus 1 may further include a dresser and/or a temperature regulation device or mechanism and may exclude the atomizer. The dresser serves to perform surface conditioning of the polishing surface 102 of the polishing pad 100 during an interval between polishing operations or in the course of polishing. The dresser presses a disk that has a smaller diameter than the diameter of the polishing pad 100 and that has diamond abrasive grains placed thereon, against the polishing surface 102 of the polishing pad 100 and moves the disk relative to the polishing pad 100, so as to condition the entire polishing surface 102 of the polishing pad 100. For example, the temperature regulation mechanism may be connected with the polishing solution supply device to heat up or cool down the slurry itself. In another example, the temperature regulation mechanism may be provided with a heat exchanger placed near to the polishing surface 102 of the polishing pad 100 and may be configured to heat up or cool down the heat exchanger by using a heater placed inside of the heat exchanger or by supplying either of hot water or cold water or a mixture of hot water and cold water at a predetermined mixing ratio to the heat exchanger, and to transmit the temperature of the heated or cooled heat exchanger to the polishing surface 102 and thereby regulate the temperature of the polishing surface 102. In another example, the temperature regulation mechanism may be configured to inject and supply a gas (for example, the air, $N_2$ or the like) to the polishing surface 102 of the polishing pad 100 to cool down the polishing surface 102.

(Polishing Solution Supply System)

Figure 25:
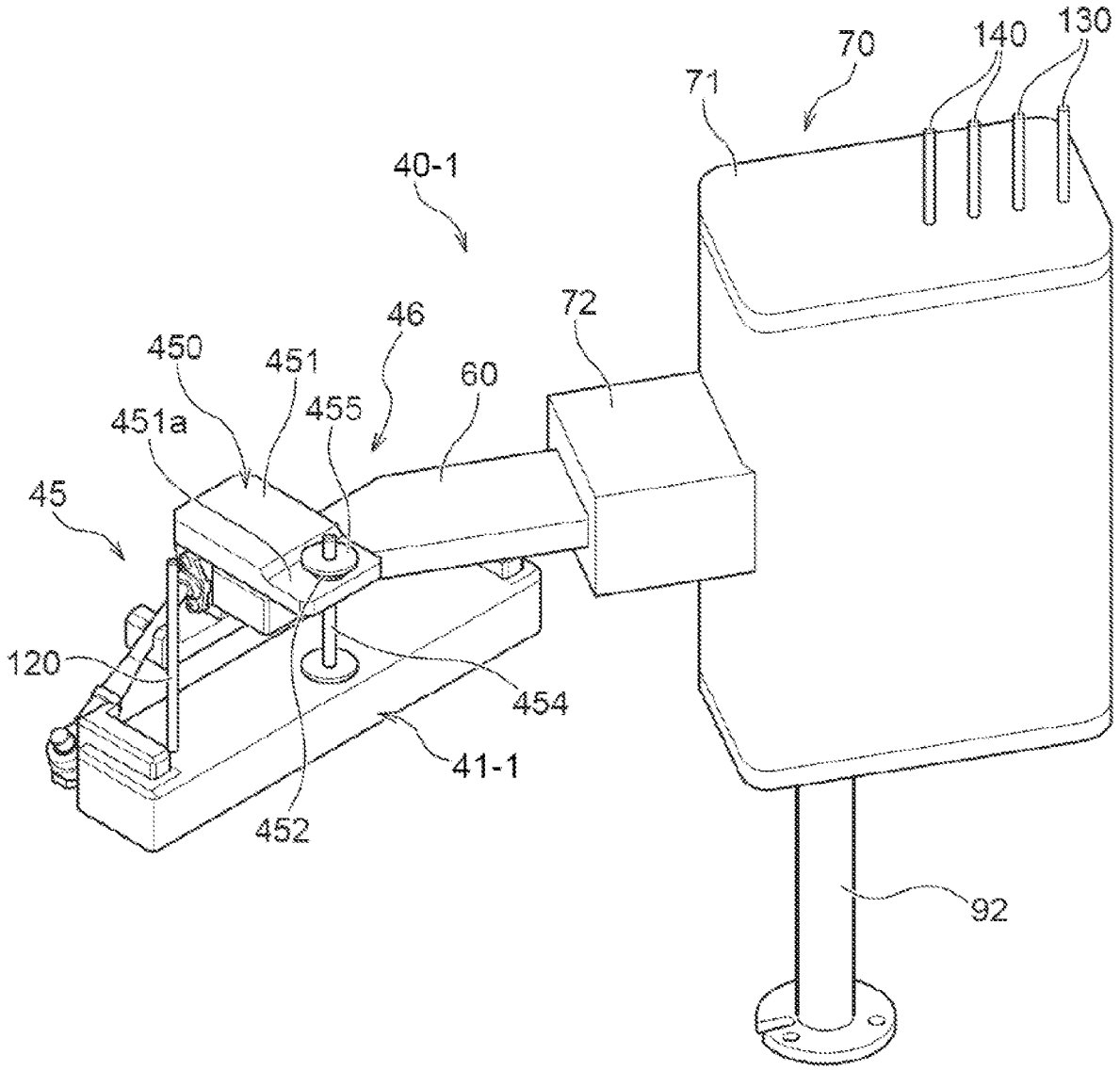
FIG. 25 is a perspective view illustrating a polishing solution supply system viewed from a downstream side thereof.
Figure 26:
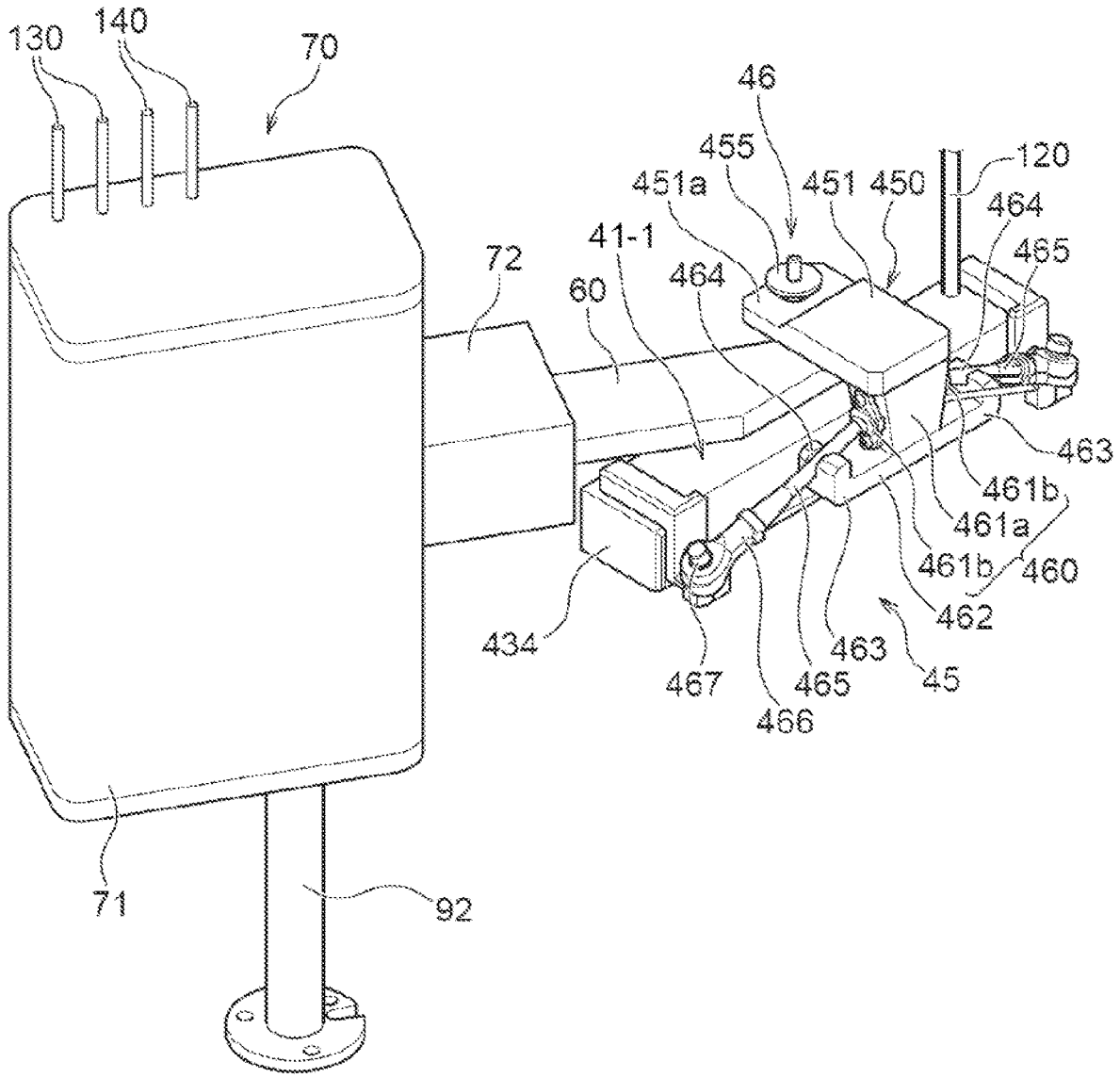
FIG. 26 is a perspective view illustrating the polishing solution supply system viewed from an upstream side thereof.
Figure 27:
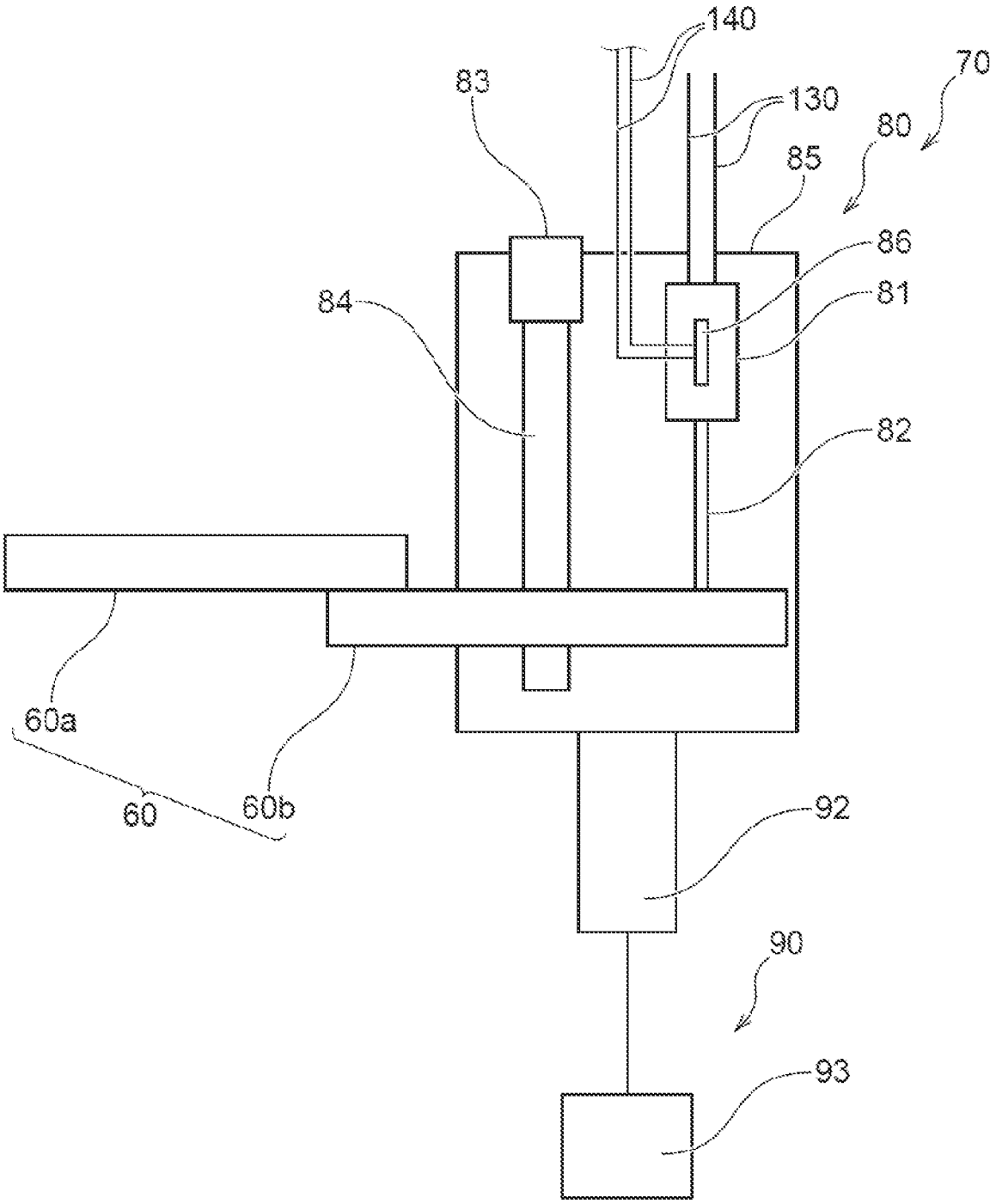
FIG. 27 is a diagram illustrating the configuration of a lifting mechanism.

FIG. 25 is a perspective view illustrating the polishing solution supply system viewed from a downstream side thereof. FIG. 26 is a perspective view illustrating the polishing solution supply system viewed from an upstream side thereof. FIG. 27 is a diagram illustrating the configuration of the lifting mechanism. In the description hereof, the upstream side and the downstream side denote an upstream side and a downstream side in the case where the polishing table 20 (the polishing pad 100) is rotated clockwise in FIG. 24.

As illustrated, the polishing solution supply system 40-1 includes the polishing solution supply device 41-1, the arm 60, and a following mechanism 45 and a suspending mechanism 46 provided to link the polishing solution supply device 41-1 with the arm 60. The polishing solution supply device 41-1 is configured to come into contact with the polishing surface 102 by the load of a weight (described later) provided inside of the polishing solution supply device 41-1. The contact pressure (load) of the polishing solution supply device 41-1 applied to the polishing surface 102 is adjustable by changing the load of the weight. In this illustrated example, the polishing solution supply device 41-1 is uniformly brought into contact with the polishing surface 102 by the load of the weight. Another technique may, however, be employed. For example, the polishing solution supply device 41-1 may be uniformly brought into contact with the polishing surface 102 by applying a fluid pressure to a pad body (described later) of the polishing solution supply device 41-1 via an elastic body such as an airbag. The expression of "bringing" the polishing solution supply device 41-1 "into contact with" the polishing surface 102 in the description hereof does not mean pressing the polishing solution supply device 41-1 to apply a pressure and even the unevenness of the polishing pad but means pressing the polishing solution supply device 41-1 to follow the unevenness of the polishing pad. The minimum requirement is thus merely the deadweight of the weight of the polishing solution supply device 41-1 (naturally including the weight of the pad body and the like included in the polishing solution supply device 41-1) or the fluid pressure via the elastic body such as the airbag.

The polishing solution supply device 41-1 is connected with a slurry supply line 120. The polishing solution supply device 41-1 serves to supply the slurry fed through the slurry supply line 120 from a device bottom face thereof onto the polishing surface 102. The following mechanism 45 and the suspending mechanism 46 serve to change the connecting state between the polishing solution supply device 41-1 and the arm 60. More specifically, the following mechanism 45 and the suspending mechanism 46 change the connecting state of the polishing solution supply device 41-1 with the arm 60 between a released state that the polishing solution supply device 41-1 is released from vertical motions of the arm 60 by the lifting turning mechanism 70 described later (i.e., released from the hold by the arm 60) and a locked state that the polishing solution supply device 41-1 is made to follow the vertical motions of the arm 60 (i.e., the state that the polishing solution supply device 41-1 is held by the arm 60). The arm 60 is extended from a base end portion thereof to a leading end portion thereof which the polishing solution supply device 41-1 is mounted to. In this illustrated example, the arm 60 is bent in the middle thereof, with a view to avoiding the interference with another unit and is extended toward a downstream side in a rotating direction of the polishing table in plan view. The arm 60 may not be bent but may be linearly arranged according to the specification of the apparatus. As shown in FIG. 27, the arm 60 may be configured to include a leading end side portion 60*a* and a base end portion 60*b* provided as separate members and linked with each other by means of any fixation means such as a bolt. The leading end side portion 60*a* and the base end portion 60*b* of the arm 60 may be formed integrally. In the case where the leading end side portion 60*a* and the base end portion 60*b* are provided as separate members, multiple different types of the leading end side portions 60*a* having different bending angles may be provided by taking into account the workability and/or the positioning property. Each of the different types of the leading end side portions 60*a* (arm) may be provided with a plurality of pin holes or a plurality of pins such as to be adjustable among a plurality of (for example, three) different angles relative to the base end portion 60*b*. This configuration allows for fine adjustment of the set angle in the leading end side portion 60*a* of an identical type.

(Lifting Turning Mechanism)

The base end portion 60*b* of the arm 60 is connected with the lifting turning mechanism 70 configured to lift up, lower, and turn the arm 60 as shown in FIG. 27. The lifting turning mechanism 70 includes the lifting mechanism 80 configured to lift up and lower the arm 60, and the turning mechanism 90 configured to turn the arm 60. The lifting mechanism 80 and the turning mechanism 90 are controlled by the controller 200.

In this illustrated example, the lifting mechanism 80 includes a lift cylinder 81 fixed to a frame 85, and the base end portion 60*b* of the arm 60 is fixed to an axis 82 of the lift cylinder 81. The lift cylinder 81 is configured to receive a supply of a fluid (a gas such as the air or a liquid such as hydraulic oil) through fluid lines 130 to advance or retreat the axis 82. The lift cylinder 81 has two chambers parted by, for example, a piston and arranged such that one of the fluid lines 130 is connected with one chamber and the other of the fluid lines 130 is connected with the other chamber. The lift cylinder 81 advances and retreats the axis 82 by introducing the fluid into one chamber and discharging the fluid from the other chamber and by introducing the fluid into the other chamber and discharging the fluid from one chamber. The arm 60 is configured to be moved in a vertical direction by advance and retreat of the axis 82 of the lift cylinder 81. The lifting mechanism 80 further includes a ball spline 83 configured to guide the vertical motions of the arm 60. The ball spline 83 is fixed to the frame 85. The base end portion 60*b* of the arm 60 is fit in an axis 84 of the ball spline 83, and the vertical motions of the arm 60 by the lift cylinder 81 are guided along the axis 84. The configuration of guiding the vertical motions of the arm 60 is not limited to the ball spline, but may be any other guide mechanism or may be omitted. A sensor 86 (for example, a magnetic sensor) is provided to detect a move of the axis 82 of the lift cylinder 81 and thereby detect the height of the arm 60. Electric cables 140 denote cables connected with the sensor. The sensor may, however, be omitted. The lifting mechanism 80 is not limited to the above configuration but may be any other configuration to lift up and lower the arm 60. Furthermore, the lifting mechanism 80 employs the lift cylinder 81-based driving system in this illustrated example but may employ a motor driving system via a ball screw or a belt mechanism.

The base end portion 60*b* of the arm 60 is also connected with the turning mechanism 90 configured to turn the arm 60 via the frame 85. In this illustrated example, the turning mechanism 90 has a motor 93 that is connected with, for example, a lower end of a shaft 92 fixed to a lower portion of the frame 85 as shown in FIG. 27. The motor 93 is connected with the shaft 92 via, for example, a reduction mechanism or the like. An axis of the motor 93 may be directly connected with the shaft 92. The arm 60 is configured to be turnable in a plane parallel to the polishing surface 102 via the shaft 92 that is rotated by rotation of the motor 93. The turning mechanism 90 is not limited to the configuration described above but may employ any other configuration that enables the arm 60 to be turned. For example, a pulse motor may be used for the motor 93 of the turning mechanism 90, and the arm 60 may be turned to any angle by regulating the input pulse of the pulse motor.

In this illustrated example, as shown in FIG. 25 and FIG. 26, the base end portion 60*b* of the metal arm 60 and the lifting mechanism 80 are placed in a waterproof box 71 provided to protect these components from splashes of the slurry, water, polishing residue and the like. As shown in FIG. 25 and FIG. 26, the base end side of the arm 60 is covered with a waterproof box 72. For the purpose of enhancing the waterproof performance of the arm 60, the surface of the arm 60 (especially, a portion of the arm 60 located outside of the waterproof boxes 71 and 72 in FIG. 25 and FIG. 26 and an exposed portion of the arm 60 that is not covered with waterproof means according to a second embodiment (for example, a portion of the arm 60 located outside of an auxiliary cover 520)) may be coated with a water-repellent material such as a fluororesin. In this case, appropriately cleaning the portion of the arm 60 located outside of the waterproof boxes 71 and 72 by using the cleaning nozzle 300-1 (shown in FIG. 24) outside of the polishing table 20 reduces a trouble caused by adhesion of the slurry and the like. A configuration of covering a major part or the entirety of the arm 60 with a waterproof cover may be employed in place of the configuration of coating the arm 60 with the resin. The waterproof boxes 71 and 72 may also be appropriately cleaned by using the cleaning nozzle 300-1 (shown in FIG. 24).

(Suspending Mechanism)

Figure 28:
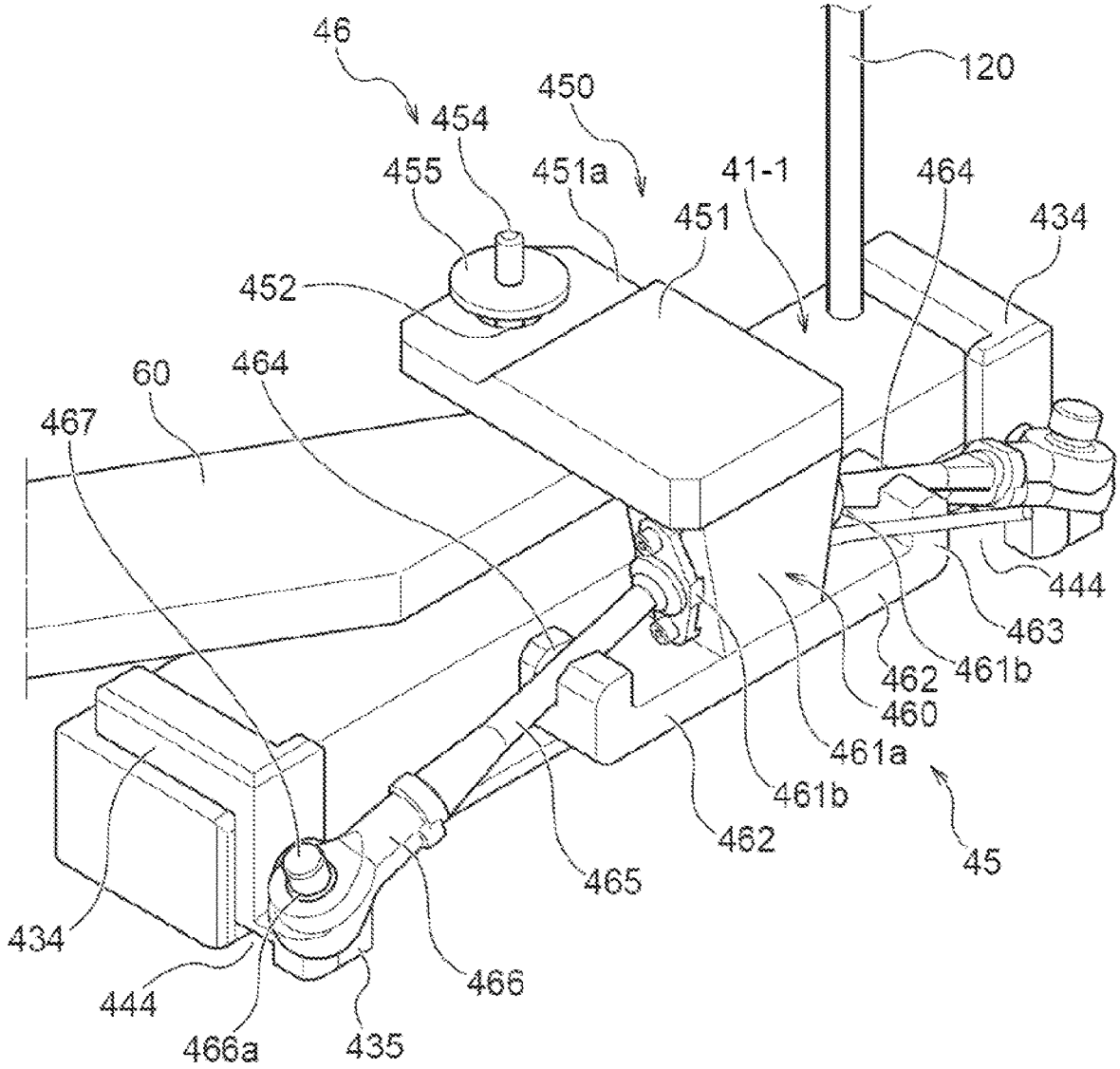
FIG. 28 is a perspective view illustrating a polishing solution supply device.
Figure 29:
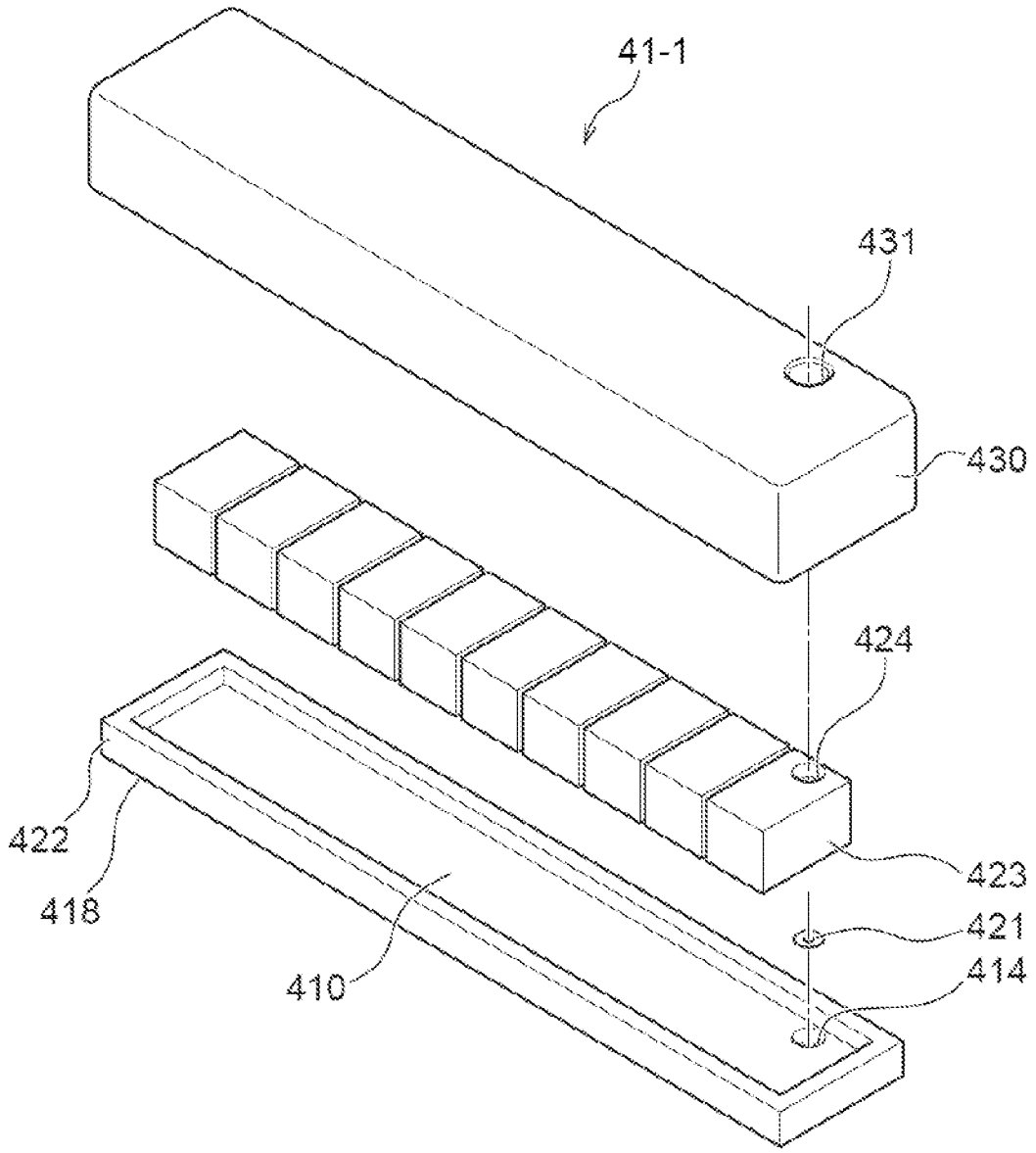
FIG. 29 is an exploded perspective view illustrating the polishing solution supply device.

FIG. 28 is a perspective view illustrating the polishing solution supply device. As shown in FIG. 25 and FIG. 28, the suspending mechanism 46 includes an arm-side stopper 450 (corresponding to the "engagement portion") fixed to a leading end of the arm 60 and a pad-side stopper 455 (corresponding to the "first stopper") fixed to the polishing solution supply device 41-1 via a shaft 454. The arm-side stopper 450 may be fixed to the arm 60 by a bolt, by an adhesive or by any other means. The arm-side stopper 450 may be formed integrally with the arm 60 (i.e., part of the arm 60 may form the arm-side stopper 450). The shaft 454 has one end fixed to a cover 430 of the polishing solution supply device 41-1 (as shown in FIG. 29) and is provided with the pad-side stopper 455 on the other end thereof. The pad-side stopper 455 employed may be, for example, a washer or a flange but may be any structure that serves as a large diameter portion of the shaft 454. The pad-side stopper 455 may be fixed to the shaft 454 by nut insertion, by an adhesive or by any other means and may be formed integrally with the shaft 454. The shaft 454 is passed through a through hole 452 provided in the arm-side stopper 450 between the polishing solution supply device 41-1 and the pad-side stopper 455. The through hole 452 has a passage area of such dimensions that do not cause an inner wall thereof to come into contact with the shaft 454 and is configured to prevent the shaft 454 from coming into contact with a passage wall (inner wall) thereof during operation of the following mechanism 45. The through hole 452 is a circular hole in this illustrated example but may be a hole or a cut in any arbitrary shape (including a polygonal shape or the like). In the case of a cut, the polishing solution supply device 41-1 may be demounted from the arm-side stopper 450 without detachment of the pad-side stopper 455 from the shaft 454.

When the arm 60 is lifted up by the lifting mechanism 80, the arm-side stopper 450 is engaged with a lower face of the pad-side stopper 455 (more specifically, the pad-side stopper 455 is engaged with a peripheral part of the through hole 452 of the arm-side stopper 450), and the polishing solution supply device 41-1 is lifted up with the lift-up of the arm 60. In this state, the pad-side stopper 455 serves to suppress inclination of the polishing solution supply device 41-1 in a width direction/short side direction (a direction crossing a longitudinal direction). When the arm 60 is lowered in the state that the polishing solution supply device 41-1 is landed on the polishing surface 102, the arm-side stopper 450 is separated from the lower face of the pad-side stopper 455 and moves downward. In this state, the polishing solution supply device 41-1 is released from the hold/support of the arm 60 and is brought into contact with the polishing surface 102 uniformly (to follow the unevenness of the polishing surface 102) by the load of a weight 423 (described later) provided inside thereof, irrespective of the position of the arm 60. In this illustrated example, an upper face 451 of the arm-side stopper 450 has a stepped face 451*a* (hereinafter also referred to as stopper face 451*a*) that is a part where the arm-side stopper 450 is engaged with the pad-side stopper 455 and that is lower than a residual part. The height of the stepped face 451*a* is set by adjusting the position of engagement of the pad-side stopper 455 with the arm-side stopper 450. According to a modification, the upper face 451 may be a flat face without formation of the stepped face 451*a*. The position of engagement of the pad-side stopper 455 with the arm-side stopper 450 may be adjusted by adjusting the position of the pad-side stopper 455 relative to the polishing solution supply device 41-1 (shaft 454) with omission of the stepped face 451*a* or in combination with the stepped face 451*a*. According to another modification, in place of or in combination with these adjusting methods, a shim (not shown) may be placed between the arm 60 and the arm-side stopper 450, and the position of engagement of the arm-side stopper 450 with the pad-side stopper 455 may be adjusted by changing the height of the shim.

(Following Mechanism)

As shown in FIG. 26 and FIG. 28, the following mechanism 45 includes a housing-type spherical joint assembly 460 fixed to the arm-side stopper 450, retainer-stoppers 463 (corresponding to the "second stoppers") provided on respective sides of the spherical joint assembly 460, and rods 465 provided on the respective sides of the spherical joint assembly 460 to connect the spherical joint assembly 460 with the polishing solution supply device 41-1 such as to allow for relative motions thereof. According to the embodiment, the spherical joint assembly 460 (more specifically, spherical joints 461*b*) is placed between the respective rods 465 and is fixed to the arm 60 via the arm-side stopper 450. According to the embodiment, the spherical joint assembly 460 is placed at the center in the longitudinal direction of the polishing solution supply device 41-1 (more specifically, the spherical joints 461*b* are placed in the vicinity of the center in the longitudinal direction and at positions symmetric with respect to the center). The respective rods 465 have an identical length and are configured to be movable in a plane approximately perpendicular to the polishing surface 102. This configuration enables the respective rods 465 to be symmetrically arranged and to slide symmetrically in the longitudinal direction of the polishing solution supply device 41-1 and suppresses inclination of the polishing solution supply device 41-1 in the longitudinal direction. According to another embodiment, the respective rods 465 may be configured to be movable in a plane different from the plane approximately perpendicular to the polishing surface 102. According to another embodiment, the respective rods 465 may be configured to have different lengths. The spherical joint assembly 460 and/or the retainer-stoppers 463 may be divided corresponding to the respective rods 465. For example, each of the spherical joints 461*b* may be provided in an individual plate-like member fixed to the arm 60 via the arm-side stopper 450, in place of a housing 461*a*. The arm-side stopper 450, the spherical joint assembly 460, and the retainer-stoppers 463 may be formed as separate members and may be fixed to each other by any means such as screwing or adhesion. Part or the entirety of the arm-side stopper 450, the spherical joint assembly 460, and the retainer-stoppers 463 may be formed integrally.

The following mechanism 45 provides a structure serving to enable a bottom face of a pad body 410 of the polishing solution supply device 41-1 (shown in FIG. 29) to follow a time change in unevenness of the polishing pad 100 that is in contact with the pad body 410 (including a time change in unevenness caused by rotation of the polishing pad and a time change in unevenness caused by abrasion), while keeping the entire bottom face of the pad body 410 horizontal (i.e., while keeping the bottom face horizontal as a whole). In the illustrated example of FIG. 26 and FIG. 28, the spherical joint assembly 460 is fixed to the arm-side stopper 450 on an upstream side in rotation of the polishing table 20. When the polishing solution supply member 41 is in contact with the polishing pad 100, a rotational moment is applied to the polishing solution supply member 41 by friction against the polishing pad 100. The polishing solution supply member 41 is thus likely to be inclined about its upstream side end in rotation as the supporting point. Placing the spherical joint assembly 460 at this position of the supporting point suppresses inclination of the polishing solution supply device 41-1.

The spherical joint assembly 460 includes the housing 461*a* and the spherical joints 461*b* mounted to respective side faces of the housing 461*a* by screwing or by any other fixing means. The spherical joint 461*b* includes a spherical body having a bearing (through hole) which a shaft passes through, and a main body configured to hold the spherical body in a rotatable manner. This configuration enables the shaft (rod 465) to be slidable through the spherical joint 461*b* with changing the inclination of the shaft. The housing 461*a* has inner spaces provided to receive respective one ends of the respective rods 465 (in this example, also called leading ends/second ends). The respective inner spaces provided to receive the respective rods 465 may be formed separately from each other or may be formed to communicate with each other. The one end of each rod 465 is passed through the bearing of the spherical joint 461*b* to be inserted into the inner space of the housing 461*a* and is arranged to be slidable in the bearing of the spherical joint 461*b*. This configuration enables each rod 465 to be slid by the spherical joint 461*b* with changing the angle to the polishing surface 102, when the spherical joint assembly 460 is lifted up or lowered relative to the polishing solution supply device 41-1. Each rod 465 can thus follow the vertical motions of the arm 60.

The other end of the rod 465 (in this example, also called a base end/a first end) is connected with a rod end 466 having a spherical joint 466*a* (shown in FIG. 28) by screwing, by pressure clamping or the like. The rod end 466 includes a cylindrical portion having one end connected with the rod 465 and a substantially flat mounting portion provided on the other end of the cylindrical portion. This mounting portion is provided with a spherical joint 466*a*. A spherical body having a bearing (through hole) which a shaft (a shaft 467 in this example) passes through is mounted in a rotatable manner to the spherical joint 466*a*. The shaft 467 is passed through the bearing of the spherical joint 466*a* of the rod end 466 and is fixed to a mounting surface of a mounting portion 435 of a bracket 434. This configuration causes the rods 465 to be fixed to the polishing solution supply device 41-1 via the spherical joints 466*a*. The respective mounting surfaces of the mounting portions 435 are inclined to rise from outside toward inside in the longitudinal direction of the polishing solution supply device 41-1. The brackets 434 are fixed to the cover 430 of the polishing solution supply device 41-1 by screwing, by adhesion or by any other fixing means. A washer may be placed between the rod end 466 and the mounting surface of the mounting portion 435 of the bracket 434, in order to suppress backlash of the spherical joint 461*b*. The rod end 466 is configured to change the inclination to the polishing surface 102 by the spherical joint 466*a* in the course of lifting up or lowering the spherical joint assembly 460. Changing the inclination of the rod end 466 changes the inclination of the rod 465. When the spherical joint assembly 460 is lifted up or lowered, the respective rods 465 slide the spherical joints 461*b* by their leading end sides, with changing their inclinations by the spherical joints 461*b* and 466*a* placed on the respective ends of the rods 465. This causes the respective rods 465 to follow the motion of the spherical joint assembly 460 (the arm 60) in the vertical direction. It may be regarded that the rod 465 and the rod end 466 collectively form a rod and that the rod has the rod end 466.

The retainer-stoppers 463 are provided via arms 462 extended to respective sides in the longitudinal direction of the polishing solution supply device 41-1 in a lower portion of the spherical joint assembly 460. The retainer-stopper 463 has a groove 464 provided to receive a middle portion of each rod 465 (a portion between the rod end 466 and the spherical joint 461*b*). The retainer-stopper 463 has side walls on the respective sides of the groove 464 to suppress/prevent each rod 465 from moving in a lateral direction (falling down toward the polishing solution supply device 41-1 side or toward its opposite side). The groove 464 has a bottom face configured to support each rod 465 upward. This configuration causes the respective rods 465 to be engaged with the retainer-stoppers 463 at positions of an identical height symmetric with respect to the spherical joint assembly 460 and thereby suppresses/prevents inclination of the polishing solution supply device 41-1 in a width direction. The retainer-stoppers 463 (the grooves 464) are configured to receive the load of the polishing solution supply device 41-1, when the polishing solution supply device 41-1 is lifted up by the arm 60.

The rod ends 466 of the respective rods 465 are fixed to a lower portion (vicinity of a bottom face) of the polishing solution supply device 41-1, and/or the arm 60 (the following mechanism 45) is arranged such as to pull the polishing solution supply device 41-1 relative to the rotating direction of the polishing table 20. This configuration reduces the influence of bending moment on the polishing solution supply device 41-1 caused by a friction torque generated by rotation of the polishing table 20.

As shown in FIG. 28, the polishing solution supply device 41-1 is fixed to the arm 60 via the spherical joint assembly 460, the rods 465 and the rod ends 466 to have its inclination changeable and is placed on a downstream side of the fixing location with the arm 60. In other words, the arm 60 supports the polishing solution supply device 41-1 such as to pull the polishing solution supply device 41-1 relative to the flow (the rotating direction of the polishing pad 100). This configuration reduces the influence of bending moment on the polishing solution supply device 41-1 caused by rotation of the polishing table 20. Furthermore, the arm 60 supports the polishing solution supply device 41-1 such as to pull the polishing solution supply device 41-1 relative to the flow (the rotating direction of the polishing pad 100). This configuration reduces the vibration caused by thrust of the polishing solution supply device 41-1 into the arm 60 by the rotation of the polishing pad 100 (the polishing table 20).

When the spherical joint assembly 460 is lifted up with a lift-up motion of the arm 60, the respective rods 465 slide the spherical joint assembly 460 (the spherical joints 461*b*) by their leading end sides, while changing their angles to come close to a direction vertical to the polishing surface 102. When the spherical joint assembly 460 is lowered with a lowering motion of the arm 60, the respective rods 465 slide the spherical joint assembly 460 (the spherical joints 461*b*) by their leading end sides, while changing their angles to come close to a direction horizontal to the polishing surface 102. In such states, the middle portions of the respective rods 465 are supported in the grooves 464 of the retainer-stoppers 463 and change their angles to the polishing surface 102. This suppresses/prevents the inclination of the polishing solution supply device 41-1 in the width direction. When the arm 60 is lifted up and the arm-side stopper 450 (the stepped face 451*a*) is engaged with the pad-side stopper 455, this fixes the distances between the polishing solution supply device 41-1 and the arm-side stopper 450 and also fixes the positions of the spherical joint assembly 460 and the retainer-stoppers 463 relative to the polishing solution supply device 41-1. Furthermore, fixing the distance between the polishing solution supply device 41-1 and the arm-side stopper 450 fixes the positions of the respective rods 465 as well as the positions of the spherical joint assembly 460 and the retainer-stoppers 463 relative to the polishing solution supply device 41-1. When the arm 60 is further lifted up, the polishing solution supply device 41-1 is lifted up together with the arm 60 in the state that the pad-side stopper 455 is locked by the arm-side stopper 450 (the stepped face 451*a*) and that the respective rods 465 are locked by the retainer-stoppers 463. In this state, the polishing solution supply device 41-1 is locked simultaneously by the pad-side stopper 455 and the two retainer-stoppers 463 and is thus lifted up in a stable attitude. Additionally, the retainer-stoppers 463 serve to fix the respective rods 465 and to suppress/prevent the inclination of the polishing solution supply device 41-1 in the width direction. This further enables the polishing solution supply device 41-1 to be lifted up in a stable attitude. When the pad-side stopper 455 is released from the arm-side stopper 450, on the contrary, the weights placed inside of the polishing solution supply device 41-1 cause the polishing solution supply device 41-1 to come into contact with the polishing surface 102 evenly (to follow the unevenness of the polishing surface 102). The respective rods 465 slide along with the move of the polishing solution supply device 41-1 and thereby enable the polishing solution supply device 41-1 to follow the unevenness of the polishing surface 102 while maintaining the horizontal attitude.

(Polishing Solution Supply Device)

Figure 30:
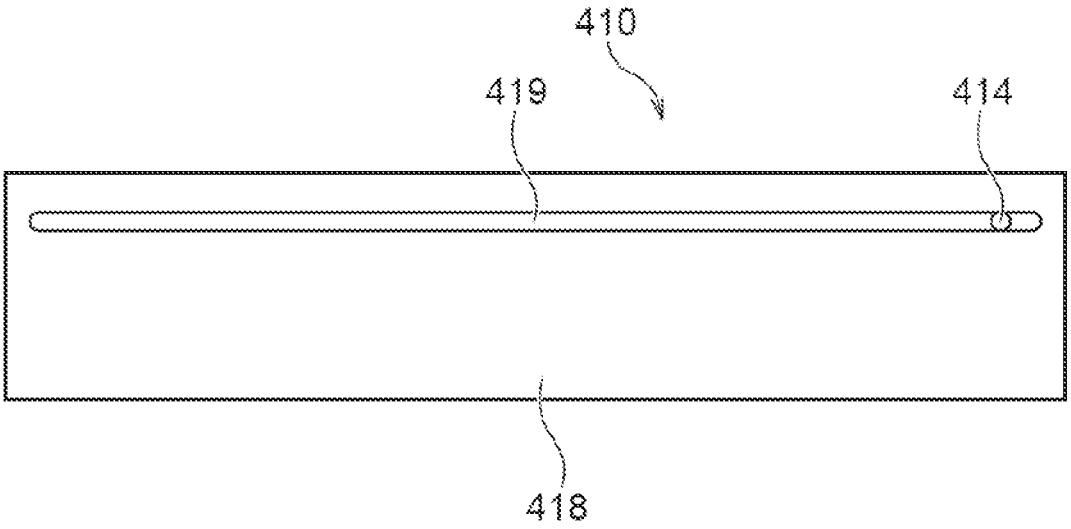
FIG. 30 is a perspective view illustrating a pad body of the polishing solution supply device viewed from a bottom face side thereof.

FIG. 29 is an exploded perspective view illustrating the polishing solution supply device 41-1. FIG. 30 is a perspective view illustrating the pad body 410 of the polishing solution supply device 41-1 viewed from its bottom face side.

As shown in FIG. 29, the polishing solution supply device 41-1 includes the pad body 410, a plurality of weights 423, the cover 430, and a packing 422. The pad body 410 and the cover 430 are made of a resin. The pad body 410 is made of, for example, a rigid plastic such as PPS or PEEK. The pad body 410 is formed, for example, as a plate-like member. As shown in FIG. 30, a slit 419 is formed in a bottom face 418 of the pad body 410 to supply the slurry onto the polishing surface 102. The slit 419 is provided with a supply port 414 formed on a bottom face thereof to supply the slurry into the slit 419. The slurry supplied from the supply port 414 is spread in the slit 419 and is further pressed and spread through a clearance between the bottom face 418 of the pad body 410 and the polishing pad 100 onto the polishing pad 100. Any number of the supply ports 414 may be provided in the slit 419 at any positions in a slit longitudinal direction according to the specification of the apparatus and the like. As shown in FIG. 29, the supply port 414 is extended to an upper face of the pad body 410 to be open to the upper face. The supply port 414 is chamfered on the upper face side of the pad body 410 to receive the slurry supply line 120 such as a tube (shown in FIG. 28) and/or an O-ring 421. Any seal other than the O-ring 421 may be employed for the purpose of sealing. In the example of FIG. 30, the shape of the pad body 410 is not limited to a rectangular shape but may be any shape having long and short lengths in two different directions (for example, two directions orthogonal to each other). For example, the pad body 410 may be formed in a polygonal shape other than the rectangular shape (for example, a triangular shape or a pentagonal shape) or in a shape at least partly having a curve. The slit 419 may have an opening end on both or one of the respective ends in the longitudinal direction (i.e., the slit 419 may be extended to short sides of the polishing solution supply device 41-1 to be open to the short sides). The pad body 410 may have a groove other than the slurry supply port 414 and the slit 419.

The respective weights 423 may be mounted to the pad body 410 by screwing, by adhesion, by welding or by any other fixing means. Each of the weights 423 and the pad body 410 may be provided with a structure for positioning (for example, a pin and a pin hole). The cover 430 may be mounted to the pad body 410 by screwing, by adhesion, by welding or by any other fixing means. The cover 430 is mounted to the pad body 410 such as to cover the weights 423 placed on the pad body 410.

The material used for the weights 423 may be a metal material such as SUS, and the surface of the weights 423 may be coated with a fluororesin or the like. In this illustrated example, the weights 423 are mounted to the pad body 410 directly without using any other layer. An adhesive layer or an elastic layer may be placed between the pad body 410 and the weights 423 according to the fixation technique employed. The weight 423 placed on one end is provided with a through hole 424 that penetrates from an upper face to a lower face thereof, and the slurry supply line 120 such as a tube (shown in FIG. 28) is inserted into the through hole 424. The slurry supply line 120 is passed through the through hole 424 of the weight 423 and is inserted through the O-ring 421 into the supply port 414 of the pad body 410. Tightly fixing the weights 423 to the pad body 410 in this state crushes the O-ring 421 to seal the connecting location of the slurry supply line with the supply port 414 and to enhance the air tightness. The slurry supply line 120 is also passed through the through hole 431 of the cover 430.

The cover 430 is mounted to cover the pad body 410 and the plurality of weights 423. The packing 422 is placed on the pad body 410 to surround the weights 423 on the pad body 410. The packing 422 is mounted to the circumference of an upper face of the pad body 410 by, for example, a double-sided tape. The fixation of the packing 422 is not limited to using the double-sided tape but may be performed by adhesion or by any other fixing means. The packing 422 may be made of a soft resin (for example, PTFE), a rubber (for example, EPDM) or the like. In the course of mounting the cover 430 to the pad body 410, an upper face of the packing 422 is brought into contact with a shoulder portion (not shown) provided in an inner wall of the cover 430 to be crushed by a predetermined thickness. This enhances the air tightness by the cover 430. As a result, the packing 422 seals between the cover 430 and the pad body 410 and suppresses/prevents the slurry, the polishing residue and the like from entering inside of the cover 430.

As shown in FIG. 28, the polishing solution supply device 41-1 further includes the two brackets 434 mounted to the respective ends of the cover 430 in the longitudinal direction. At least one of the brackets 434 may be formed integrally with the cover 430. Each of the bracket 434 has an approximately L shape and is mounted to an upper face and an upstream side face of the cover 430. The mounting portion 435 is integrally provided with a lower portion of a part of the bracket 434 placed on the upstream side face of the cover 430 and is configured to mount the rod end 466 of the following mechanism 45. A passage 444 is provided on a lower face of the mounting portion 435 to discharge the used slurry that hits against the upstream side face of the cover 430. The passage 444 is formed to pass through the mounting portion 435 along a longitudinal direction of the cover 430. A mounting surface is provided on an upper face of the mounting portion 435 to mount the rod end 466. The mounting surface of the mounting portion 435 is formed as an inclined plane sloping down from inside toward outside in the longitudinal direction of the cover 430. The mounting surface of the mounting portion 435 has a fitting hole or a threaded hole to fix a leading end of the shaft 467 for mounting the rod end 466. The mounting surface of the mounting portion 435 placed nearer to the polishing surface 102 more effectively suppresses the inclination and the vibration of the polishing solution supply device 41-1 caused by a friction torque during polishing.

(Description of Suspending/Following Operations)

Figure 31A:
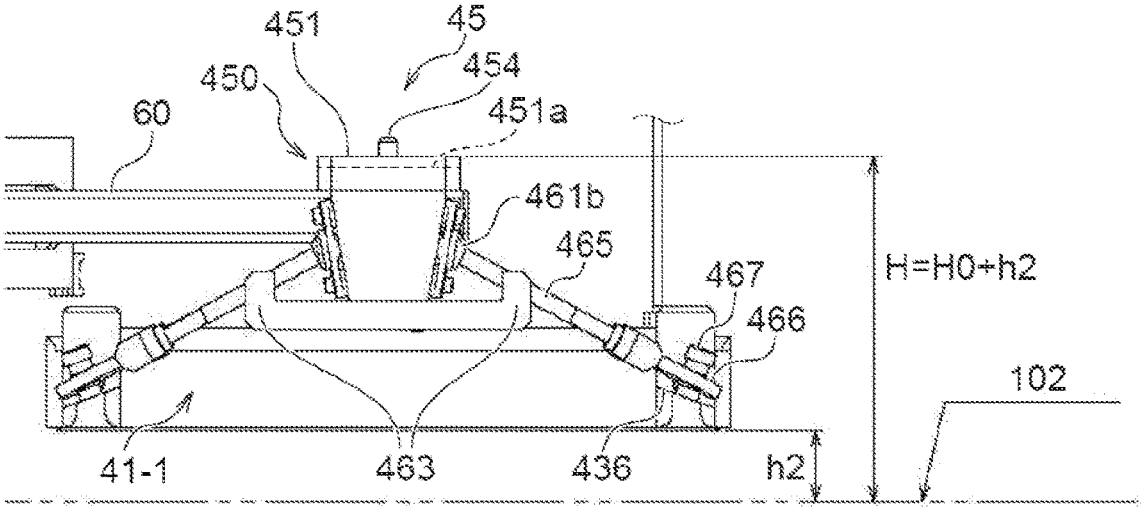
FIG. 31A is a diagram illustrating the operations of a following mechanism and a suspending mechanism viewed from an upstream side thereof.
Figure 31B:
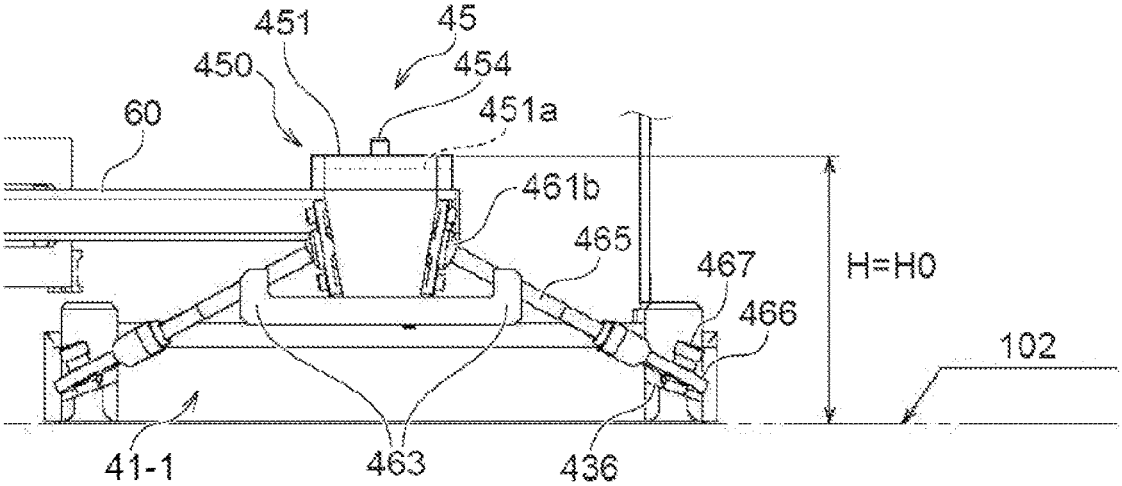
FIG. 31B is a diagram illustrating the operations of the following mechanism and the suspending mechanism viewed from the upstream side thereof.
Figure 31C:
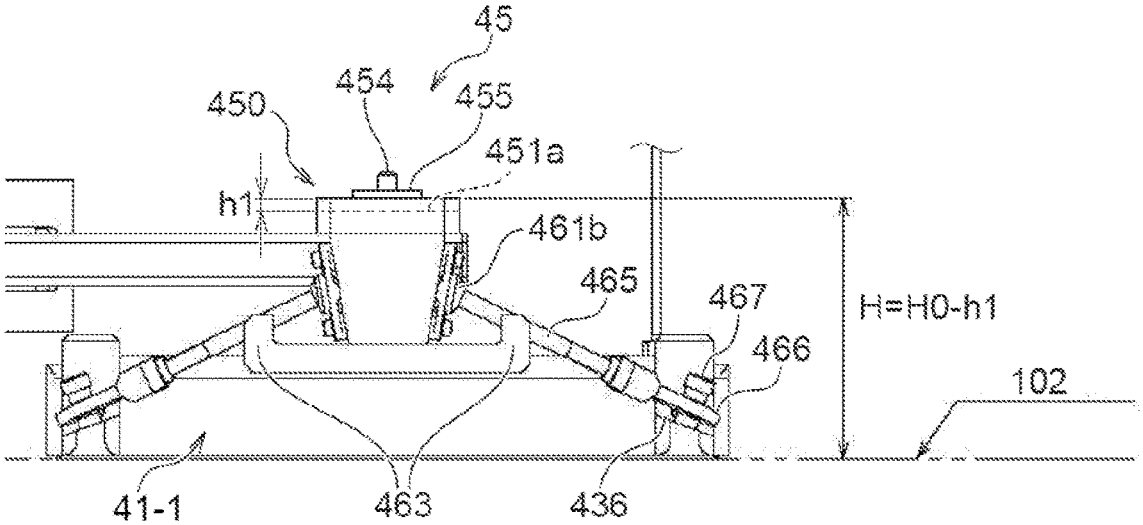
FIG. 31C is a diagram illustrating the operations of the following mechanism and the suspending mechanism viewed from the upstream side thereof.
Figure 32A:
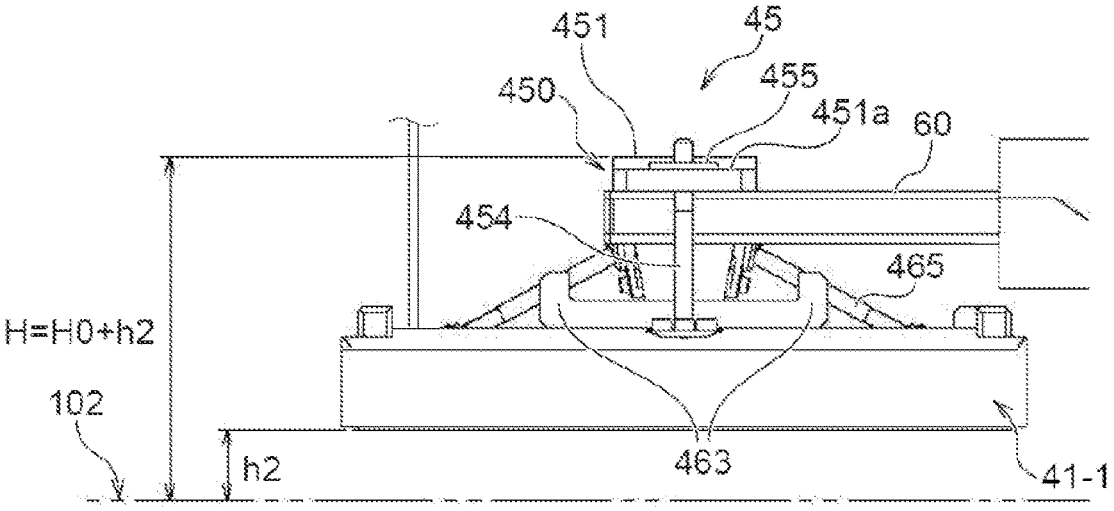
FIG. 32A is a diagram illustrating the operations of the following mechanism and the suspending mechanism viewed from a downstream side thereof.
Figure 32B:
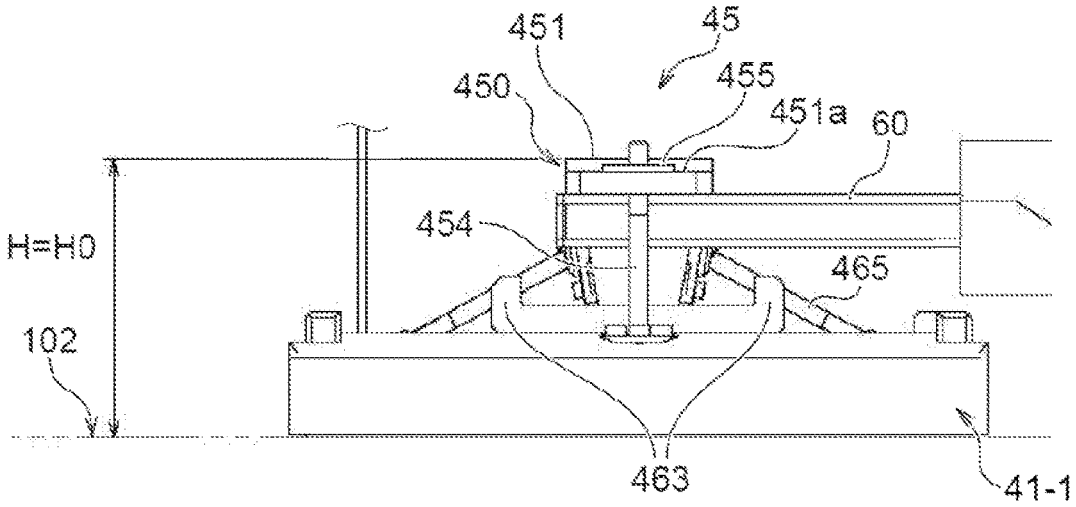
FIG. 32B is a diagram illustrating the operations of the following mechanism and the suspending mechanism viewed from the downstream side thereof.
Figure 32C:
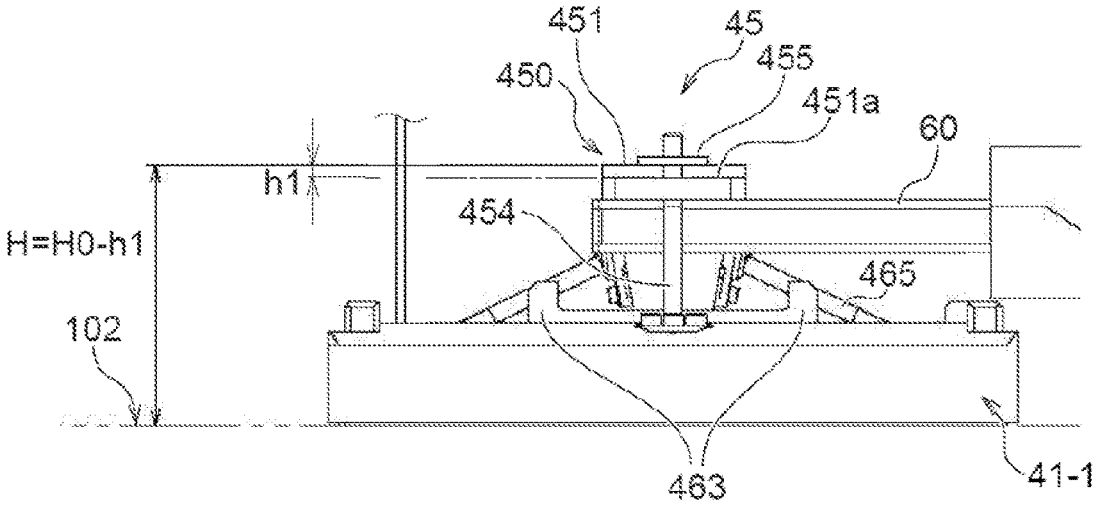
FIG. 32C is a diagram illustrating the operations of the following mechanism and the suspending mechanism viewed from the downstream side thereof.

FIGS. 31A to 31C and FIGS. 32A to 32C are diagrams illustrating the operations of the following mechanism and the suspending mechanism. FIGS. 31A to 31C are side views illustrating the vicinity of the polishing solution supply device 41-1 from an upstream side (slurry discharge side). FIGS. 32A to 32C are side views illustrating the vicinity of the polishing solution supply device 41-1 from a downstream side (slurry supply side).

FIG. 31A and FIG. 32A illustrate the state that the arm 60 and the following mechanism 45/the suspending mechanism 46 suspend the polishing solution supply device 41-1 at a height h2 (a height to the lower face of the polishing solution supply device 41-1 relative to the polishing surface 102 as a reference plane). In this state, the upper face 451 of the arm-side stopper 450 (i.e., the portion other than the stepped face 451*a*) has a height of H=H0+h2. At this time, the stepped face 451*a* of the arm-side stopper 450 is engaged with the pad-side stopper 455. The respective rods 465 are supported upward by the retainer-stoppers 463. This suppresses/prevents the inclination of the polishing solution supply device 41-1 in the width direction. The suspending mechanism 46 (the arm-side stopper 450 and the pad-side stopper 455) also serves to suppress/prevent the inclination of the polishing solution supply device 41-1 in the width direction.

FIG. 31B and FIG. 32B illustrate that state that arm 60 is lowered by the height h2 from the state of FIG. 31A and FIG. 32A and that the arm 60 and the following mechanism 45/the suspending mechanism 46 land the polishing solution supply device 41-1 on the polishing surface 102. At this time, the stepped face 451*a* of the arm-side stopper 450 is still engaged with the pad-side stopper 455. In this state, the polishing solution supply device 41-1 is held by the arm 60 and is not allowed to be further lowered independently of the position of the arm 60. In this state, the polishing solution supply device 41-1 has a height of 0, and the upper face 451 of the arm-side stopper 450 has a height of H=H0. The respective rods 465 are supported upward by the retainer-stoppers 463. This suppresses/prevents the inclination of the polishing solution supply device 41-1 in the width direction. The suspending mechanism 46 (the arm-side stopper 450 and the pad-side stopper 455) also serves to suppress/prevent the inclination of the polishing solution supply device 41-1 in the width direction.

FIG. 31C and FIG. 32C illustrate the state that the arm 60 is further lowered by a height h1 (<h2) from the state of FIG. 31B and FIG. 32B and that the polishing process is performed with supplying the slurry from the polishing solution supply device 41-1 onto the polishing surface 102. The upper face 451 of the arm-side stopper 450 has a height of H=H0−h1. In this state, the polishing solution supply device 41-1 lands on the polishing surface 102. Accordingly, while the height of the pad-side stopper 455 from the polishing surface 102 is not changed, only the arm-side stopper 450 (the stepped face 451*a*) is lowered to be separated from the pad-side stopper 455. In this state, the pad-side stopper 455 is released from the arm-side stopper 450 (the stepped face 451*a*), and the polishing solution supply device 41-1 is brought into contact with the polishing surface 102 by the load of the plurality of weights 423 in the state released from the arm 60 (independently of the position of the arm 60). This enables the pad body 410 to be bent corresponding to the unevenness of the polishing surface 102 by the plurality of weights 423 arrayed in the longitudinal direction of the polishing solution supply device 41-1.

In the event of abrasion of the polishing surface 102, the polishing solution supply device 41-1 and the pad-side stopper 455 follow the downward motion of the polishing surface 102 to be lowered from the state of FIGS. 31C and 32C, whereas the anm 60 and the arm-side stopper 450 (the stepped face 451*a*) are not lowered but are kept at the height. Accordingly, the pad-side stopper 455 tends to lower and become close to the stepped face 451*a* of the arm-side stopper 450. In this case, h1 (a distance by which the arm 60 is further lowered from the position where the polishing solution supply device 41-1 is landed (i.e., a distance by which the pad-side stopper 455 and the arm-side stopper 450 are separated from each other)) is to be set larger than an amount corresponding to the abrasion of the polishing surface 102. Even when the pad-side stopper 455 follows the abrasion of the polishing surface 102 to be lowered, this setting does not bring the pad-side stopper 455 into contact with the arm-side stopper 450 (the stepped face 451*a*) but keeps the polishing solution supply device 41-1 in the state released from the arm 60. This enables the bottom face 418 of the pad body 410 to follow the abrasion and the unevenness of the polishing surface 102 by the load of the weights 423 placed in the polishing solution supply device 41-1.

In this example, the stroke of the vertical motion of the arm 60 by the lifting mechanism 80 (the lift cylinder 81) is h1+h2. By this stroke, the lifting mechanism 80 lifts up the arm 60 and thereby lifts up the polishing solution supply device 41-1 from the polishing surface 102 to the height of h2 (as shown in FIG. 31A and FIG. 32A). The lifting mechanism 80 also lowers the arm 60 by the height h2 and thereby lands the polishing solution supply device 41-1 on the polishing surface 102 (as shown in FIG. 31B and FIG. 32B). The lifting mechanism 80 further lowers the arm 60 by the height h1 in the state that the polishing solution supply device 41-1 lands on the polishing surface 102, and thereby releases the polishing solution supply device 41-1 from the arm 60 (as shown in FIG. 31C and FIG. 32C).

The foregoing describes the series of operations to land the polishing solution supply device 41-1 on the polishing surface 102 and to release the polishing solution supply device 41-1 from the arm 60. The following describes the case where the polishing process is terminated and the polishing solution supply device 41-1 is retreated to outside of the polishing table 20. After the polishing process is terminated in the state of FIG. 31C and FIG. 32C, the arm 60 is lifted up. At this time, the stepped face 451*a* of the arm-side stopper 450 is separated from the pad-side stopper 455. Accordingly, until the stepped face 451*a* of the arm-side stopper 450 comes into contact with the pad-side stopper 455, neither the polishing solution supply device 41-1 nor the pad-side stopper 455 changes the height, while only the arm 60 and the stepped face 451*a* of the arm-side stopper 450 are lifted up. When the stepped face 451*a* of the arm-side stopper 450 is lifted up by the height of h1, the stepped face 451*a* comes into contact with the pad-side stopper 455. This is the state of FIG. 31B and FIG. 32B. When the arm 60 and the stepped face 451*a* of the arm-side stopper 450 are further lifted up from this state, the stepped face 451*a* of the arm-side stopper 450 is lifted up together with the pad-side stopper 455, and the polishing solution supply device 41-1 follows the upward motion of the arm 60 to be lifted up. The arm 60 is further lifted up by the height of h2 from the state of FIG. 31B and FIG. 32B to reach the state of FIG. 31A and FIG. 32A.

In the state of FIG. 31A and FIG. 32A, the arm 60 is turned by the turning mechanism 90 to retreat the polishing solution supply device 41-1 to the retreat position outside of the polishing table 20. At the retreat position outside of the polishing table 20, the polishing solution supply device 41-1 may be cleaned by using the cleaning nozzle 300-1 (shown in FIG. 24). This cleaning process cleans the bottom face of the pad body 410, the outer surface of the cover 430, and the arm 60. This washes away the slurry, the polishing residue and the like adhering to the polishing solution supply device 41-1. The polishing solution supply device 41-1 may be turned and moved by the arm 60 to be placed at a desired position on the polishing surface 102. This enables the position of the polishing solution supply device 41-1 to be readily adjusted on the polishing surface 102.

The configuration of the embodiment described above enables the polishing solution supply device 41-1 to be suspended and held by the following mechanism 45 and the suspending mechanism 46. This facilitates maintenance of the polishing solution supply device 41-1 and/or the polishing apparatus 1. More specifically, the configuration of the embodiment enables the weight pressure-type polishing solution supply device 41-1 to be suspended and held by the following mechanism 45 and the suspending mechanism 46. The configuration also cancels the suspension and enables the polishing solution supply device 41-1 to be brought into contact with the polishing surface 102 by the load of the weights 423. Furthermore, the polishing solution supply device 41-1 is suspended and held in the state that the two stoppers (the arm-side stopper 450 and the pad-side stopper 455, the retainer-stoppers 463 and the rods 465) are engaged with each other. This configuration enables the polishing solution supply device 41-1 to be lifted up and held in a stable attitude.

The configuration of the embodiment described above enables the weight pressure-type polishing solution supply device 41-1 to be retreated to the retreat position outside of the polishing table 20 and to be cleaned by using the cleaning nozzle 300-1. This configuration suppresses/prevents the slurry and the like adhering to the polishing solution supply device 41-1 from being fixed and dropping onto the polishing surface 102 to affect the polishing process. Moreover, this configuration enables the cleaning solution supply device 41-1 to be cleaned with suppressing/preventing the slurry, the polishing residue and the like washed away during the cleaning process from remaining on the polishing surface 102 of the polishing pad 100.

The configuration of the embodiment described above enables the polishing solution supply device 41-1 to be released from the vertical motions of the arm 60 by the following mechanism 45 and the suspending mechanism 46. This enables the polishing solution supply device 41-1 to supply the slurry to the polishing surface 102 in the state that the polishing solution supply device 41-1 is brought into contact with the polishing surface 102 by the load of the weights. Furthermore, the structure of the plurality of weights 423 enables the polishing solution supply device 41-1 to be flexibly bent along the longitudinal direction and to effectively follow the unevenness of the polishing surface 102 and/or the abrasion of the polishing surface 102.

The configuration of the embodiment described above enables the polishing solution supply device 41-1 to be moved between the supply position and the retreat position by turning the arm 60 in the state that the polishing solution supply device 41-1 is suspended by the following mechanism 45 and the suspending mechanism 46. This configuration also enables the position of the polishing solution supply device 41-1 to be readily adjusted on the polishing surface 102 by turning the polishing solution supply device 41-1. This configuration further enables the polishing solution supply device 41-1 kept landing on the polishing surface 102 to be swung during the polishing process or the like, so as to change the supply position of the slurry.

Furthermore, the retainer-stoppers 463 of the following mechanism 45 suppress' prevent the inclination of the polishing solution supply device 41-1 in the width direction. The location of fixation (the rod end 466) where the following mechanism 45 is mounted to the polishing solution supply device 41-1 is provided in the lower portion of the polishing solution supply device 41-1 (the vicinity of the bottom face). The arm 60 is arranged such as to pull the polishing solution supply device 41-1 relative to the rotating direction of the polishing pad (the polishing table). This configuration reduces the influence of bending moment on the polishing solution supply device 41-1 caused by the rotation of the polishing pad (the polishing table). Furthermore, this configuration enables the polishing solution supply device 41-1 to be suspended by the following mechanism 45 at the position of the low center of gravity and thereby stabilizes the attitude of the polishing solution supply device 41-1.

The configuration of the embodiment described above enables the suspending mechanism 46 and/or the following mechanism 45 to suppress the inclination of the polishing solution supply device 41-1 in the width direction and enables the bottom face of the polishing solution supply device 41-1 to be bent corresponding to the unevenness of the polishing surface 102 by means of the plurality of weights 423. The combination of such functions and advantageous effects enables the polishing solution supply device 41-1 to effectively follow the unevenness of the polishing surface 102 and effectively suppresses/prevents the non-uniform contact state. As a result, this ensures the stable supply of the slurry and stabilizes the polishing performance. Moreover, as described above, this configuration reduces the vibration of the polishing solution supply device 41-1 and thereby more effectively suppresses/prevents the non-uniform contact state. This further ensures the stable supply of the slurry and stabilizes the polishing performance.

Other Embodiments (1) According to the embodiment described above, the cover 430 is used to cover the pad body 410 of the polishing solution supply device 41-1 and the packing 422 is provided for the purpose of waterproof effect. According to a modification, however, in place of providing the packing 422 or in addition to providing the packing 422, a line may be connected to feed a gas into an internal space of the cover 430 and purge the internal space of the cover 430 with the gas (an inert gas such as nitrogen gas). This modified configuration also suppresses/prevents the slurry from adhering to the upper portion of the pad body 410 and/or the weights 423. According to another modification, the cover 430 and the packing 422 may be omitted, and the pad body 410 and the weights 423 may be appropriately cleaned by using the cleaning nozzle 300-1. In this modification, the pad body 410 and the weights 423 are not covered by the cover 430 and can thus be readily cleaned. According to the embodiment described above, coating the surface of the weights with a fluororesin or the like further facilitates cleaning.

(2) The above embodiment describes the configuration that the weights 423 are placed inside of the polishing solution supply device 41-1. According to a modification, the polishing process may be performed with placing weights on the polishing solution supply device 41-1 that is located on the polishing surface 102 and that is released from the vertical motions of the arm 60, by a robot hand or the like, and the polishing solution supply device 41-1 may be suspended after removal of the weights. According to another modification, an airbag may be provided on the polishing solution supply device 41-1, and the polishing solution supply device 41-1 released from the vertical motions of the arm 60 may be uniformly brought into contact with the polishing surface 102 (to follow the unevenness of the polishing surface 102) by expansion of the airbag.

Second Embodiment

Figure 33:
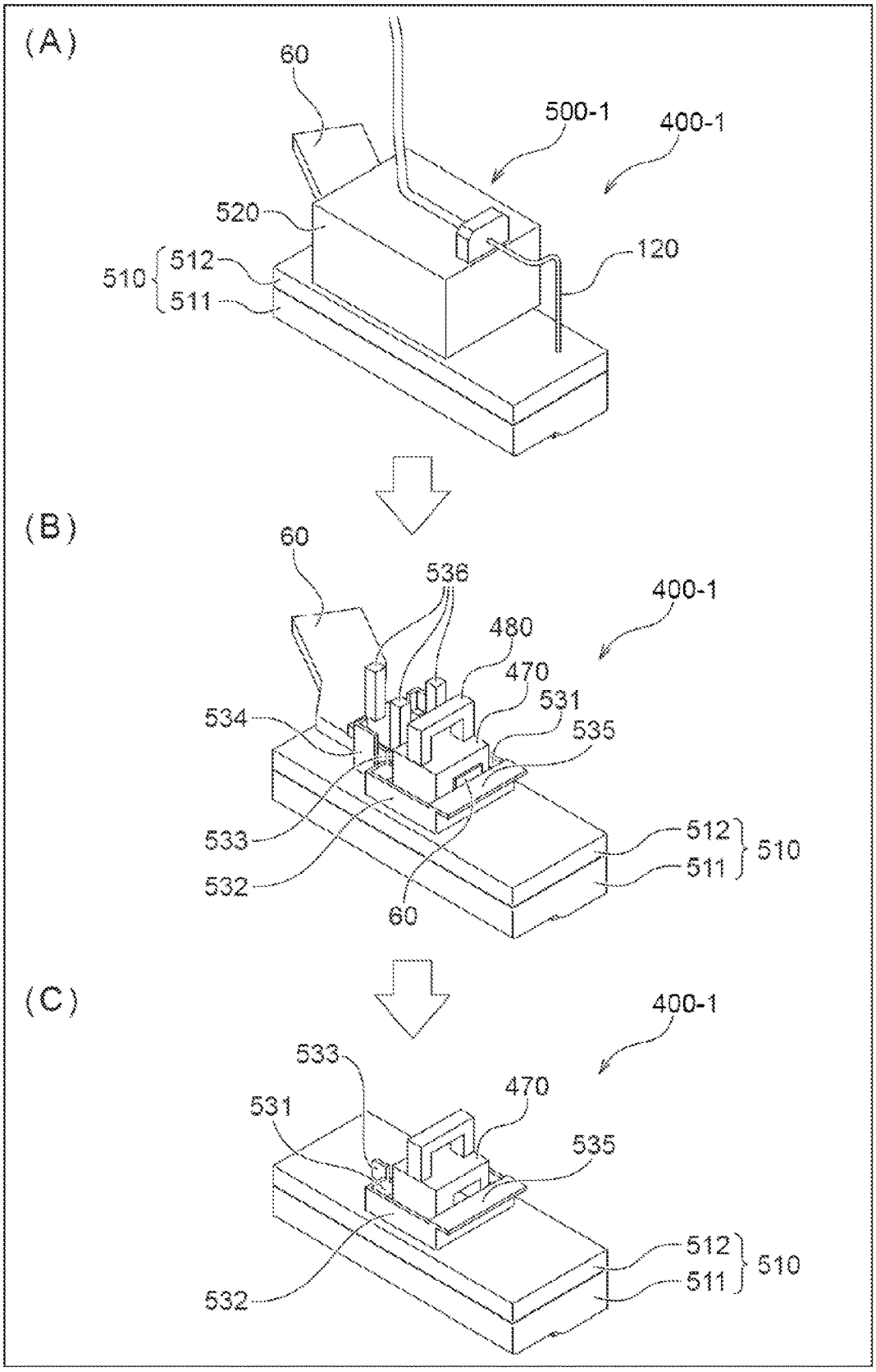
FIG. 33 is perspective views illustrating a polishing solution supply mechanism according to a second embodiment.
Figure 34:
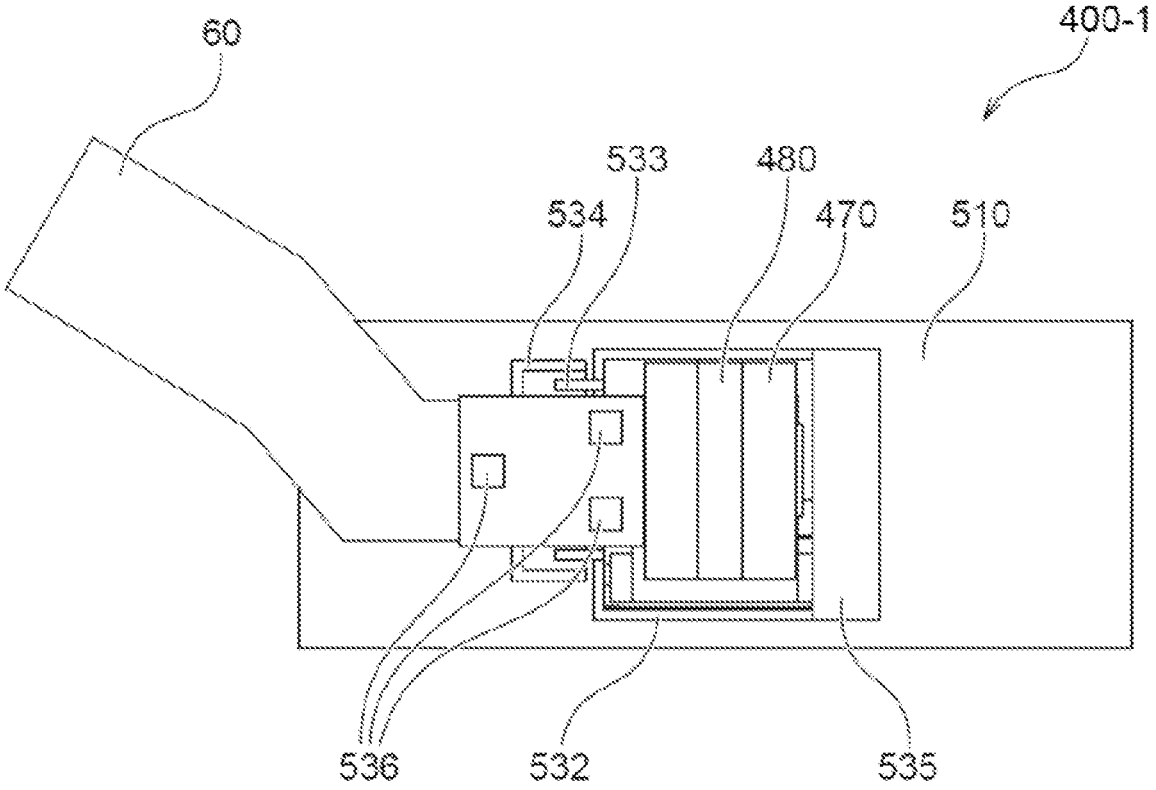
FIG. 34 is a plan view illustrating the polishing solution supply mechanism in the state of removal of an auxiliary cover.

FIG. 33 is perspective views illustrating a polishing solution supply mechanism 400-1 according to a second embodiment. FIG. 33(A) illustrates the polishing solution supply mechanism 400-1 with a main cover 510 and an auxiliary cover 520 mounted thereto. FIG. 33(B) illustrates the polishing solution supply mechanism 400-1 with removal of the auxiliary cover 520. FIG. 33(C) illustrates the polishing solution supply mechanism 400-1 with further removal of the arm 60. FIG. 34 is a plan view illustrating the polishing solution supply mechanism 400-1 with removal of the auxiliary cover 520.

This embodiment differs from the above embodiment by providing a cover 500-1 to cover the entire configuration including the polishing solution supply device 41-1 (the pad body 410 and the weights 423), the following mechanism 45 and the suspending mechanism 46, in place of the cover 430 provided to cover the pad body 410 and the weights 423 described above. The other configuration of this embodiment is, however, similar to that of the above embodiment. The following describes differences from the above embodiment. The like components to those of the above embodiment are expressed by the like reference signs and are not specifically explained. In the description hereof, the configuration including the polishing solution supply device 41-1 (the pad body 410 and the weights 423), the following mechanism 45, and the suspending mechanism 46 is referred to as the polishing solution supply mechanism 400-1. Such definitions of the polishing solution supply device and the polishing solution supply mechanism are only for the convenience of explanation in the description hereof and are not essential.

The cover 500-1 according to this embodiment includes a main cover 510 provided to cover the whole polishing solution supply mechanism 400-1 and an auxiliary cover 520 provided to cover the part of the polishing solution supply mechanism exposed on the main cover 510 (the location of connection of the polishing solution supply mechanism 400-1 with the arm 60 and its vicinity). The main cover 510 includes a lower cover 511 provided to cover a lower portion of the polishing solution supply mechanism 400-1 and an upper cover 512 provided to cover an upper portion of the polishing solution supply mechanism 400-1. The auxiliary cover 520 has a substantially rectangular parallelepiped shape with a lower opening according to the embodiment but may have any arbitrary shape with a lower opening. The auxiliary cover 520 has a smaller area than the area of an upper face of the upper cover 512 in plan view and is formed in required minimum dimensions according to the embodiment but may have an area equal to the area of the upper face of the upper cover 512. The main cover 510 has a substantially rectangular parallelepiped shape according to the embodiment but may have any arbitrary shape to cover substantially the whole polishing solution supply mechanism 400-1. The upper cover 512 has a substantially rectangular parallelepiped shape with a lower opening according to the embodiment but may have any arbitrary shape according to the shape of the lower cover 511. Through holes (not shown) which the slurry supply line 120 passes through are provided in an upper wall of the upper cover 512 (shown in FIG. 33) and in an upper wall of the lower cover 511 (shown in FIG. 35) to be connected with the pad body 410 like the first embodiment.

Figure 35:
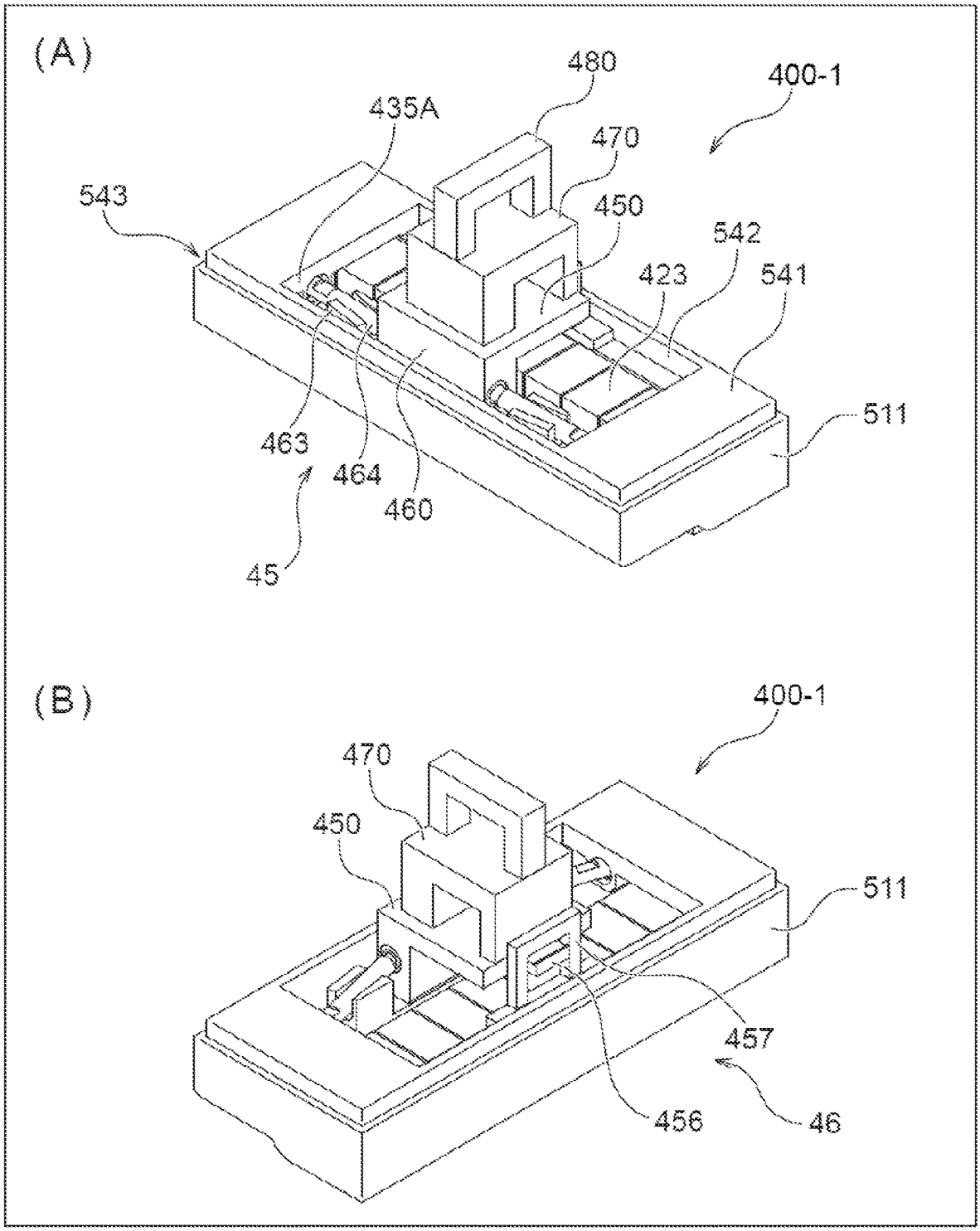
FIG. 35 is perspective views illustrating the polishing solution supply mechanism in the state of removal of the auxiliary cover and an upper cover.

An opening 531 is provided in the upper face of the upper cover 512, and a waterproof wall 532 is provided to surround the opening 531 and to be protruded from the upper face of the upper cover 512. A stepped portion or a cut which a leading end portion of the arm 60 passes through is provided on one end side of the waterproof wall 532, and two waterproof walls 533 are provided on respective sides of the stepped portion to be continuously extended from the waterproof wall 532, as shown in FIG. 33(B) and FIG. 34. The waterproof walls 533 are extended toward outside of the waterproof wall 532 along respective sides of the arm 60 with keeping clearances from the arm 60. The waterproof walls 533 are provided on the respective sides of the stepped portion to be extended from and integrally with the waterproof wall 532. The leading end portion of the arm 60 accordingly passes through between the two waterproof walls 533 and is fixed to a bracket (mounting member) 470 that forms part of the suspending mechanism 46. As shown in FIG. 35, the bracket 470 is a substantially reverse U shaped or an arch shaped member mounted to an upper face of an arm-side stopper 450. The leading end of the arm 60 is fixed to a lower face of an upper beam of the bracket 470 by screwing, by adhesion or by any other fixing means. A handle 480 is provided on an upper face of the bracket 470 to be used when the suspending mechanism 46 and the following mechanism 45 are to be demounted from the lower cover 511.

As shown in FIG. 33(B) and FIG. 34, waterproof walls 534 in a substantially U shape in plan view are mounted to respective sides of the leading end portion of the arm 60. The waterproof walls 534 are mounted to the respective side faces of the arm 60 and are provided in combination with the waterproof wall 532 to surround the leading end portion of the arm 60. The waterproof walls 534 are provided on the respective sides of the arm 60 with keeping clearances from the respective side faces of the arm 60 to be extended along the arm 60 toward the waterproof wall 532 and to be terminated with keeping clearances from the waterproof wall 532. The waterproof walls 534 on the respective sides are arranged outside of the two waterproof walls 533 such as to place the two waterproof walls 533 therebetween with keeping clearances from the two waterproof walls 533. More specifically, the waterproof walls 533 and the waterproof walls 534 overlap each other alternately and the leading ends of the waterproof walls 534 are opposed to the waterproof wall 532 across the clearances. This arrangement forms a labyrinth structure to waterproof the part of the polishing solution supply mechanism 400-1 that includes the location of connection of the arm 60 with the polishing solution supply mechanism 400-1 and that is exposed on the main cover 510.

As shown in FIG. 33(B) and FIG. 34, one or a plurality of (three in the illustrated example) support columns 536 are provided on the upper face of the arm 60. When the auxiliary cover 520 is mounted to the upper cover 512, leading end faces of these support columns 536 support an inner face of an upper wall of the auxiliary cover 520. The support column 536 has a threaded hole (not shown) provided in the leading end face to be screwed by a screw, bolt or the like passing through the upper wall of the auxiliary cover 520. A bent portion 535 is provided at an upper end of the waterproof wall 532 on the opposite side to the waterproof walls 533 to be extended in the longitudinal direction of the polishing solution supply device 41-1. When the auxiliary cover 520 is mounted to the upper cover 512, the bent portion 535 covers part of the lower opening of the auxiliary cover 520, so as to prevent the slurry from entering the opening 531.

Figure 36:
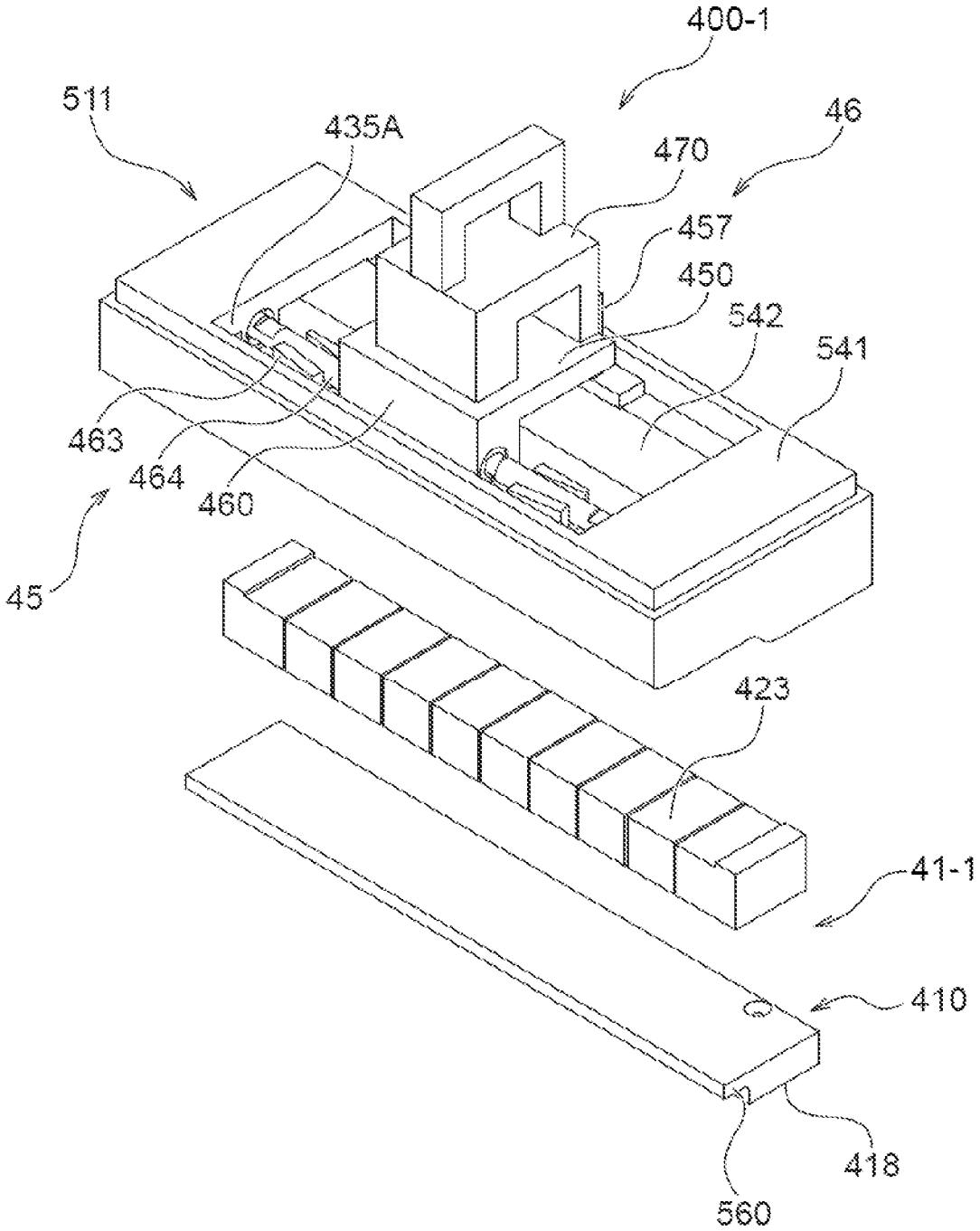
FIG. 36 is an exploded perspective view illustrating the polishing solution supply mechanism.
Figure 37:
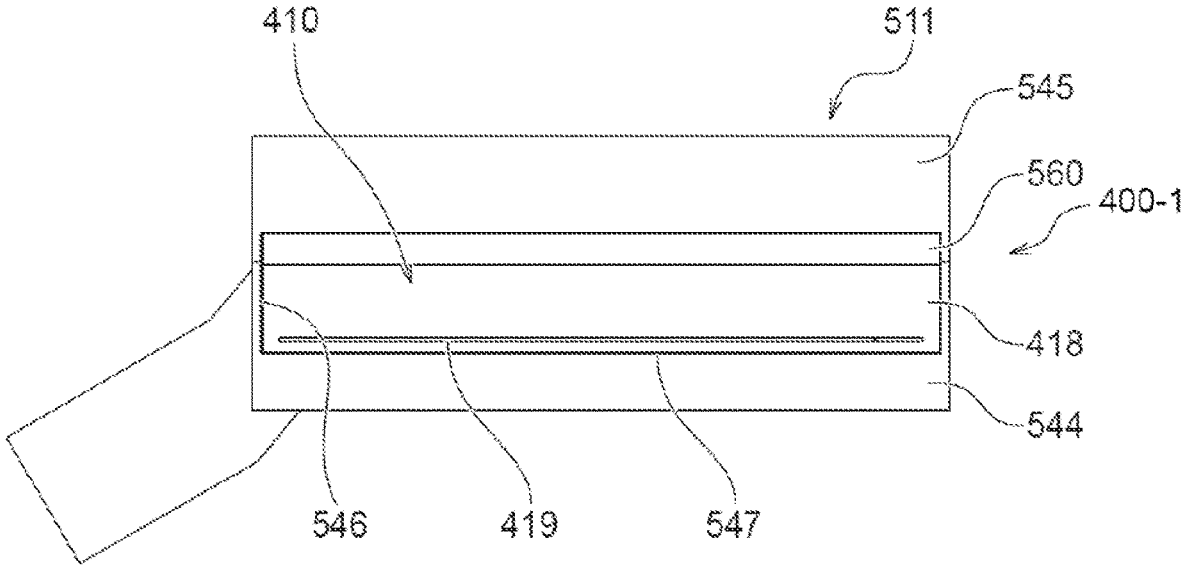
FIG. 37 is a bottom view illustrating the polishing solution supply mechanism.
Figure 38:
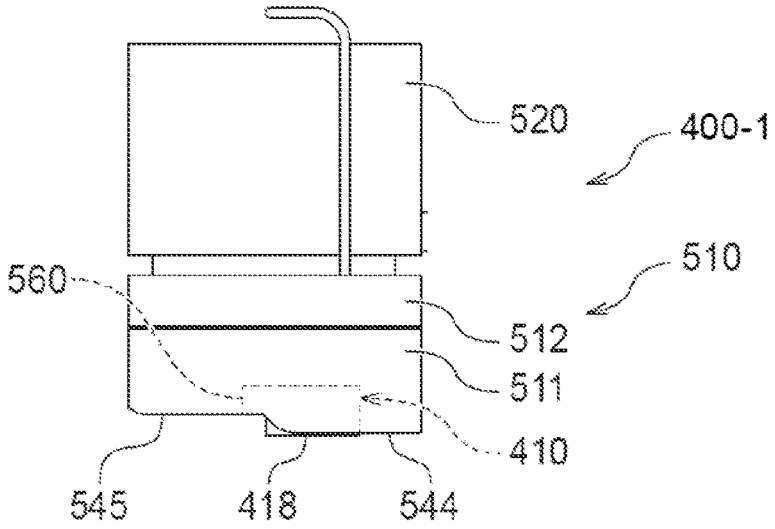
FIG. 38 is a side view illustrating the polishing solution supply mechanism viewed from a short side thereof.

FIG. 35 is perspective views illustrating the polishing solution supply mechanism 400-1 with removal of the auxiliary cover 520 and the upper cover 512. FIG. 35(A) is a perspective view of the polishing solution supply mechanism 400-1 viewed from an upstream side relative to the rotating direction of the polishing table as a criterion. FIG. 35(B) is a perspective view of the polishing solution supply mechanism 400-1 viewed from a downstream side relative to the rotating direction of the polishing table as the criterion. FIG. 36 is an exploded perspective view illustrating the polishing solution supply mechanism 400-1. FIG. 37 is a bottom view of the polishing solution supply mechanism 400-1. FIG. 38 is a side view illustrating the polishing solution supply mechanism 400-1 viewed from a short side thereof.

As shown in FIG. 35 and FIG. 36, the lower cover 511 places therein the pad body 410 and the weights 423 of the polishing solution supply device 41-1, the following mechanism 45 and the suspending mechanism 46. An opening 542 is provided in an upper wall 541 of the lower cover 511 such as to expose part or the entirety of the weights 423, the following mechanism 45 and the suspending mechanism 46. A stepped portion 543 is provided around the upper wall 541 of the lower cover 511. End faces and inner side faces of the lower opening of the upper cover 512 are fit in the stepped portion 543, so that the upper cover 512 is mounted to the lower cover 511. The pad body 410 and the weights 423 are fixed to each other by screwing, by adhesion or by any other fixing means (not shown). A resulting assembly of the pad body 410 and the weights 423 is placed inside of the lower cover 511 and is fixed to the lower cover 511 by screwing, by adhesion or by any other fixing means (not shown). For example, after the pad body 410 and the weights 423 are fixed to each other, the weights 423 are fixed to the inner side face of the upper wall 541 of the lower cover 511. This configuration causes the pad body 410, the weights 423 and the lower cover 511 to be fixed to one another and to be moved integrally. The pad body 410 is, however, placed in an opening 546 of the lower cover 511 across a clearance 547 to be deformable according to the unevenness of the polishing surface without interference with a bottom face of the lower cover 511 as described later.

An arm-side stopper 450 of the suspending mechanism 46 according to the embodiment has an engagement portion 456 protruded toward the downstream side as shown in FIG. 35(B). A pad-side stopper 457 is configured by an approximately reverse U-shaped member and is fixed to an inner face of a side wall in the longitudinal direction on a downstream side of the lower cover 511 by screwing, by adhesion or by any other fixing means. The pad-side stopper 457 is arranged to be placed inside of the main cover 510 when the upper cover 512 is mounted to the lower cover 511. The engagement portion 456 of the arm-side stopper 450 corresponds to the engagement portion (the peripheral part of the through hole 452) of the arm-side stopper 450 of the first embodiment. The pad-side stopper 457 corresponds to the pad-side stopper 455 of the first embodiment. According to the embodiment, engagement or disengagement of the engagement portion 456 with or from inside of an upper beam of the pad-side stopper 457 couples or separates (decouples) the motion of the arm 60-side with or from the motion of the polishing solution supply device 41-1-side (pad body-side). The operations of the suspending mechanism 46 are similar to those of the first embodiment.

The following mechanism 45 according to the embodiment has the configuration similar to that of the first embodiment. In this embodiment, however, a mounting portion 435A (corresponding to the mounting portion 435 shown in FIG. 28) provided to mount the rod end 466 (spherical joint 466*a*) of the rod 464 is mounted to the periphery of the opening 542 of the lower cover 511 and is placed inside of the main cover 510. In this case, the location of connection of the rod end 466 with the mounting portion 435A is placed at a low position in the polishing solution supply mechanism 400-1.

As shown in FIG. 37, the opening 546 is provided in the bottom face of the lower cover 511 to expose the bottom face 418 of the pad body 410. As shown in FIG. 38, the bottom face of the lower cover 511 includes a bottom face portion 544 placed at a lower position and a bottom face portion 545 placed at a higher position than the bottom face portion 544 by a predetermined height. As shown in FIG. 37, the opening 546 is formed across the bottom face portion 544 and the bottom face portion 545. The opening 546 is formed in slightly larger dimensions than those of the pad body 410, and a predetermined clearance 547 is provided between the outer circumference of the pad body 410 and the bottom face (the bottom face portion 544 and the bottom face portion 545) of the lower cover 511. This configuration enables the pad body 410 to be deformed without coming into contact with the lower cover 511. In other words, providing the clearance 547 between the pad body 410 and the bottom face of the lower cover 511 enables the pad body 410 to be freely deformed corresponding to the unevenness of the polishing surface without interference with the bottom face of the lower cover 511. As shown in FIG. 38, the bottom face 418 of the pad body 410 is protruded slightly by a predetermined height from the bottom face portion 544 of the lower cover 511. This configuration enables the pad body 410 to come into contact with the polishing pad 100 without bringing the lower cover 511 into contact with the polishing pad 100.

As shown in FIG. 36, the pad body 410 has a returned portion 560. The returned portion 560 is provided at a position higher than the bottom face 418 of the pad body 410 by a predetermined height and over the entire length in the longitudinal direction of the pad body 410 to be protruded toward the upstream side in the rotating direction of the polishing pad. In this illustrated example, the returned portion 560 has an upper face formed to be flush with the upper face of the pad body 410. The upper face of the returned portion 560 may, however, be formed to be lower than the upper face of the pad body 410. As shown in FIG. 38, the returned portion 560 has a lower face configured to be substantially flush with the bottom face portion 545 of the lower cover 560. The returned portion 560 provides a waterproof structure to prevent the slurry on the polishing pad 100 from entering the weights 423-side.

According to this embodiment, the whole polishing solution supply mechanism 400-1 including the polishing solution supply device 41-1, the following mechanism 45 and the suspending mechanism 46 is covered by the cover 500-1. This configuration suppresses or prevents the slurry from being splashed and adhering to the exposed respective elements (for example, the spherical joints and the stoppers) of the following mechanism and/or the suspending mechanism and thereby from affecting the functions of the respective elements (operations such as sliding operation). This configuration also suppresses or prevents the slurry adhering to the exposed respective elements from falling off onto the polishing table and thereby from affecting the substrate that is the object to be polished. Since the main cover 510 alone serves to cover the most part of the polishing solution supply mechanism 400-1, only the main cover 510 may be provided with omission of the auxiliary cover 520.

According to this embodiment, the pad body 410 is provided with the returned portion 560. Even when there is a clearance between the pad body 410 and the lower cover 511, this configuration suppresses or prevents the slurry from entering inside of the main cover 510. The pad body 410 of the first embodiment may also be provided with a similar returned portion.

According to this embodiment, providing the seal of the labyrinth structure at the location of connection of the arm 60 with the polishing solution supply mechanism 400-1 suppresses or prevents the slurry from entering inside of the main cover 510.

According to this embodiment, the configuration of providing the clearance 547 between the bottom face of the cover 500-1 (the lower cover 511) and the pad body 410 enables the pad body 410 to be freely deformed corresponding to the unevenness of the polishing surface without causing the bottom face of the cover 500-1 to interfere with the motion of the pad body 410. The contact face of the pad body 410 may be bent and may not be flat, depending on the mounting structure of the pad body 410. Providing the clearance between the cover 500-1 and the pad body 410, however, avoids such a potential problem.

At least the following aspects are provided from the embodiments described above.

According to a nineteenth aspect, there is provided a polishing apparatus configured to polish an object by using a polishing pad having a polishing surface. The polishing apparatus comprises a polishing solution supply device; an arm configured to be horizontally movable relative to the polishing surface; a lifting mechanism configured to lift up and lower the arm; a following mechanism linked with the arm and with the polishing solution supply device and configured to cause the polishing solution supply device to follow the polishing surface of the polishing pad; and a suspending mechanism linked with the arm and with the polishing solution supply device and configured to suspend the polishing solution supply device while the arm is lifted up and lowered by the lifting mechanism. The following mechanism comprises two rods wherein each of the rods has a first end and a second end and the first end of each rod is mounted to the polishing solution supply device via a first spherical joint; and two second spherical joints fixed to the arm between the two rods and configured to slidably receive the second ends of the respective rods. The suspending mechanism comprises a first stopper fixed to the polishing solution supply device; and an engagement portion fixed to the arm and engaged with the first stopper when the arm is lifted up relative to the polishing solution supply device.

In the polishing apparatus of this aspect, the following mechanism comprised of the rods and the spherical joints causes the polishing solution supply device to follow the polishing surface of the polishing pad. This configuration suppresses inclination of the polishing solution supply device and vibration of the polishing solution supply device caused by a friction torque generated between the polishing solution supply device and the polishing pad and thereby suppresses the non-uniform contact state of the polishing solution supply device with the polishing pad. This stabilizes the polishing performance.

In the polishing apparatus of this aspect, during non-operation of the stopper of the suspending mechanism, the polishing solution supply device is allowed to be placed on the polishing surface in the state that the polishing solution supply device is released from the arm holding. This allows for employment of a structure that uses a load of, for example, a weight or an airbag to bring the polishing solution supply device into contact with the polishing surface, independently of the position of the arm. This suppresses inclination and/or vibration of the polishing solution supply device during a polishing process. When the polishing solution supply device is pressed downward by a pressing mechanism such as an actuator, the polishing solution supply device is likely to have vibration caused by backlash of the actuator during rotation of a polishing table. Employing the structure that uses the load of the weight or the like to bring the polishing solution supply device into contact with the polishing surface, on the other hand, suppresses/prevents the vibration caused by the actuator. In the polishing apparatus of this aspect, the structure that uses the load of the weight or the like to bring the polishing solution supply device into contact with the polishing surface independently of the position of the arm enables a contact face of the polishing solution supply device with the polishing surface to readily follow the unevenness and/or abrasion of the polishing surface.

The configuration of this aspect also enables the polishing solution supply device to be suspended separately from the polishing surface by the lifting mechanism and suspending mechanism. This configuration accordingly moves the arm horizontally in the state that the polishing solution supply device is suspended, so as to move the polishing solution supply device to outside of a range of the polishing pad. This enables the polishing solution supply device to be cleaned outside of the range of the polishing pad. As a result, this enables the polishing solution supply device to be cleaned without causing the slurry, the polishing residue and the like washed away during cleaning to remain on the polishing surface of the polishing pad.

According to a twentieth aspect, in the polishing apparatus of the nineteenth aspect described above, one of the first stopper and the engagement portion may be a large diameter portion provided on a shaft, and the other of the first stopper and the engagement portion may be a peripheral part of a through hole or a cut which the shaft passes through. The large diameter portion may be engaged with the peripheral part of the through hole or the cut.

The configuration of this aspect readily provides the structure of connecting/disconnecting the polishing solution supply device with/from the vertical motion of the arm. The configuration of the shaft and the through hole or the cut suppresses inclination of the polishing solution supply device (especially, inclination in a width direction crossing a longitudinal direction).

According to a twenty-first aspect, in the polishing apparatus of the twentieth aspect described above, the large diameter portion of the shaft may be a ring-shaped member provided in the shaft.

The configuration of this aspect forms or mounts the ring-shaped member in or to the shaft to readily configure the first stopper/the engagement portion.

According to a twenty-second aspect, in the polishing apparatus of any one of the nineteenth to the twenty-first aspects described above, the following mechanism may comprise a housing fixed to the arm, and the second spherical joints may be provided on respective side faces of the housing.

The configuration of this aspect enables the motion of the polishing solution supply device relative to the arm to be stably guided by a spherical joint assembly (the housing and the second spherical joints) and the respective rods.

According to a twenty-third aspect, in the polishing apparatus of the twenty-second aspect described above, the following mechanism may further comprise a second stopper fixed to the housing and engaged upward with a middle portion between the first end and the second end of each of the rods.

The configuration of this aspect causes each of the rods to be supported upward by the second stopper and thereby suppresses/prevents inclination of the polishing solution supply device (especially, inclination in the width direction). This configuration also enables the load of the polishing solution supply device in the suspended state to be received by the second stopper.

According to a twenty-fourth aspect, in the polishing apparatus of the twenty-third aspect described above, the second stopper may have a groove that is engaged with the middle portion between the first end and the second end of the each rod.

The configuration of this aspect causes each of the rods to be engaged with the groove and thereby supported upward, while suppressing the motion of each rod in a lateral direction.

According to a twenty-fifth aspect, in the polishing apparatus of any one of the nineteenth to the twenty-fourth aspects described above, the first end of the each rod may be mounted to a periphery of a bottom face of the polishing solution supply device.

In the polishing apparatus of this aspect, a fixing point (supporting point) where the polishing solution supply device is linked with the arm-side is placed at a low position. This configuration reduces the influence of bending moment on the polishing solution supply device by the rotation of the polishing pad (polishing table) and thereby suppresses inclination and vibration of the polishing solution supply device caused by a friction torque during polishing.

According to a twenty-sixth aspect, in the polishing apparatus of any one of the nineteenth to the twenty-fifth aspects described above, the each rod may have a rod end at the first end, and the first spherical joint may be provided in the rod end.

In the polishing apparatus of this aspect, the spherical joint between the rod and the polishing solution supply device is readily configured by the rod end.

According to a twenty-seventh aspect, in the polishing apparatus of any one of the nineteenth to the twenty-sixth aspects described above, the polishing solution supply device may be placed on a downstream side of the arm with respect to a rotating direction of the polishing pad.

The configuration of this aspect further reduces the influence of bending moment on the polishing solution supply device by the rotation of the polishing pad (polishing table). This configuration holds the arm such as to pull the polishing solution supply device to an opposite side to the flow (rotating direction of the polishing pad). This reduces the vibration caused by thrust of the polishing solution supply device into the arm by the rotation of the polishing pad (polishing table).

According to a twenty-eighth aspect, the polishing apparatus of any one of nineteenth to the twenty-seventh aspects described above may further comprise a turning mechanism configured to turn the arm.

The configuration of this aspect enables the polishing solution supply device in the suspended state to be turned by the turning mechanism and moved to outside of the polishing pad and thereby further facilitates maintenance such as cleaning. Cleaning the polishing solution supply device enables the slurry, the polishing residue and the like adhering to the polishing solution supply device to be washed away. This enables the polishing solution supply device to be cleaned without causing the slurry, the polishing residue and the like washed away during cleaning to remain on the polishing surface of the polishing pad. This configuration also enables the position of the polishing solution supply device to be readily adjusted on the polishing surface. This configuration also enables the polishing solution supply device landing on the polishing surface during a polishing process or the like to be moved by the turning mechanism and to change the supply position of the slurry.

According to a twenty-ninth aspect, in the polishing apparatus of any one of the nineteenth to the twenty-eighth aspects described above, the polishing solution supply device may comprise a pad body; and a plurality of weights fixed to the pad body.

The configuration of this aspect enables the slurry to be supplied in the state that the pad body is brought into contact with the polishing surface by the plurality of weights. The plurality of weights enable the pad body to be flexibly bent and follow the unevenness of the polishing surface.

According to a thirtieth aspect, in the polishing apparatus of the twenty-ninth aspect described above, the polishing solution supply device may further comprise a cover configured to cover the pad body and the weights; and a packing configured to seal between the cover and the pad body.

In the polishing apparatus of this aspect, the cover protects an upper portion of the pad body and the weights from the slurry and the like (provide the waterproof effect). The packing enhances the waterproof performance inside of the cover.

According to a thirty-first aspect, the polishing apparatus of any one of the nineteenth to the twenty-ninth aspects described above may further comprise a first cover configured to cover the polishing solution supply device, the following mechanism, and the suspending mechanism.

In the polishing apparatus of this aspect, the whole polishing solution supply mechanism including the polishing solution supply device, the following mechanism and the suspending mechanism is covered by the cover. This configuration suppresses or prevents the slurry from being splashed and adhering to the exposed respective elements (for example, the weights, the spherical joints and the stoppers) of the polishing solution supply device, the following mechanism and the suspending mechanism and thereby from affecting the functions of the respective elements (operations such as sliding operation). This configuration also suppresses or prevents the slurry adhering to the exposed respective elements from falling off onto the polishing table and thereby from affecting the substrate that is the object to be polished.

According to a thirty-second aspect, in the polishing apparatus of the thirty-first aspect described above, the first cover may be configured to expose part of the polishing solution supply device, the following mechanism and/or the suspending mechanism, on an upper face of the first cover. The polishing apparatus of this aspect may further comprise a second cover configured to cover an exposed part that is exposed on the first cover.

In the polishing apparatus of this aspect, after the polishing solution supply mechanism is covered by the first cover, the polishing solution supply mechanism is connected with the arm on the upper face of the first cover, and the location of connection of the polishing solution supply mechanism with the arm is covered by the second cover. This configuration facilitates mounting of the arm and more reliably covers the entirety of the polishing solution supply mechanism. The cover provided to cover the whole polishing solution supply mechanism is configured by the first cover and the second cover. This configuration enables the second cover to be formed in necessary and sufficient dimensions to cover the part exposed on the first cover. Compared with a case where a waterproof cover provided to appropriately cover the whole polishing solution supply mechanism is configured by one single member, this configuration ensures easy manufacture. This is likely to reduce the manufacturing cost including the material cost of the covers.

According to a thirty-third aspect, in the polishing apparatus of either the thirty-first aspect or the thirty-second aspect described above, the polishing solution supply device may have a pad body, and the pad body may be exposed on a bottom face of the first cover with keeping a predetermined clearance from the first cover.

In the polishing apparatus of this aspect, the configuration of providing a clearance between the pad body and the cover enables the pad body to be freely deformed corresponding to the unevenness of the polishing surface without causing the cover to interfere with the motion of the pad body. The contact face of the pad body may be bent and may not be flat, depending on the mounting structure of the pad body. Providing the clearance between the pad body and the cover, however, avoids such a potential problem.

According to a thirty-fourth aspect, in the polishing apparatus of the thirty-third aspect described above, the pad body may have a returned portion that is placed at a position higher than a bottom face thereof and that is protruded toward an upstream side with respect to a rotating direction of the polishing pad.

In the polishing apparatus of this aspect, the configuration of covering the whole polishing solution supply mechanism by the cover and providing the returned portion in the pad body suppresses or prevents the slurry from entering inside of the first cover.

According to a thirty-fifth aspect, in the polishing apparatus of the thirty-fourth aspect described above, the polishing solution supply device may further comprise one or a plurality of weights placed on the pad body.

In the polishing apparatus of this aspect, the returned portion provided in the pad body suppresses or prevents the slurry from adhering to one or the plurality of weights placed on the pad body.

According to a thirty-sixth aspect, the polishing apparatus of any one of the thirty-first to the thirty-fifth aspects described above may further comprise a waterproof structure provided to surround a location of connection of the suspending mechanism with the arm, and the waterproof structure may at least partly have a labyrinth structure.

In the polishing apparatus of this aspect, the waterproof structure having the labyrinth structure effectively suppresses or prevents the slurry from entering inside of the first cover. In other words, this configuration effectively suppresses or prevents the slurry from entering the polishing solution supply mechanism-side in the vicinity of the location of connection of the suspending mechanism with the arm.

According to a thirty-seventh aspect, in the polishing apparatus of the thirty-sixth aspect described above, the waterproof structure may comprise a first waterproof wall provided to be protruded from an upper face of the second cover and to surround a location of connection of the suspending mechanism with the arm: second waterproof walls provided on respective sides of the arm to be extended continuously from the first waterproof wall and along the arm with keeping clearances from the arm; and third waterproof walls provided on respective side faces of the arm to be extended along the arm and placed outside of the respective second waterproof walls with keeping clearances from the respective second waterproof walls and to be terminated with keeping clearances from the first waterproof wall. The first waterproof wall, the second waterproof walls and the third waterproof walls may constitute a seal of the labyrinth structure.

In the polishing apparatus of this aspect, the location of connection of the suspending mechanism with the arm is covered by the first waterproof wall, and the waterproof seal of the labyrinth structure is provided around the arm adjacent to the first waterproof wall. This configuration more reliably suppresses or prevents the slurry from entering the polishing solution supply mechanism-side in the vicinity of the location of connection of the suspending mechanism with the arm.

According to a thirty-eighth aspect, the polishing apparatus of any one of the nineteenth to the thirty-seventh aspects described above may further comprise a cleaning device placed outside of the polishing pad and configured to clean the polishing solution supply device.

The configuration of this aspect enables the polishing solution supply device moved to outside of the polishing pad to be cleaned by the cleaning device (for example, by using a cleaning nozzle). This washes away the slurry, the polishing residue and the like adhering to the polishing solution supply device. This configuration enables the polishing solution supply device to be cleaned without causing the slurry, the polishing residue and the like washed away during cleaning to remain on the polishing surface of the polishing pad.

According to a thirty-ninth aspect, there is provided a method of polishing an object by using a polishing pad having a polishing surface. The method comprises lowering an arm connected with a polishing solution supply device to land the polishing solution supply device on the polishing surface, and subsequently further lowering the arm to release the polishing solution supply device from the arm; causing a polishing solution to be supplied from the polishing solution supply device onto the polishing surface, and pressing and polishing the object against the polishing surface with rotating the polishing pad and/or the object; and lifting up the arm after termination of polishing to cause the polishing solution supply device to be held by the arm, and lifting up the polishing solution supply device together with the arm.

The configuration of this aspect enables the polishing solution supply device to be placed on the polishing surface in the state that the polishing solution supply device is released from the arm holding in the course of a polishing process. This configuration also enables the polishing solution supply device to be brought into contact with the polishing surface independently of the position of the arm, by the load of, for example, a weight or an airbag. The configuration that enables the polishing solution supply device to follow the polishing surface of the polishing pad independently of the arm suppresses inclination of the polishing solution supply device and vibration of the polishing solution supply device caused by a friction torque generated between the polishing solution supply device and the polishing pad and thereby suppresses the non-uniform contact state of the polishing solution supply device with the polishing pad. This stabilizes the polishing performance. This configuration also causes the polishing solution supply device to be lifted up by the arm and thereby facilitates maintenance of the polishing solution supply device and/or the polishing pad.

According to a fortieth aspect, the method of the thirty-ninth aspect described above may further comprise after lifting up the polishing solution supply device together with the arm, turning the arm to horizontally move the polishing solution supply device to outside of the polishing pad.

The configuration of this aspect enables the polishing solution supply device in the suspended state to be turned and moved to outside of the polishing pad for the purpose of maintenance such as cleaning. Cleaning the polishing solution supply device enables the slurry, the polishing residue and the like adhering to the polishing solution supply device to be washed away. This enables the polishing solution supply device to be cleaned without causing the slurry, the polishing residue and the like washed away during cleaning to remain on the polishing surface of the polishing pad. This configuration also enables the position of the polishing solution supply device to be readily adjusted on the polishing surface.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit respective constituent elements described in the claims and the specification in a range where at least a part of the above-mentioned problem can be solved or a range where at least a part of the effect is exhibited.

The present application claims priorities from the Japanese patent application No. 2020-038725 filed on Mar. 6, 2020, the Japanese patent application No. 2020-044050 filed on Mar. 13, 2020, and the Japanese patent application No. 2021-002919 filed on Jan. 13, 2021. The entire disclosures of the Japanese patent application No. 2020-038725 filed on Mar. 6, 2020, the Japanese patent application No. 2020-044050 filed on Mar. 13, 2020, and the Japanese patent application No. 2021-002919 filed on Jan. 13, 2021, including the specifications, the claims, the drawings and the abstracts are incorporated herein by reference in their entireties.

The entire disclosures of U.S. Pat. No. 7,086,933 (Patent Document 1), Japanese Unexamined Patent Publication No. H10-217114 (Patent Document 2), Japanese Patent No. 2903980 (Patent Document 3), Japanese Unexamined Patent Publication No. H11-114811 (Patent Document 4), Japanese Unexamined Patent Publication No. 2019-520991 (Patent Document 5) and U.S. Pat. No. 8,845,395 (Patent Document 6), including the specifications, the claims, the drawings and the abstracts are incorporated herein by reference in their entireties.

REFERENCE SIGNS LIST

1, 1-A, 1-B. 1-C, polishing apparatus
20 polishing table
30 polishing head (substrate holder)
31 shaft
34 support arm
40 polishing solution supply device
40-1 polishing solution supply system
41 polishing solution supply member
41-1 polishing solution supply device
45 following mechanism
46 suspending mechanism
50 atomizer
51 pivot
60 arm
60*a* leading end portion (leading end side portion)
60*b* base end portion
61 link member
70 lifting turning mechanism
71 waterproof box
72 waterproof box
80 lifting mechanism
81 lift cylinder
82 axis
83 ball spline
84 axis
85 frame
86 sensor
90 tuning mechanism
92 shaft
93 motor
100 polishing pad
102 polishing surface
120 polishing solution supply line
125 flow rate regulating mechanism
130 fluid line
140 electric cable
200 controller
300 cleaning mechanism
301 cleaning nozzle
300-1 cleaning nozzle
302 drying nozzle
350-A, 350-B cleaning device

400 robot (transport device)
400-1 polishing solution supply mechanism
410 supply member body (pad body)
410*a* supply surface
410*b* back face
410*c* convex
410*d* protrusion
414 polishing solution supply port (supply port)
418 bottom face
419 slit
420 buffer portion
421 O-ring
422 packing
423 weight
424 through hole
430 cover member (cover)
431 through hole
434 bracket
435, 435A mounting portion
440 packing
450 arm-side stopper
451 upper face
451*a* stepped face (stopper face)
452 through hole
454 shaft
455 pad-side stopper
456 engagement portion
457 pad-side stopper
460 spherical joint assembly
461*a* housing
461*b* spherical joint
462 arm
463 retainer-stopper
464 groove
465 rod
466 rod end
466*a* spherical joint
467 shaft
470 bracket
480 handle
500 load port
500-1 cover
510 main cover
511 lower cover
512 upper cover
520 auxiliary cover
531 opening
532, 533, 534 waterproof walls
535 bent portion
536 support column
541 upper wall
542 opening
543 stepped portion
544,545 bottom face portions
546 opening
547 clearance
560 returned portion
600 dryer device
1000 processing system
AA, BB, CC virtual axes
DI diameter
RA radius
WF substrate

What is claimed is:

1. An apparatus for polishing, comprising:

a table configured to support a polishing pad;

a polishing head configured to hold an object; and a polishing solution supply device configured to supply a polishing solution between the polishing pad and the object, the apparatus causing the polishing pad and the object to be in contact with each other and to be rotated relative to each other in presence of the polishing solution and thereby polishes the object, wherein the polishing solution supply device comprises a plurality of polishing solution supply ports arrayed in a direction intersecting with a rotating direction of the polishing pad in a state that the polishing solution supply device is placed on an upstream side in rotation of the polishing pad relative to the object, and the polishing solution supply device supplies the polishing solution, such that the polishing solution supplied from the plurality of polishing solution supply ports has a predetermined flow rate distribution, wherein the polishing solution supply device further comprises:

a polishing solution supply member configured to supply the polishing solution;

an arm configured to hold the polishing solution supply member, and wherein the polishing solution supply device has the plurality of polishing solution supply ports formed in an equal distance range from a corresponding position on a trajectory of rotation of the polishing pad corresponding to a center of rotation of the object toward positions corresponding to respective outer circumferences of the object and configured to supply the polishing solution such as to increase a flow rate of the polishing solution in the range from the corresponding position on the trajectory of rotation of the polishing pad corresponding to the center of rotation of the object toward the positions corresponding to the respective outer circumferences of the object, wherein the plurality of polishing solution supply ports have opening centers thereof arranged at equal intervals and have opening diameters increasing by discrete predetermined fixed number steps, from the corresponding position on the trajectory of rotation of the polishing pad corresponding to the center of rotation of the object toward the positions corresponding to the respective outer circumferences of the object, or wherein the plurality of polishing solution supply ports have an identical opening diameter and have intervals of the respective polishing solution supply ports decreasing by discrete predetermined fixed number steps, from the corresponding position on the trajectory of rotation of the polishing pad corresponding to the center of rotation of the object toward the positions corresponding to the respective outer circumferences of the object.

2. The apparatus according to claim 1, wherein the plurality of polishing solution supply ports have opening diameters of 0.3 to 2 mm.

3. The apparatus according to claim 1, wherein the polishing solution supply device has the plurality of polishing solution supply ports formed in a range corresponding to a diameter of the object and configured to supply the polishing solution such as to have a uniform flow rate distribution of the polishing solution in the range.

4. The apparatus according to claim 3, wherein the plurality of polishing solution supply ports have an identical opening diameter and are arranged at equal intervals in the range corresponding to the diameter of the object or in the range corresponding to the radius of the object on the side nearer to the center of rotation of the polishing pad.

5. The apparatus according to claim 1, wherein the polishing solution supply device has the plurality of polishing solution supply ports formed in a range corresponding to a radius of the object on a side nearer to a center of rotation of the polishing pad and configured to supply the polishing solution such as to have a uniform flow rate distribution of the polishing solution in the range.

6. The apparatus according to claim 1, wherein the polishing solution supply member is configured to be swingable on the polishing pad by a turning motion of an arm.

7. The apparatus according to claim 1, wherein the polishing solution supply member is configured to be slidingly movable in a first direction where the plurality of polishing solution supply ports are arrayed, in a second direction perpendicular to a polishing surface of the polishing pad, and in a third direction orthogonal to both the first direction and the second direction.

8. The apparatus according to claim 1, wherein the polishing solution supply member is configured to be rotatable about respective virtual axes in a first direction where the plurality of polishing solution supply ports are arrayed, in a second direction perpendicular to a polishing surface of the polishing pad, and in a third direction orthogonal to both the first direction and the second direction.

9. The apparatus according to claim 1, further comprising:

a cleaning mechanism configured to supply a cleaning solution to the polishing solution supply device turned to outside of the polishing pad by a turning motion of an arm.

10. A system for processing configured to process an object, the processing system comprising:

the apparatus according to claim 1;

a rinser configured to clean the object polished by the apparatus;

a dryer configured to dry the object cleaned by the rinser; and a robot configured to transport the object between the apparatus, the rinser and the dryer.

11. The apparatus according to claim 1, wherein the polishing solution supply device further comprises a flow rate regulating mechanism configured to regulate a flow rate of the polishing solution supplied from the polishing solution supply member, wherein the arm is configured to be turnable about a pivot placed outside of the polishing pad, and the polishing solution supply member further comprises a buffer portion that is connected with the flow rate regulating mechanism and with the plurality of polishing solution supply ports.

12. The apparatus according to claim 11, wherein the buffer portion comprises first and second direction sizes along first and second directions perpendicular to one another, the first direction size is a size within which two or more of the polishing solution supply ports can be located along the first direction, and the second direction size is a size within which two or more of the polishing solution supply ports can be located along the second direction.

13. The apparatus according to claim 1, wherein the polishing solution supply member comprises a supply surface on which the plurality of polishing solution supply ports are provided, and the polishing solution supply member comprises a configuration that (a) the supply surface is provided with a slope in a tapered shape on a short side direction side of the supply surface, (b) the supply surface is provided with a convex in an outer circumferential part of the plurality of polishing solution supply ports, or (c) the supply surface is provided with a protrusion where the plurality of polishing solution supply ports are formed.

14. An apparatus for polishing, comprising:

a table configured to support a polishing pad;

a polishing head configured to hold an object; and a polishing solution supply device configured to supply a polishing solution between the polishing pad and the object, the apparatus causing the polishing pad and the object to be in contact with each other and to be rotated relative to each other in presence of the polishing solution and thereby polishes the object, wherein the polishing solution supply device comprises a plurality of polishing solution supply ports arrayed in a direction intersecting with a rotating direction of the polishing pad in a state that the polishing solution supply device is placed on an upstream side in rotation of the polishing pad relative to the object, and the polishing solution supply device supplies the polishing solution, such that the polishing solution supplied from the plurality of polishing solution supply ports has a predetermined flow rate distribution, wherein the polishing solution supply device has the plurality of polishing solution supply ports formed in an equal distance range from a corresponding position on a trajectory of rotation of the polishing pad corresponding to a center of rotation of the object toward positions corresponding to respective outer circumferences of the object and configured to supply the polishing solution such as to increase a flow rate of the polishing solution in the range from the corresponding position on the trajectory of rotation of the polishing pad corresponding to the center of rotation of the object toward the positions corresponding to the respective outer circumferences of the object, and wherein the plurality of polishing solution supply ports have opening centers thereof arranged at equal intervals and have opening diameters increasing by discrete predetermined fixed number steps, from the corresponding position on the trajectory of rotation of the polishing pad corresponding to the center of rotation of the object toward the positions corresponding to the respective outer circumferences of the object.

15. An apparatus for polishing, comprising:

a table configured to support a polishing pad;

a polishing head configured to hold an object; and a polishing solution supply device configured to supply a polishing solution between the polishing pad and the object, the apparatus causing the polishing pad and the object to be in contact with each other and to be rotated relative to each other in presence of the polishing solution and thereby polishes the object, wherein the polishing solution supply device comprises a plurality of polishing solution supply ports arrayed in a direction intersecting with a rotating direction of the polishing pad in a state that the polishing solution supply device is placed on an upstream side in rotation of the polishing pad relative to the object, and the polishing solution supply device supplies the polishing solution, such that the polishing solution supplied from the plurality of polishing solution supply ports has a predetermined flow rate distribution, wherein the polishing solution supply device has the plurality of polishing solution supply ports formed in a range corresponding to a radius of the object on a side nearer to a center of rotation of the polishing pad and configured to supply the polishing solution such as to increase a flow rate of the polishing solution in the range from a corresponding position on a trajectory of rotation of the polishing pad corresponding to a center of rotation of the object toward a position corresponding to an outer circumference of the object on the side nearer to the center of rotation of the polishing pad, and wherein the plurality of polishing solution supply ports have opening centers thereof arranged at equal intervals and have opening diameters increasing by discrete predetermined fixed number steps, from the corresponding position on the trajectory of rotation of the polishing pad corresponding to the center of rotation of the object toward the position corresponding to the outer circumference of the object on the side nearer to the center of rotation of the polishing pad.

16. An apparatus for polishing, comprising:

a table configured to support a polishing pad;

a polishing head configured to hold an object; and a polishing solution supply device configured to supply a polishing solution between the polishing pad and the object, the apparatus causing the polishing pad and the object to be in contact with each other and to be rotated relative to each other in presence of the polishing solution and thereby polishes the object, wherein the polishing solution supply device comprises a plurality of polishing solution supply ports arrayed in a direction intersecting with a rotating direction of the polishing pad in a state that the polishing solution supply device is placed on an upstream side in rotation of the polishing pad relative to the object, and the polishing solution supply device supplies the polishing solution, such that the polishing solution supplied from the plurality of polishing solution supply ports has a predetermined flow rate distribution, wherein the polishing solution supply device has the plurality of polishing solution supply ports formed in an equal distance range from a corresponding position on a trajectory of rotation of the polishing pad corresponding to a center of rotation of the object toward positions corresponding to respective outer circumferences of the object and configured to supply the polishing solution such as to increase a flow rate of the polishing solution in the range from the corresponding position on the trajectory of rotation of the polishing pad corresponding to the center of rotation of the object toward the positions corresponding to the respective outer circumferences of the object, and wherein the plurality of polishing solution supply ports have an identical opening diameter and have intervals of the respective polishing solution supply ports decreasing by discrete predetermined fixed number steps, from the corresponding position on the trajectory of rotation of the polishing pad corresponding to the center of rotation of the object toward the positions corresponding to the respective outer circumferences of the object.

17. An apparatus for polishing, comprising:

a table configured to support a polishing pad;

a polishing head configured to hold an object; and a polishing solution supply device configured to supply a polishing solution between the polishing pad and the object, the apparatus causing the polishing pad and the object to be in contact with each other and to be rotated relative to each other in presence of the polishing solution and thereby polishes the object, wherein the polishing solution supply device comprises a plurality of polishing solution supply ports arrayed in a direction intersecting with a rotating direction of the polishing pad in a state that the polishing solution supply device is placed on an upstream side in rotation of the polishing pad relative to the object, and the polishing solution supply device supplies the polishing solution, such that the polishing solution supplied from the plurality of polishing solution supply ports has a predetermined flow rate distribution, wherein the polishing solution supply device has the plurality of polishing solution supply ports formed in a range corresponding to a radius of the object on a side nearer to a center of rotation of the polishing pad and configured to supply the polishing solution such as to increase a flow rate of the polishing solution in the range from a corresponding position on a trajectory of rotation of the polishing pad corresponding to a center of rotation of the object toward a position corresponding to an outer circumference of the object on the side nearer to the center of rotation of the polishing pad, and wherein the plurality of polishing solution supply ports have an identical opening diameter and have intervals of the respective polishing solution supply ports decreasing by discrete predetermined fixed number steps, from the corresponding position on the trajectory of rotation of the polishing pad corresponding to the center of rotation of the object toward the position corresponding to the outer circumference of the object on the side nearer to the center of rotation of the polishing pad.

18. An apparatus for polishing, comprising:

a table configured to support a polishing pad;

a polishing head configured to hold an object; and a polishing solution supply device configured to supply a polishing solution between the polishing pad and the object, the apparatus causing the polishing pad and the object to be in contact with each other and to be rotated relative to each other in presence of the polishing solution and thereby polishes the object, wherein the polishing solution supply device comprises a plurality of polishing solution supply ports arrayed in a direction intersecting with a rotating direction of the polishing pad in a state that the polishing solution supply device is placed on an upstream side in rotation of the polishing pad relative to the object, and the polishing solution supply device supplies the polishing solution, such that the polishing solution supplied from the plurality of polishing solution supply ports has a predetermined flow rate distribution, wherein the polishing solution supply device has the plurality of polishing solution supply ports formed in a range corresponding to a diameter of the object and configured to supply the polishing solution such as to increase a flow rate of the polishing solution in the range from a position corresponding to an outer circumference of the object on a side nearer to a center of rotation of the polishing pad toward a position corresponding to an outer circumference of the object on a side farther from the center of rotation of the polishing pad, and wherein the plurality of polishing solution supply ports have opening centers thereof arranged at equal intervals and have opening diameters increasing by discrete predetermined fixed number of steps, from the position corresponding to the outer circumference of the object on the side nearer to the center of rotation of the polishing pad toward the position corresponding to the outer circumference of the object on the side farther from the center of rotation of the polishing pad.

19. An apparatus for polishing, comprising:

a table configured to support a polishing pad;

a polishing head configured to hold an object; and a polishing solution supply device configured to supply a polishing solution between the polishing pad and the object, the apparatus causing the polishing pad and the object to be in contact with each other and to be rotated relative to each other in presence of the polishing solution and thereby polishes the object, wherein the polishing solution supply device comprises a plurality of polishing solution supply ports arrayed in a direction intersecting with a rotating direction of the polishing pad in a state that the polishing solution supply device is placed on an upstream side in rotation of the polishing pad relative to the object, and the polishing solution supply device supplies the polishing solution, such that the polishing solution supplied from the plurality of polishing solution supply ports has a predetermined flow rate distribution, wherein the polishing solution supply device has the plurality of polishing solution supply ports formed in a range corresponding to a diameter of the object and configured to supply the polishing solution such as to increase a flow rate of the polishing solution in the range from a position corresponding to an outer circumference of the object on a side nearer to a center of rotation of the polishing pad toward a position corresponding to an outer circumference of the object on a side farther from the center of rotation of the polishing pad, and wherein the plurality of polishing solution supply ports have an identical opening diameter and have intervals of the respective polishing solution supply ports decreasing by a discrete predetermined fixed number of steps, from the position corresponding to the outer circumference of the object on the side nearer to the center of rotation of the polishing pad toward the position corresponding to the outer circumference of the object on the side farther from the center of rotation of the polishing pad.

* * * * *